US006705060B1

(12) United States Patent
McGuinness et al.

(10) Patent No.: US 6,705,060 B1
(45) Date of Patent: Mar. 16, 2004

(54) METHOD AND APPARATUS FOR WRAPPING A COIL

(75) Inventors: James McGuinness, Alexandria, VA (US); Jan E Rhoads, Grapevine, TX (US)

(73) Assignee: Applied Technology Group, Inc., Alexandria, VA (US)

( * ) Notice: Subject to any disclaimer, the term of this patent is extended or adjusted under 35 U.S.C. 154(b) by 0 days.

(21) Appl. No.: 09/694,368

(22) Filed: Oct. 24, 2000

(51) Int. Cl.[7] ..... B65B 25/24
(52) U.S. Cl. ..... 53/409; 53/204; 53/504
(58) Field of Search ..... 53/409, 587, 589, 53/211, 204, 55, 504, 535, 393, 390

(56) References Cited

U.S. PATENT DOCUMENTS

| | | | | | |
|---|---|---|---|---|---|
| 1,630,834 | A | * | 5/1927 | Derry | 53/204 |
| 4,995,224 | A | * | 2/1991 | Yourgalite et al. | 53/540 |
| 5,095,684 | A | * | 3/1992 | Walker et al. | 53/443 |
| 5,299,410 | A | * | 4/1994 | Freeman | 53/442 |
| 5,352,080 | A | * | 10/1994 | Bakke | 414/24.5 |
| 5,459,977 | A | * | 10/1995 | Haberstroh | 53/399 |
| 5,533,321 | A | * | 7/1996 | Hooper et al. | 53/415 |
| 5,704,478 | A | * | 1/1998 | Born | 206/394 |
| 5,755,083 | A | * | 5/1998 | Cleine | 53/588 |
| 5,893,259 | A | * | 4/1999 | Posge | 53/448 |
| 6,050,057 | A | * | 4/2000 | Tuyn et al. | 53/376.2 |
| 6,122,895 | A | * | 9/2000 | Schubert | 53/55 |
| 6,298,634 | B1 | * | 10/2001 | Cramer | 53/410 |
| 6,349,526 | B1 | * | 2/2002 | Newman | 53/446 |
| 6,449,927 | B2 | * | 9/2002 | Hebron et al. | 53/501 |
| 6,505,534 | B2 | * | 1/2003 | Robertson et al. | 83/13 |
| 6,510,670 | B1 | * | 1/2003 | Janhonen | 53/209 |
| 2002/0029542 | A1 | * | 3/2002 | Davis et al. | 53/399 |
| 2002/0121199 | A1 | * | 9/2002 | Waltman | 99/419 |

* cited by examiner

*Primary Examiner*—Stephen F. Gerrity
*Assistant Examiner*—John Paradiso
(74) *Attorney, Agent, or Firm*—Nixon & Vanderhye, P.C.

(57) ABSTRACT

This disclosure describes an apparatus for wrapping all exposed surfaces of a large annular coil, including its hollow cylindrical core, to prevent contamination and to prepare it for shipping. A pair of opposing robotic arms hand off or transfer a roll of wrapping material, such as paper or plastic, from a gripper on one arm to a gripper on the other arm. The arms travel around both ends of the coil, handing off the roll back and forth above the coil and in the center of its hollow core, as it is slowly rotated by a variable-speed coil roller. The speed of the coil roller is adjusted such that the wrap overlaps during each successive pass around the coil, thereby ensuring its sealed integrity. A compact variable-tensioning mechanism, inserted into the roll, maintains constant tension on the wrapping material to keep it taut while being pulled around the coil. The work envelope of the robotic arms traveling around the coil is adjusted to the relative height and width of each new coil to minimize wrap time and reduce wear and tear.

153 Claims, 38 Drawing Sheets

METHOD AND APPARATUS FOR WRAPPING A COIL

BACKGROUND OF THE INVENTION

1. Field of The Invention

This invention comprises an apparatus and method for wrapping an annular object. More specifically, it relates to wrapping and sealing off the exposed surfaces of a large coil of sheet metal, e.g., steel, aluminum, copper, etc., thereby preventing rust and other deteriorations over extended periods of time while in storage or in transit. Such rusting is prevented in the present illustrative embodiments by wrapping all exposed surfaces of the coil with stretch wrap, a material well known in the industry. The wrapped surfaces include inside the "eye" (or hollow cylindrical center core) of the coil, formed when the sheet metal is originally wound around a mandrel. Although disclosed in terms of sheet metal coils, the invention is applicable to other annular objects including but not limited to coils of paper, cables, wires, hoses, chains, etc. Also, although disclosed in terms of stretch wrap under tension, the invention is applicable to other wrapping material dispensed from a roll, including but not limited to pre-stretched wrap, shrink wrap, paper wrap, cloth wrap, etc., and, in particular, stretch wrap treated with Vapor Corrosion Inhibitor (VCI) which also serves to preclude rust.

2. Background and Summary of the Invention

The need to seal annular steel coils by applying a wrap thereto is well known in the art. The following patents directed thereto are representative of those known to the inventors: U.S. Pat. No. 3,856,141 to Reed; U.S. Pat. Nos. 4,793,485 and 4,928,454 to Bertolotti; U.S. Pat. No. 5,282,347 to Clein; U.S. Pat. No. 5,501,058 to Sonoyama et al.; U.S. Pat. No. 5,755,083 to Clein et al.; U.S. Pat. No. 5,782,058 to Chadwick; U.S. Pat. No. 5,867,969 to Quinones; and U.S. Pat. No. 5,941,050 to Georgetti et al., the disclosures of which are all incorporated herein by reference. The necessity of wrapping steel coils and the difficulties to be overcome are detailed in these references and need not be repeated here.

So far as the present invention is concerned, the most pertinent of the prior art in this area are Clein and Clein et al., supra, helically wrap a rotating annulus by repeatedly passing a roll of wrapping material around successive radial portions of said annulus. These inventors have provided a wrapping apparatus comprising an endless oval track composed of two sections which are separated to allow insertion of a portion of the oval track through the hollow center core of the steel coil, after which the two sections are reunited. A self-propelled shuttle continuously travels around the resulting endless track. The shuttle carries a roll of wrapping material, which is applied to the slowly rotating coil as a long, continuous helical strip. A complex series of fixed and biased rollers are incorporated into the shuttle to maintain tension on the coil wrap, thereby increasing the size and complexity of the shuttle. While effective so far as prior inventions go, these patents have numerous and important disadvantages.

One major disadvantage of their disclosed systems is the complexity of the equipment, i.e., the track and supporting structure needed is large and cumbersome. Either the wrapping structure or the coil must be movable in order to be able to interleave the coil and the track. Clein, supra, prefers a movable trolley to support the coil, to transport it to and from the endless track, and to rotate it when in place; not an easy task in view of the size and weight of the coil, which by itself can weigh up to thirty tons. Clein et al., supra, move the coil on conveyer carriages from which they are lifted by drive rollers, an exceedingly complicated arrangement. Moreover, to house an endless track tall enough to handle the largest coils, both patents have resorted to cumbersome superstructures, several stories tall, that pose a potential physical hazard to overhead cranes.

A further disadvantage of both patents is the time required to wrap the coil. The endless track is of a fixed size, which remains the same regardless of whether the coil being wrapped is large or small; of necessity, the track has been designed to handle the maximum coil size contemplated for wrapping. Consequently, the time required for the shuttle to circle the track is at a maximum. Obviously, for smaller coils, the time wasted during each lap of the shuttle around the track accumulates into a good deal of time wasted for the wrapping the entire coil, and continues to accumulate when large batches of smaller coils are being wrapped.

Other disadvantages are inherent in their systems as well. For example, the aforementioned complex tensioning rollers on the shuttle to stretch the wrap are cumbersome and costly. They are also difficult to adjust and time consuming to reload when the wrap either runs out or is severed, e.g., due to adverse operating factors such as excessive tensioning of the wrap. Also, the operator of their systems must always return to the system console to select the next system command, which forces him or her to walk back and forth to the coil being wrapped and/or the next coil to be serviced.

The illustrative embodiments of the instant invention advantageously reduce the equipment needed to handle large coils, namely, down to a permanent work station with a coil roller capable of supporting and rotating a coil. This work station is serviced by a conventional overhead crane for lifting loading and unloading large coils.

In the illustrative embodiments, a plurality of such permanent work stations permit independent loading and unloading operations to be performed simultaneously, thereby increasing coil throughput and decreasing coil-to-coil processing time.

The illustrative embodiments further eliminate the need for a costly shuttle-track structure, which is both space-consuming and time-consuming, by adopting a less costly, space-efficient floor-mounted track system on which a pair of movable gantries travel in two directions. These gantries carry a pair of robotic wrapping mechanisms into precise position in a matter of seconds, both between the work stations and toward the coil loaded at each work station.

In accordance with at least one illustrative embodiment, a coil is wrapped and sealed solely by means of a pair of opposing robotic arms, whose movements are under variable control, in combination with a coil roller, which slowly rotates the coil about its cylindrical axis, and whose speed is also under variable control.

In accordance with at least one illustrative embodiment, a coil is completely wrapped and sealed by a pair of robotic arms passing a roll of wrapping material repeatedly through, and then around, each successive segment of the annulus of the coil as the coil is slowly rotated.

In accordance with at least one illustrative embodiment, the time needed to wrap said coil is minimized by adapting the range of vertical movements of the robotic arms to the height of the coil and by adapting the range of their horizontal movements to the width of the coil, based upon data collected via position and distance sensors, thereby adapting the "work envelope" of travel for the robotic arms down to the size of any given coil.

In accordance with at least one illustrative embodiment, the time needed to wrap said coil is minimized by adapting the rotational speed of the coil roller to the height and the width of the coil, based upon data collected via position and distance sensors, thereby adapting the rotating device to the size of any given coil.

In accordance with at least one illustrative embodiment, a wide range of gauges, or thickness, of stretch wrap is accommodated by providing variable amounts of tension to the wrap via a simple, compact, continuously-adjustable tensioning device built into each handle holding the roll, which can be quickly and easily adjusted by the operator.

In accordance with at least one illustrative embodiment, the wrap mechanism operates under the complete, automatic control of an off-the-shelf PC via flexible computer programs that are easy to update, change, or replace, as compared to the more rigid structure and logic of traditional Programmable Logic Controllers (PLCs).

In accordance with at least one illustrative embodiment, the operator selectively controls the complex, automated processes of the computer programs via a hand-held wireless remote control, where each of the steps necessary to wrap a coil is initiated by a single button push on the remote control, allowing the operator to stand near the coil being wrapped and issue commands, or walk to the next station and load the next coil.

In the illustrative embodiments of the present invention, the difficulties described earlier are overcome while accomplishing the above objectives, by providing a novel coil wrapping apparatus which performs a novel wrapping method, including, in different combinations, the exemplary components and steps of: loading a coil of sheet metal on a variable-speed motor-driven coil roller which slowly rotates the coil, positioning a pair of adaptable opposing robotic arm mechanisms to face each other at opposite ends of the coil, dispensing wrapping material under operator-selectable tension generated by variable-tension handles, and programming the robotic arms to exchange the roll of wrapping material back and forth to each other while carrying the roll repeatedly through and around each radial segment of the annulus of the coil as it rotates. An associated enclosure houses the system electronic components, such as power supplies, computer control boards, motor drives, sensor interfaces, etc., under control of a central processing unit (CPU) within a personal computer (PC), all of which serving to control the coil wrapper.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF,THE PREFERRED EMBODIMENT

Figure 1:
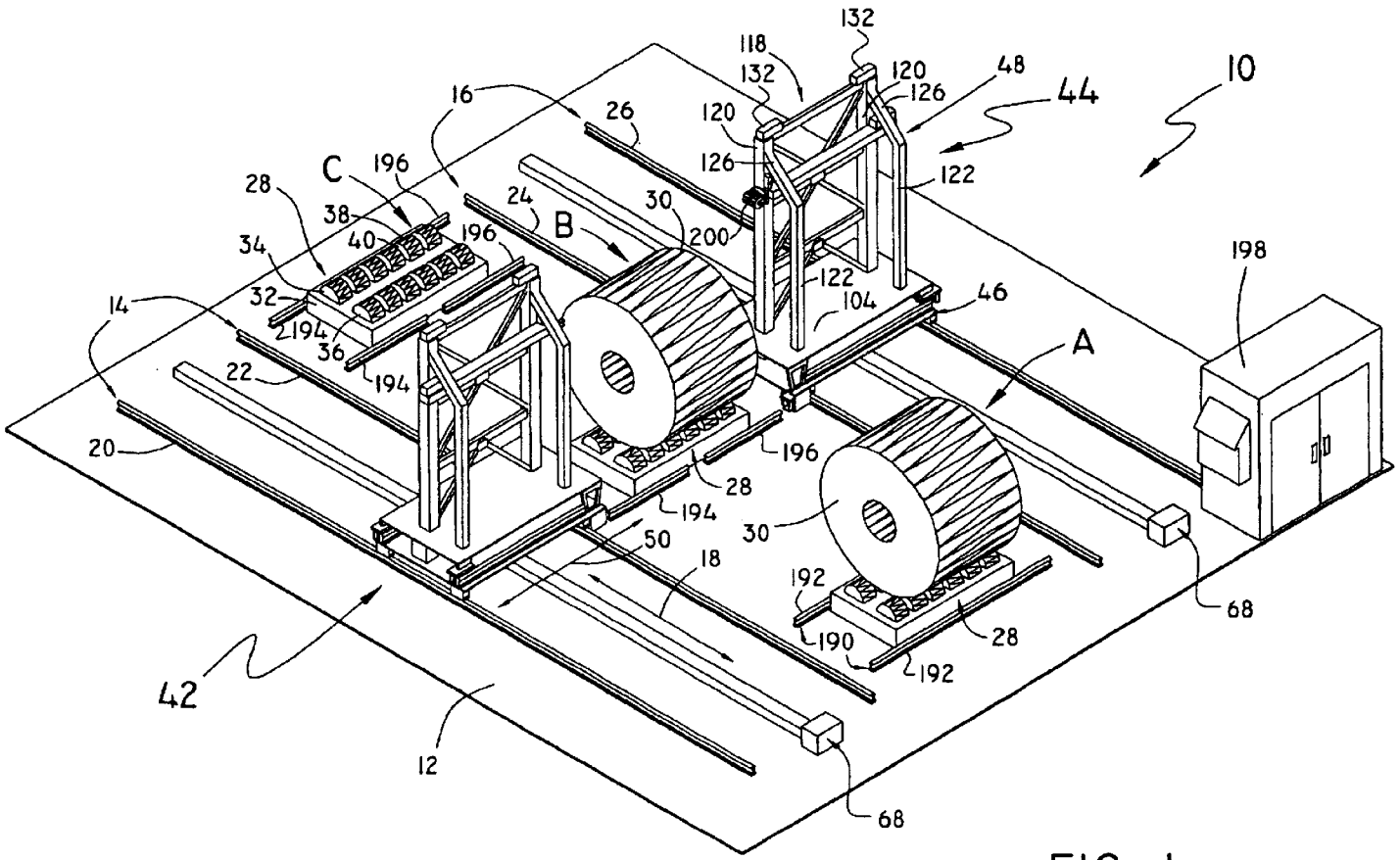
FIG. 1 is a schematic representation of a perspective view of a preferred embodiment of the present invention showing a coil wrapping production line in a plant including a plurality of coil wrapping stations.

The inventive apparatus utilized in a coil wrapping production line 10 for performing the inventive method is shown schematically in FIG. 1. Fixed to the plant floor 12 is a pair of parallel tracks 14 and 16, extending in what shall herein be referred to as the Z-axis direction, shown by the double-ended arrow 18. Each of tracks 14 and 16 comprises a set of parallel rails 20, 22 and 24, 26, respectively. Spaced between tracks 14 and 16 and positioned transversely thereto are three work stations A, B, and C, also fixed to plant floor 12, each of which includes a coil roller 28 designed to support and rotate a large coil 30.

In order to avoid unduly crowding the drawing, only the coil roller 28 in station C will be given reference numerals. It is to be understood, however, that all such coil rollers 28 are essentially identical, and the same reference numerals apply to corresponding components in stations A and B. The frame for coil roller 28 includes a base 32 within which are journalled a pair of parallel rotating rollers 34 and 36. Rollers 34 and 36 each include a plurality of non-skid polyurethane covers 38 separated by annular recesses 40, as is conventional in the art. A variable-speed gear motor (not shown) rotationally drives rollers 34, 36 in unison. A gear-driven chain (not shown) is the preferred mode of driving rollers 34, 36 in unison, but any tightly-coupled conventional drive mechanism will do. Rotating rollers 34, 36 are designed to support a single coil 30, as can be seen on work stations A and B. When driven by the drive motor, rollers 34, 36 will rotate coil 30 slowly, in synchronism with the wrapping operation to be described later.

One work station is sufficient for many of the illustrative embodiments to be practiced. For each additional work station, the method and apparatus for wrapping a single coil is replicated modularly as the most cost-effective expansion of the system. Thus, the three work stations shown herein become another illustrative embodiment of the invention. For instance, in FIG. 1, the coil at station A has already been wrapped and is awaiting transport to an outbound storage area; the coil at station B has just been delivered and is ready to be wrapped; and a coil will next be moved to station C by an overhead crane (not shown) from an inbound area. The advantage here is that any of the three operations can be performed simultaneously and independently on any combination of the three work stations. Production efficiency is thereby optimized in that this strategy makes best use of the overhead crane which has the longest turn-around time. Clearly, increasing the number of work stations can further optimize productivity. However, only one work station is required to practice many of the illustrative embodiments.

Fixing work stations A, B, and C to the plant floor 12 simplifies the equipment required to supply and remove coils 30. An overhead crane, (not shown), commonly used to move coils inside a plant, simply loads them or unloads them from any of the coil rollers 28, generally in less than a minute. This eliminates the elaborate structures shown in the prior art (see Clein and Clein et al, supra, for instance) for transporting coils to and from the work area.

Referring to FIG. 1, two gantries 42 and 44 perform the wrapping process, as will be described briefly below and in detail later on. Gantries 44 and 42, hereinafter referred to as the North and South, respectively, are mirror images of each other, so only one, North gantry 44, will be described. North gantry 44 comprises a station-to-station platform 46 for positioning gantry 44 relative to the work stations, and a coil-approach platform 104, for positioning a robotic wrapping mechanism, hereinafter referred to as robot 48, relative to coils 30 in order to wrap them. Platform 46 travels on track 16 in the Z-axis direction 18. North platform 104 travels orthogonally thereto in the X-axis direction, shown by the double-ended arrow 50. Robot 48 includes the high-speed mechanisms that actually wrap coil 30.

Figure 1A:
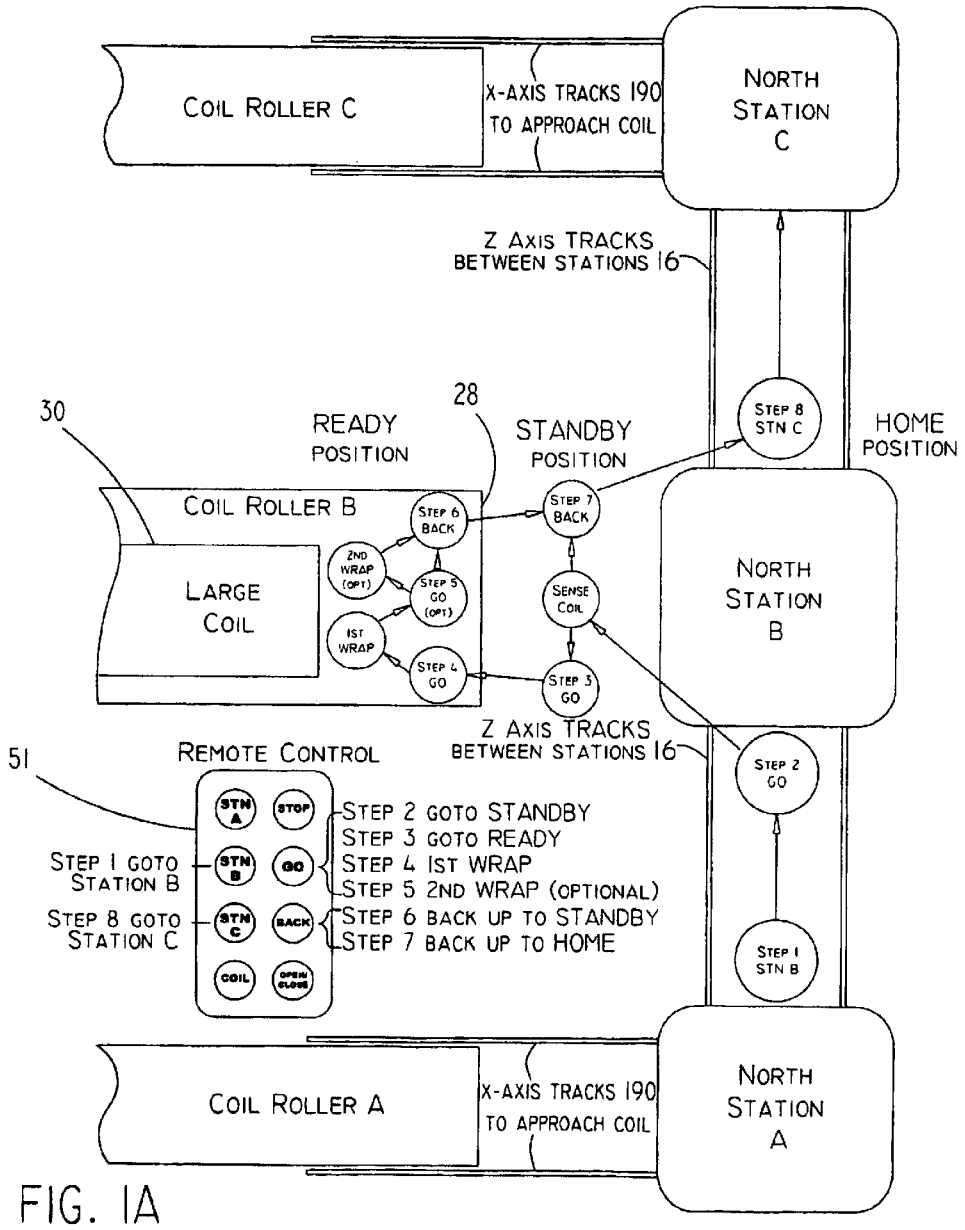
FIG. 1A is an overview process flowchart depicting the flow of steps to wrap a coil using the major elements shown in FIG. 1, via a remote control.

Before proceeding further into the specifics of the hardware structure, attention is directed to FIG. 1A for a brief overview of the wrapping process itself (discussed in greater depth in the hardware and software sections described later in FIGS. 24–37). FIG. 1A shows how simple the process flow is, as seen from the operator's point of view. The operator uses a convenient, hand-held remote control 51 to command eight basic steps, identified on the drawing by circled steps numbered and labeled Step 1, 2, . . . , 7, 8. The remote control 51 is a wireless remote (i.e., operating at a unique carrier frequency of 435 mHz), which allows the operator to move freely about the system.

The following points should be noted with respect to FIG. 1A: Only the North half of the system is shown; however, the South half is an exact mirror-image, both in its construction and its operation. The depictions of North Station A/B/C are merely symbolic reference positions on the Z-axis track 16 for purposes of discussion here, and do not imply any actual physical hardware at those, points. Similarly, the depictions of positions Home, Standby, and Ready are symbolic reference points on the X-axis tracks 190, and likewise do not imply any physical hardware. Finally, station-to-station platform 46 and coil-approach platform 104 (FIG. 1) are not shown here for clarity.

TABLE 1A summarizes the functions of remote control 51, showing the relationship of the plurality of remote control buttons to the plurality of operational functions they initiate, via a control processor (shown later in FIG. 24). The sequence of operating steps needed to wrap any given coil is shown on the right of TABLE 1A.

TABLE 1A

Summary of Remote Control Functions (refer to FIG. 1A)

| Remote Command | Operational Function(s) | Operating Step |
|---|---|---|
| (FIG. 1A) | (response to each buttonpush or 'hit') | (Table 1B) |
| Stn A | go to Station A | Step 8a |
| Stn B | go to Station B | Step 1 |
| Stn C | go to Station C | Step 8 |
| STOP | stop all current motion (1st hit) | as needed |
| | put system to 'sleep' (2nd hit) | when idle |
| GO | approach coil - go to Standby | Step 2 |
| | approach coil - go to Ready | Step 3 |
| | launch 1st wrap | Step 4 |
| | launch 2nd wrap (optional) | Step 5 |
| | if 'asleep', reawaken system | after STOP |
| BACK | backup from Ready to Standby | Step 6 |
| | backup from Standby to Home | Step 7 |
| | backup to, last position reached | after STOP |
| Open/Close | open grippers, or | as needed |
| | close grippers (alternating sequence) | |
| COIL | rotate Coil (CCW facing South) | as needed |

TABLE 1B delineates the sequence of operational steps needed to wrap any given coil, as shown in TABLE 1A, but in their numerical order of Steps 1, 2, . . . , 7, 8. In addition, TABLE 1B briefly describes the system response to the specific remote control command that initiates each step 1, 2, . . . , 7, 8. These system responses can be best understood by tracing their associated steps 1, 2, . . . , 7, 8 through the sequential process flow shown in FIG 1A (i.e., the sequence of circled steps therein).

TABLE 1B

Operational Steps to Wrap any given Coil (refer to FIG. 1A)

| Operating Step | Remote Control Command | System Response |
|---|---|---|
| Step 1 | Stn B | send platform 46 down Z-axis tracks 16 to Station B (used as an example) |
| Step 2 | GO | send platform 104 down X-axis tracks 190 to Standby (at end of the coil roller) |
| Step 2a | Sense Process | System raises and lowers robotic arms 48 to find the coil dimensions |
| Step 3 | GO | send platform 104 down X-axis tracks 190 to Ready (6" in front of the coil) |
| Step 4 | GO | If robotic arms 48 are in correct position, launch the 1st wrap (Wrap process follows) |
| Step 4a | Wrap Process (1st wrap) | System wraps the coil according to data collected during the Sense process |
| Step 5 (optional) | GO | if a 2nd wrap is required, launch the 2nd wrap (Wrap process follows) |
| Step 5a (optional) | Wrap Process (2nd wrap) | Same as Step 4a, except the coil rotates approximately 67% faster |
| Step 6 | Back | backup platform 104 from Ready to Standby (away from the coil) |
| Step 7 | Back | backup platform 104 from Standby to Home (back upon Z-axis tracks) |
| Step 8 (optional) | Stn C | send platform 46 down Z-axis tracks 16 to Station C (if next coil is loaded there) |
| Step 8a (optional) | Stn A | alternatively, send platform 46 to Station A (if next coil is loaded there) |

As depicted in FIG. 1A, the hand-held remote control 51 comprises eight large (three-quarter inch) buttons which activate all of the commands needed to operate the system. TABLE 1A delineates the commands assigned to each of these buttons, and TABLE 1B gives the system's response to each of the eight commands needed to wrap a given coil.

Stations A/B/C are located equidistant along the Z-axis tracks 16, with tracks 190 and respective coil rollers 28 being perpendicular to track 16.

Assume that initially gantry 44 is located at station A, and the coil 30 to be wrapped is at station B. Robot 48 is in the Home position. The Home position is where the X-axis platform 104 (FIG. 1) is completely backed up onto platform 46 of gantry 44. It is only safe to move the X-axis platform down the Z-axis tracks when it has reached this fully-retracted position.

At Step 1 (FIG. 1A), the; operator pushes button STN B which tells the gantry 44 to go to station B (TABLE 1A). The system responds by sending platform 46 down the Z-axis track 16 to station B. Upon arriving at any given station, high-precision lasers mounted on the robotic arms 48 (FIG. 13) verify that both platforms and both arms are Home at the same station (i.e., that they are across from each other on their Z-axis tracks, approximately 16 feet apart). The system stops at station B and awaits the operator's next command.

At Step 2 (FIG. 1A), the operator pushes the GO button for the first time. The system responds by sending platform 104, and thereby robot 48, down tracks 190 to the Standby position (TABLE 1A), where it stops.

The Standby position (FIG. 1A) is adjacent to the outside edge of the coil roller 28 where sensors on the robotic arms can more accurately detect the presence of a coil and its dimensions (e.g., its ID and OD). This intermediate position puts the X-axis platform 104 as close to the target coil 30 as it can get without running into the end face of the widest coil for which the system is designed. As with most distance sensors, the nearer they are to the target, the more accurate their sensing—hence, Standby helps ensure that the system gets the most accurate distance data, typically to the nearest ¼". When robot 48 is at Standby, the operator has another chance to rotate the coil to a better position or to load a new roll of wrapping material. As shown in FIG. 1A, the system automatically takes over at Step 2*a* to 'sense' the coil dimensions (inside diameter, outside diameter, etc.) so that it can adapt the wrapping process to the size of any given coil to be wrapped. The sense process takes about 6–8 seconds, depending on the size of the coil.

At Step 3 (FIG. 1A), the operator pushes the GO button a second time, which sends platform 104 to the Ready position. The Ready position (FIG. 1A) is defined as six inches clearance away from the face of the coil to the rotational axis of the roll 200. Inasmuch as coil 30 is never placed in the exact end-to-end center of coil roller 28, the North and South robots will never be the exact same distance from the end faces of the coil. Furthermore, the end-to-end width of any given coil can vary by as much as 5½ feet. By definition, then, the Ready position is a variable distance from the fixed Standby position and is different for each robot. The system determines the distance each robot must travel to get from Standby to Ready via a pair of range-finding photocells mounted on the robotic arms 128 (FIG. 13). This distance is critical, since it defines how far the X-axis platforms must go from Standby to Ready without running into the coil. Equally important, it defines how far the pistons 136 must go for the grippers 138 to meet each other at the center of the coil, without colliding with each other by so much as a ¼" (see FIGS. 6–12). Once both North and South robots are positioned at their respective Ready positions, the robots are ready to wrap the coil.

At Step 4, the operator pushes the GO button a third time to instruct the robots to begin wrapping the coil. The system again automatically takes over at Step 4*a*/5*a* to At Step 4, the operator pushes the GO button a third time to instruct the robots to begin wrapping the coil. The system again automatically takes over at Step 4*a*/5*a* to 'wrap' the coil (FIGS. 6–12) in conformance with the dimensional data just sensed. The Wrap process for a typical coil takes 3–5 minutes, again depending on its size.

During these automatic wrap processes, the operator is free to work elsewhere (e.g., on the next coil). As a safeguard, the operator can STOP the system at any time With the STOP button, and/or can BACK up at any point to the last position reached.

As an option, anytime prior to the wrap process (Step 4*a*), the operator can open and close the grippers to load a fresh new roll of wrapping material via remote button Open/Close. Also, via remote button COIL, the operator can rotate the coil counter-clockwise (facing South) as much as desired, e.g., to clear a 'sagging' coil lap from the top of the ID.

At Step 5, once the coil is wrapped a first time, the operator has the option to wrap it a second time. If he/she chooses to do so, the operator presses the GO button a fourth time to instruct the robots to wrap the coil again. At Step 5*a* (FIG. 1A), the second wrap follows the same process as the first wrap, but the rotating speed of the coil is increased by about two-thirds, i.e., to create a smaller 'overlap' of 1–2 inches. Platform 104 remains at the Ready position after the coil has been wrapped.

At Step 6, the operator instructs the robots to return to the Standby position by pressing the BACK button a first time. At Step 7, the operator presses the BACK button a second time to return the robots to their Home position on platform 46 of gantry 44. At Step 8, the operator can move on to station C (or station A) to wrap the next coil.

Of the three programmed positions, Home, Standby, and Ready, all are fixed except Ready, which by definition varies with the width and position of the coil. Hence, all positions but Ready are monitored and validated by non-contact Hall effect sensors, which provide high-precision positional feedback to the control CPU (discussed in the flowcharts of FIGS. 25–37). The use of off-the-shelf sensors to sense, feedback, and test such repetitive positional data is old and well-established in the art, so that it is not shown or discussed at length herein.

Putting FIG. 1A in perspective, the streamlined process flow shown therein has simplified the relatively complex operations and interactions of 20-odd devices (most of them at very high speeds) down to a few simple remote control 'hits' or button-pushes. That is, behind each button-push on the remote control, there are literally tens of functions and hundreds of instructions that implement that 'hit' (as is discussed in detail in FIGS. 25–37). Thus, the remote control, is more than a mere convenience for the operator, it permits an operator with minimal education to operate a relatively complex wrapping system with but a few minutes of training.

Figure 2:
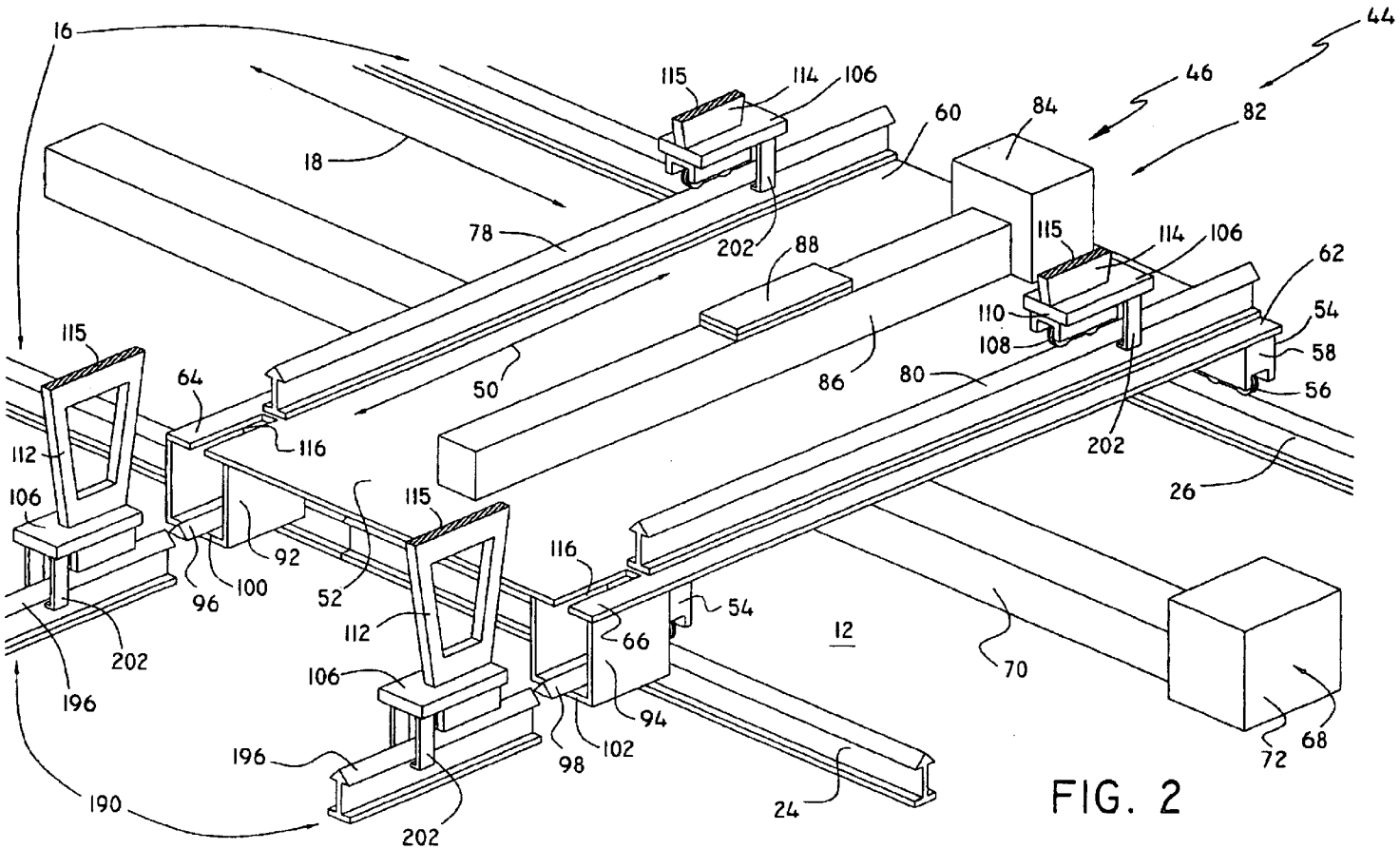
FIG. 2 is a perspective view of a portion of a gantry, including a movable station-to-station platform and the tracks on which it travels, to position robotic arms relative to workstations that support the coils to be wrapped according to the invention of FIG. 1.

FIG. 2 shows platform 46 in more detail. It comprises a flatbed 52 of approximately four by eight feet having wheel assemblies 54 fixed thereunder at each corner. Each wheel assembly 54 comprises a pair of wheels 56 journalled in wheel mounts 58. Two of the wheel assemblies 54 are located at the rear two corners 60, 62, i.e., the corners furthest from stations A–C, and two other wheel assemblies 54 are offset from the front two corners 64, 66, those closest to stations A–C. Only the two wheel assemblies 54 at corners 62 and 66 can be seen in FIG. 2; the other two are hidden by flatbed 52. Wheels 56 are oriented such that platform 46 travels in the Z-axis direction 18 on tracks 16.

Located between rails 24 and 26 and parallel thereto is a long actuator 68 fixed to floor 12. Actuator 68 can be any conventional industrial drive mechanism for propelling platform 46 along track 16. The preferred actuator 68 comprises a 20-foot carriage driven by a long belt (not shown) with pulleys at each end, mounted in housing 70 and driven by motor 72, although a chain drive or worm gear would work just as well. The belt-driven carriage 74 is fixedly connected to the underside 76 of platform 46 (FIG. 3) and is driven by motor 72 via a coupling gear. Actuator 68 moves gantry 44 along tracks 16 in order to properly position robot 48 relative to one of the work stations A, B, or C, a process to be described later.

Figure 3:
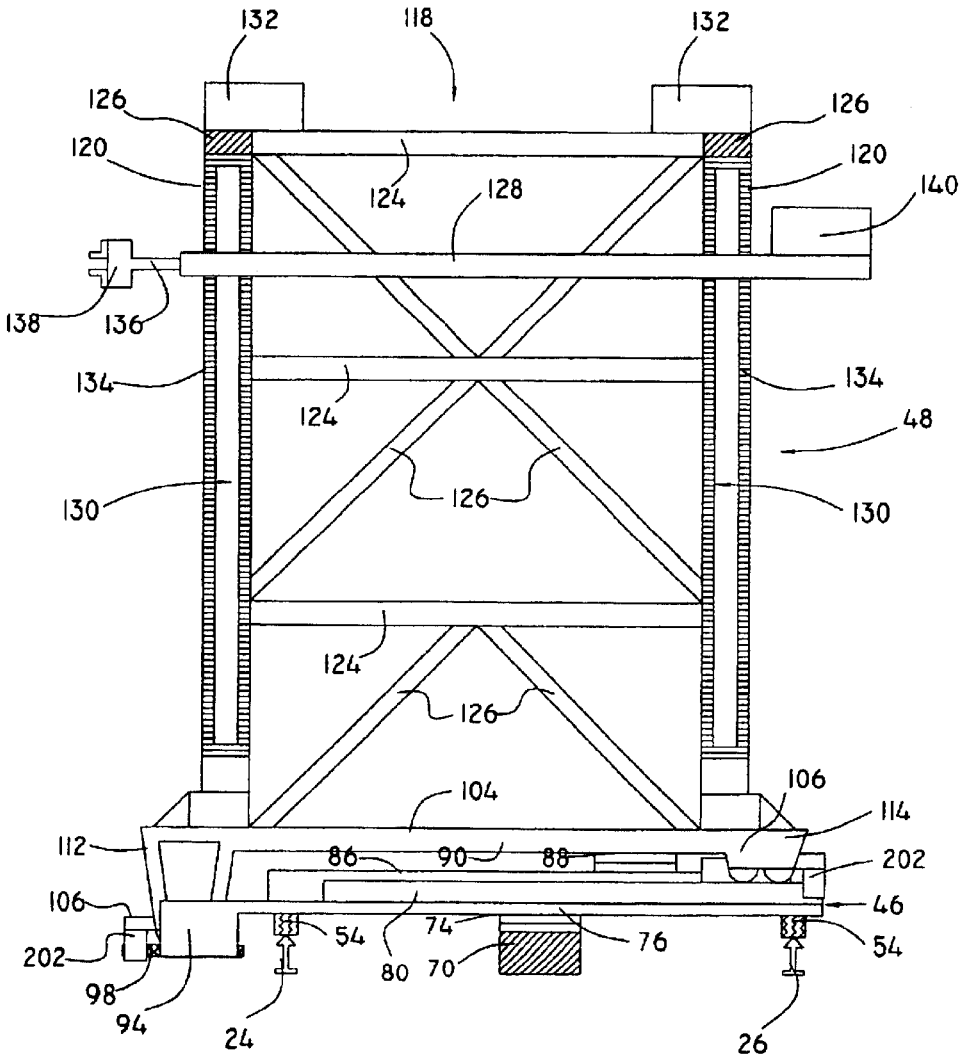
FIG. 3 is a front view, partially in cross-section, of the gantry including the movable coil-approach platform and the vertical chassis that supports the robotic wrapping mechanism (robot) according to the invention of FIG. 1.

Fixedly mounted on the top surface of flatbed 52 are a pair of parallel rails 78 and 80, which are spaced apart by approximately 4 feet and are perpendicular to track 16. A robot actuator 82 includes a drive motor coupling gear 84, a belt drive (not shown) in a housing 86, and a carriage 88 adapted to be connected to the underside 90 of robot 48 (FIG. 3). Actuator 82 functions substantially the same as actuator 68.

Beneath front corners 64 and 66 of flatbed 52 are affixed a pair of box-shaped wheel housings 92 and 94. A pair of stub rails 96 and 98 are centrally mounted within wheel housings 92 and 94 atop their bottom plates 100 and 102. Stub rails 96, 98 are parallel to rails 78 and 80, respectively, but are substantially lower than rails 78, 80 for a purpose which will be clear shortly.

Robot 48 includes a coil-approach platform 104 (FIG. 1) with four-wheel assemblies 106 fixed to the bottom thereof at its four corners (FIGS. 2–3). Wheel assemblies 106 are similar to wheel assemblies 54 on platform 46 with a pair of wheels 108 journaled in wheel mounts 110. Wheel mounts 110 are attached to platform 104 by two differently sized struts, front struts 112 and rear struts 114. In FIG. 2, platform 104 has been removed to show the wheel assemblies 106 and the front and rear struts 112, 114 more clearly. Platform 104 is attached to the top edges 115 of struts 112, 114, as is indicated by the cross-hatching thereon. As can be seen, front struts 112 are taller than rear struts 114, to allow the front wheel assemblies on stub rails 96, 98 to run a selected distance below the rear wheel assemblies on rails 78, 80. The distances therebetween allows the front wheels to roll off of stub rails 96, 98 onto rails 190 on the floor, while the rear wheels ride across rails 78 and 80, thereby keeping platform 104 essentially horizontal. All wheels 108 are oriented to travel in the X-axis direction 50. Slots 116 have been provided adjacent corners 64 and 66 of flatbed 52 to allow front wheel struts 112 to completely back up into Home position on platform 44. Front wheel assemblies 106 are retracted into the box-shaped wheel housings 92 and 94 i.e., to the right in FIG. 2. This gives their struts sufficient clearance from external structures so that gantry 44 can move freely between stations.

Turning to FIGS. 1 and 3, a vertical chassis 118 is affixed to and rises above platform 104. Vertical chassis 118 is made up of a pair of parallel, vertical slide actuators 120, a pair of parallel, vertical support posts 122 (FIG. 1), a plurality of horizontal cross members 124, and a plurality of diagonal braces 126, all of which are solidly fixed together as an integral unit, e.g., by welding, to provide substantial, long-term, vertical stability to robot 48. As seen more clearly in FIG. 3, which is a front view of robot 48 with the Z-axis in cross-section, a robotic arm 128 is attached to the vertical slide actuators 120, enabling reciprocal, vertical movement. Each of the slide actuators 120 is preferably belt-driven under the control of a servomotor 132 mounted atop the actuators 120. Servomotors 132 work synchronously to lift and lower robotic arm 128 in unison, so that robotic arm 128 is maintained horizontal at all times during the wrapping process. While a belt-driven slide is preferred, other drive mechanisms could be substituted, e.g., a rack and pinion, a worm gear and follower, or a sprocket and chain combination.

Robotic arm 128 houses a servo-driven, telescopic piston 136. Attached to the front of arm 128 is a robotic gripper assembly, hereinafter referred to as a gripper 138. A motor/coupling gear combination 140 is mounted on the back end of robotic arm 128 and powers piston 136 that quickly drives gripper 138 back and forth horizontally as required during the wrapping process. Each of the robotic arms 128 is a ballscrew driven rod, although the actuator could also be belt-driven, chain-driven, etc. The preferred ballscrew drive was chosen for its high resistance to deflection when fully extended. Outboard rod guides (not shown) flanking piston 136 further reduce robotic arm deflection, e.g., to ⅛ inch for a 48-inch extension in the present configuration.

Figures 4, 4A:
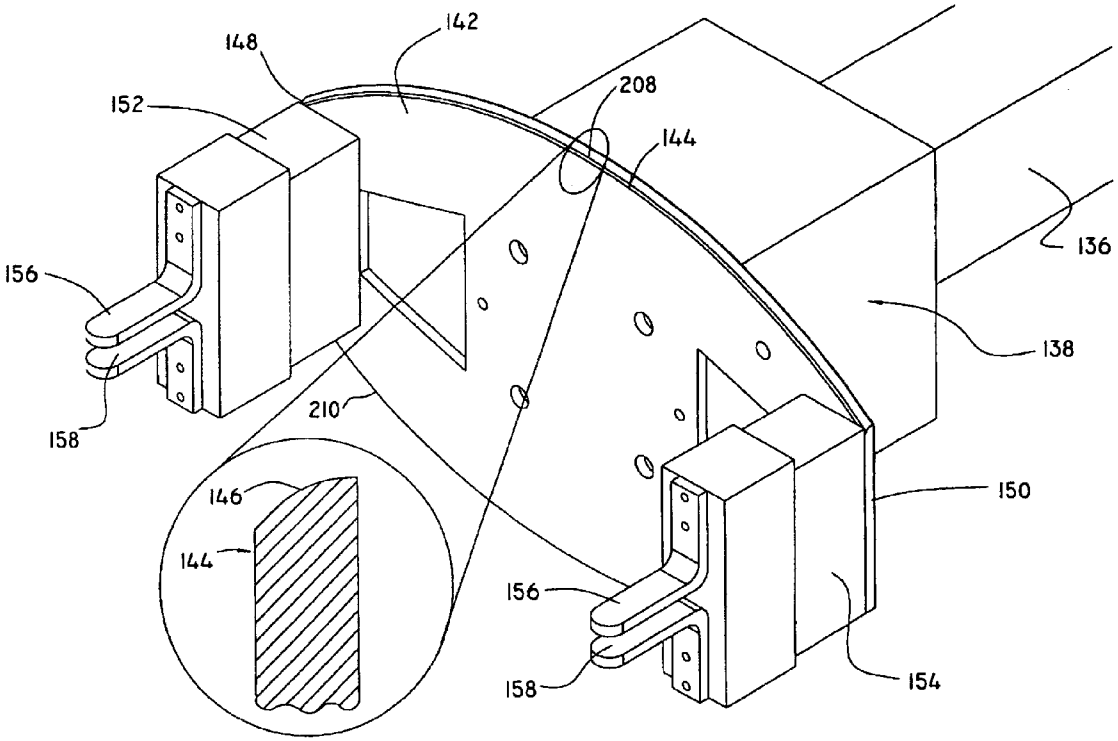
FIG. 4 is a perspective view of the gripper assembly that holds the roll of wrapping material according to the invention of FIG. 1.
FIG. 4A is a cross-sectional enlargement of one of the rounded-off rims of the gripper mounting plate.

FIG. 4 shows the complete assembly of gripper 138 in more detail. As an assembly, gripper 138 comprises a transverse, substantially oval, mounting plate 142 which is rigidly fixed to the front end of telescopic piston 136. The peripheral edge 144 of plate 142 is beveled or "rounded off" at 146, as shown in cross-section in FIG. 4A to allow the stretch wrap (not shown) to flow smoothly across its edges while under tension. Cantilevered from the truncated ends 148 and 150 of plate 142 are a pair of pneumatic grippers 152 and 154, respectively. Pneumatic grippers 152, 154 control a pair of opposing, upper and lower jaws 156 and 158. Both pairs of jaws are pneumatically controlled to open and close in unison. In this manner, they are capable of simultaneously gripping or releasing a pair of handles disposed at opposite ends of a roll of wrapping material, as will be discussed below in FIGS. 17–22.

Figure 5B:
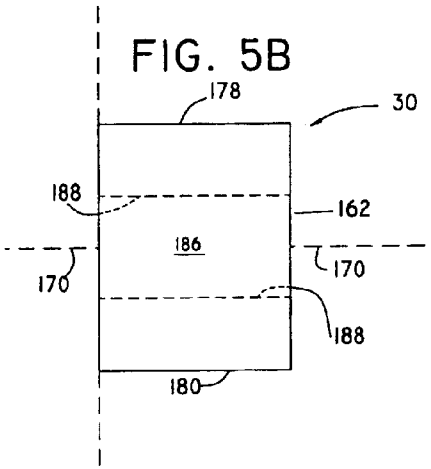
FIGS. 5A–5D show a perspective, front, side, and cross-sectional views of a typical coil of sheet metal to be wrapped by the invention of FIG. 1.
Figure 5D:
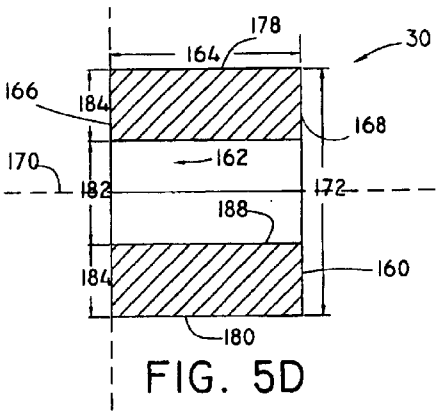
FIG. 5D [PRIOR ART]
Figure 5A:
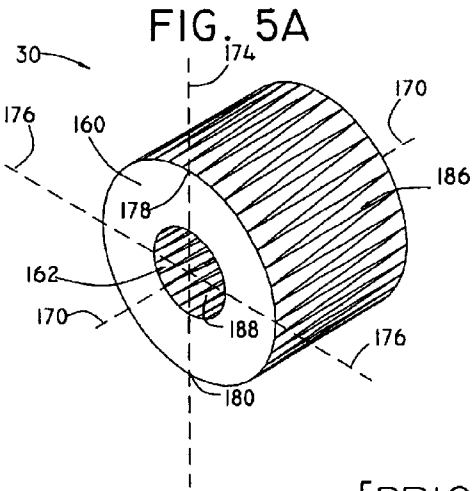
Figure 5C:
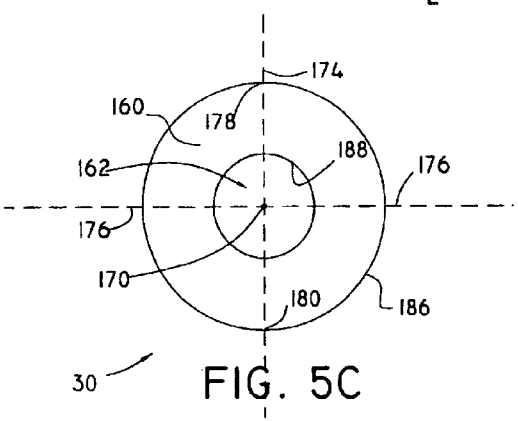

Before discussing the wrapping process in detail, it is expedient to describe a typical coil 30 with reference to FIGS. 5A–5D. Coil 30 is conventional in the art, as indicated by FIGS. 5A–5D, being collectively labeled as "PRIOR ART". Coil 30 comprises a continuous sheet of metal, spirally wound around a circular mandrel which, when the mandrel is removed, naturally forms a cylinder or annulus 160 with a hollow, cylindrical center core 162. Referring to FIG. 5D, coil 30 has an axial width 164 as measured between opposing end faces 166 and 168 along its cylindrical rotational axis 170. The height 172 of coil 30 is measured along the coils' vertical centerline 174 (equivalent to its outside diameter, or OD) from top 178 to bottom 180 (FIG. 5C). Hence, coil height 172 comprises the sum of the inside diameter 182 of center core 162 plus twice the thickness 184 of annulus 160. Coil 30 has a cylindrical, external, circumferential surface 186, also referred to as a side 186, and cylindrical core 162 has an internal surface 188 (FIG. 5A). When rotated by rollers 34 and 36 of coil roller 28, coil 30 rotates about its cylindrical rotational axis 170. These parameters will be referenced later in the description of the wrapping process.

Sheet metal coils 30 conventionally come in various sizes, typically from 3 to 7 feet in outside diameter, from one to six feet in end-to-end axial width, and up to 30 tons in weight. In addition, the inside diameter typically ranges from 20 to 28 inches. Although the present invention accommodates these typical ranges of coil dimensions, it would be obvious to extend this invention in any direction, if such a need should arise.

Returning to FIG. 1, it can be seen that each coil roller 28 is straddled by a track 190 (see station A) comprising parallel rails fixed to floor 12. Two embodiments of track 190 are shown in FIG. 1, one comprising a single, relatively long rail 192 on each side of the work station (station A), and the other comprises two relatively short rails 194 and 196 on each side of the work station (stations B and C). While either is suitable for the purpose, the two-rail embodiment is preferred, since shorter rails are easier to handle, ship, and install than longer rails.

The operation of several of the illustrative embodiments will now be described in general terms.

Referring still to FIG. 1, it has been assumed that coil 30 at station A has just been wrapped and is ready for removal, another coil 30 has been delivered to station B and is ready to be wrapped, and a new, unwrapped coil 30 (not shown) is being transported by an overhead crane to station C to be wrapped next. A Central Processing Unit (not shown) is housed in a cabinet 198 located on floor 12 near stations A–C. The CPU controls all operations of the wrapping process. The CPU is controlled by an internal program responsive to; an operator via a hand-held remote control, all of which will be described in more detail with reference to FIGS. 25–37. At present, a general explanation of the steps of the wrapping process is sufficient.

Loading a roll 200 of wrapping material into grippers 138 can be performed anytime prior to wrapping the coil 30. As a convention, roll 200 is normally loaded in grippers 138 of gantry 44, as shown in FIG. 1. Both actuators 68 are then activated to move gantries 42 and 44 along the Z-axis 18 into position adjacent work station B. Both gantries 42 and 44 are operated together as mirror images, simultaneously and synchronously. For ease of discussion, only the operations of gantry 44 will be described below.

Upon arrival at station B, the system quickly aligns the platforms and the robotic arms with reference to the coil using lasers and photocells, as described later in FIGS. 13–16. As seen in FIG. 2, when gantry 44 is properly positioned adjacent station B such that stub rails 96 and 98 are aligned with rails 196, actuator 68 is stopped. When so positioned, robot 48 is automatically centered horizontally in the center of the coil (i.e., at the vertical centerline 174). Wheel assemblies 54 and 106 of platforms 46 and 104 have brakes 202 hanging down from their wheel mounts 58 and 110. (Note that only the brakes for wheel assembly 106 are visible, while those for wheel assembly 54 are hidden behind the depicted structure). Brakes 202 are L-shaped so that they can retract upwardly to grasp the rail beneath each wheel assembly. The brakes of wheel assemblies 54 lock platform 46 down against track 16. After gantry 44 has been properly positioned and locked into place, actuator 82 is activated to move robot 48 toward coil 30 (as shown in FIG. 2) atop platform 104 along X-axis 50 (as shown in FIG.1) with the front wheels 108 now running on rails 196. When robot 48 has been properly positioned relative to coil 30, brakes 202 are set to lock platform 104 down against tracks 190. Locking down both sets of brakes further increases vertical rigidity and stability for robot 48.

The reason for stub rails 96, 98 being offset lower than rails 78, 80 on platform 46 (FIG. 2) will now become clear. Rails 24 and 26 of track 16 and rails 20 and 22 of track 14 are secured directly to plant floor 12, as are rails 192–196 of tracks 190; hence, they are all at the same level. However, rails 78, 80 on platform 46 are elevated a sizable distance above tracks 14, 16, and 190 due to the vertical thickness of the components of platform 46. In order for platform 104 to smoothly approach and retract from coil 30, some means must be provided to compensate for the difference in elevations between tracks 78, 80 and tracks 190. Obviously, the X-axis tracks 190 could be raised to the level of tracks 78, 80, but this would cost more and would create an unnecessary tripping hazard for an operator. The increased height of front struts 112 over rear struts 114 is the preferred, most cost-effective solution to the problem, just one of the many creative innovations arising from development of the present wrapping hardware.

FIGS. 6–12 illustrate the wrapping process of the instant invention. For clarity of description, the components of robot 48 on gantry 44 will continue to be indicated by the assigned reference numerals. However, the components of robot 48 on gantry 42, hereinbefore unreferenced, will be indicated by the same reference numerals supplemented by a prime, e.g., the robotic arms will be identified as robotic arm 128 and robotic arm 128', respectively, for gantries 44 and 42.

FIGS. 6–12 essentially show the path that the roll 200 takes around the coil 30 to securely wrap a small (approximatily six to ten inches) radial portion of the coil. This path around the coil defines the "work envelope" of the robotic arms 148, 148'. This work envelope could also be defined geometrically as: ten inches below the top of a twenty inch coil ID; six inches away from each coil end face, and seven inches above the top of the coil OD (which typically is of any height from thirty-six to seventy-two inches). Coil-approach platforms 104, 104' allow this robotic work envelope to shrink to the coil's width, usually between eight and seventy-two inches wide.

Figure 6:
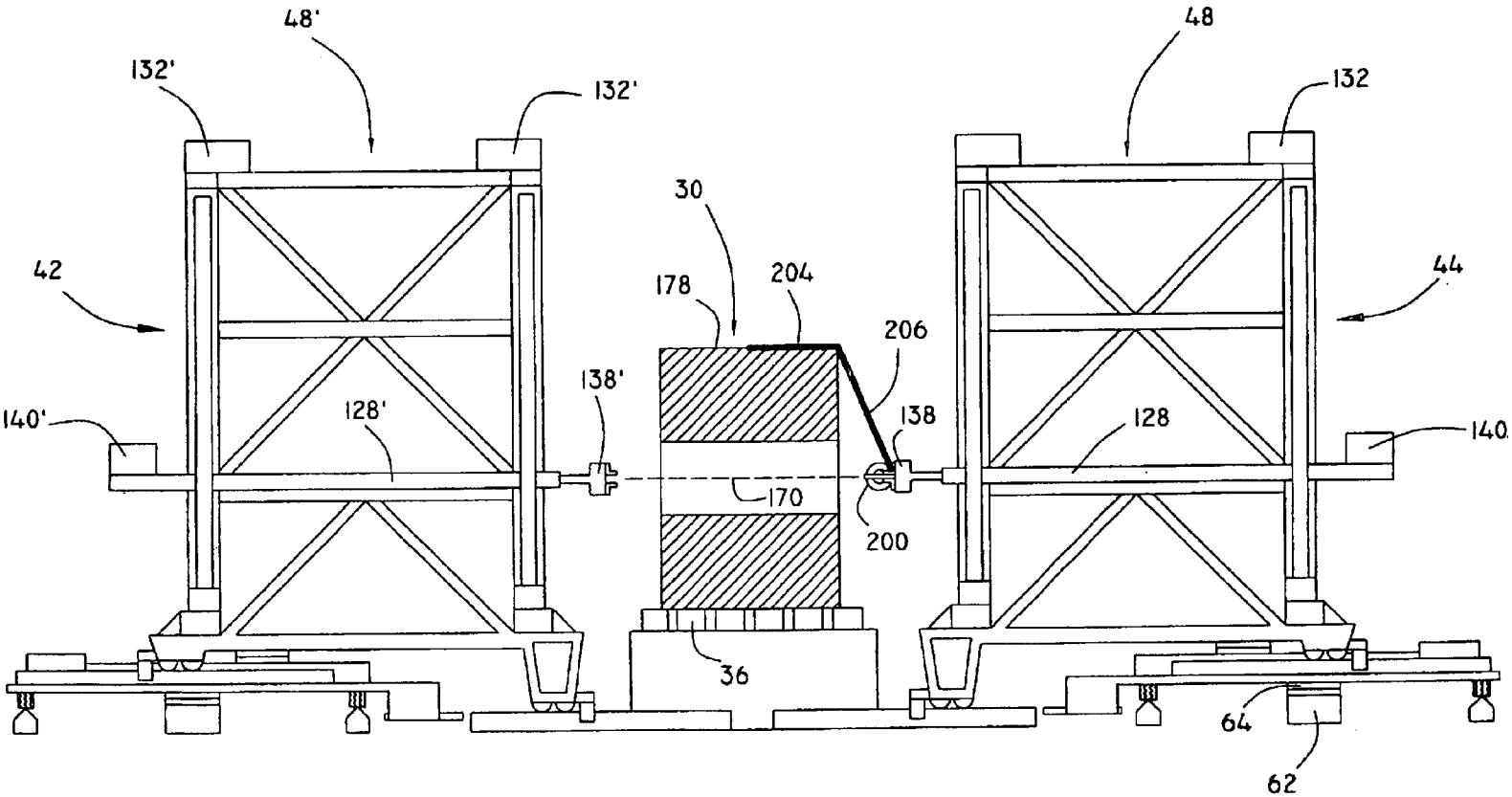
FIGS. 6–12 show the sequence of operations in carrying out one pass around a typical coil using the present inventive method of wrapping a coil, including the mirror-image relationship of the platforms and robotic arms, and the exchanges between the opposing grippers.
Figure 16:
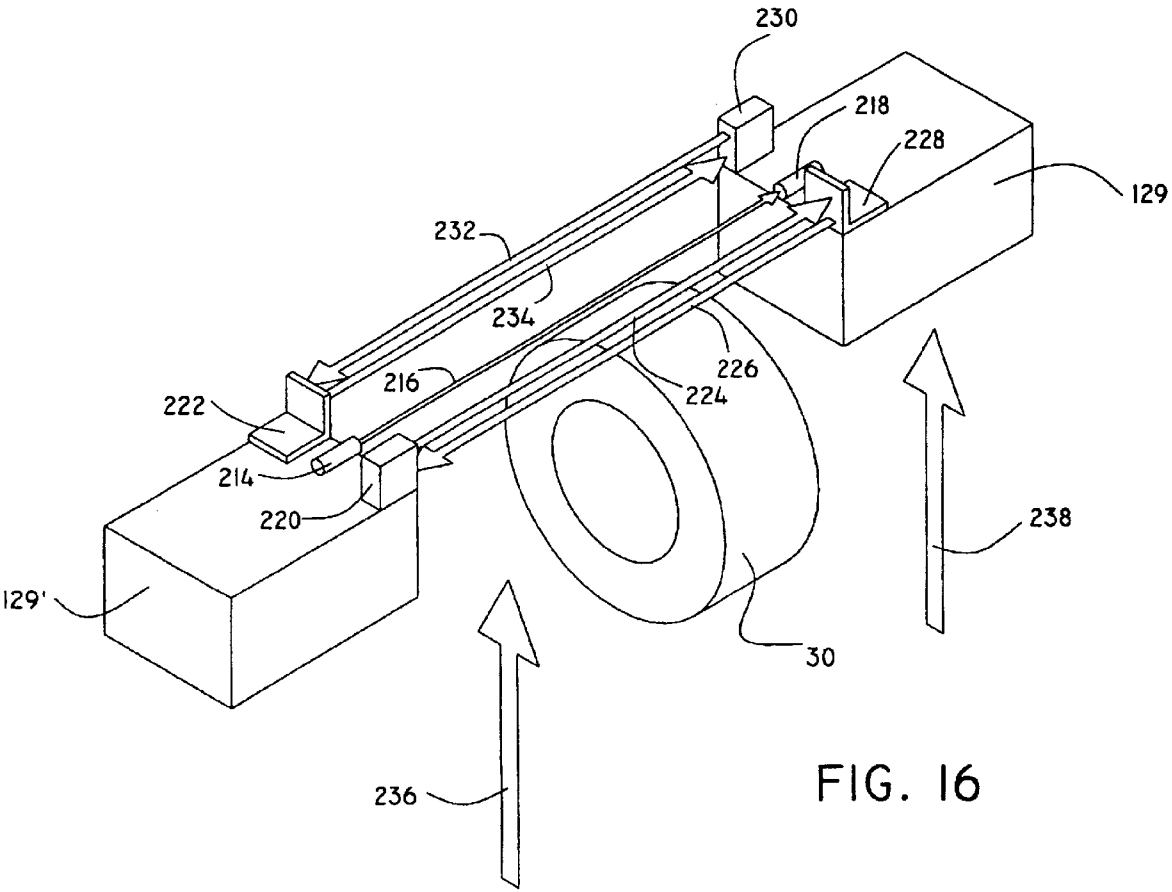
Figure 17:
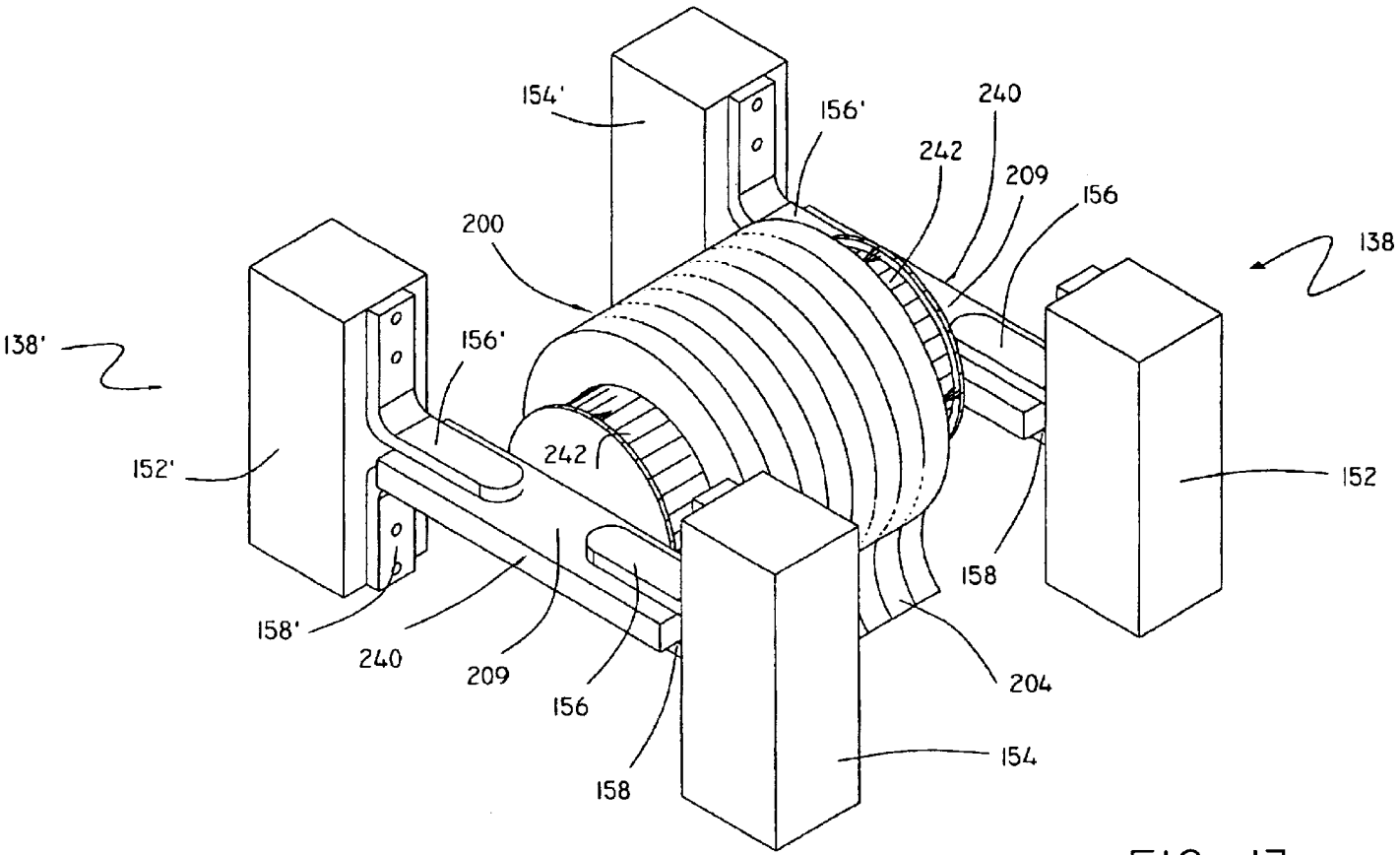
FIGS. 17–22 show the handles and internal tensioning mechanism for rotatively dispensing the roll of wrapping material, and for applying an operator-selected level of tension to the strips peeled therefrom.

At the present juncture, roll: 200 has already been loaded into jaws 156, 158 of pneumatic gripper 138 on gantry 44 which grip handles 209 (FIG. 17). Note in FIG. 6 that the jaws 156, 158 of gripper 138 are closed, whereas the jaws 156', 158' of gripper 138' are open, ready to receive the roll 200. Robots 48, 48' of gantries 44 and 42, respectively, have already been positioned horizontally relative to vertical centerline 174 of coil 30, and both robotic arms 128, 128' have been positioned vertically in alignment with horizontal centerline 176 of coil 30, so that arms 128, 128' are at the cylindrical rotational axis 170 of coil 30 (FIG. 6). (The peeled strip 206 of the wrapping material attached to coil 30 is shown with a heavy line to aid in viewing the wrapping of coil 30; in actuality it is extremely thin and virtually transparent.) Prior to allowing any wrapping steps to begin, the system lasers (FIGS. 13–16) confirm that robotic arms 128, 128' are in alignment. If all systems are cleared for action, the drive motor for rotating rollers 34, 36 is enabled by the CPU, which starts a slow rotation of coil 30, and the wrapping process is begun. Similarly all motors performing the actual wrap are also under control of the CPU, i.e., vertical slide motors 132, 132' for lifting and lowering robotic arms 128, 128', horizontal arm motors 140, 140' for driving the telescopic pistons 136, 136' in and out, and grippers 138, 138' for transferring the roll of stretch wrap 200 back and forth between grippers 138, 138'.

Figure 7:
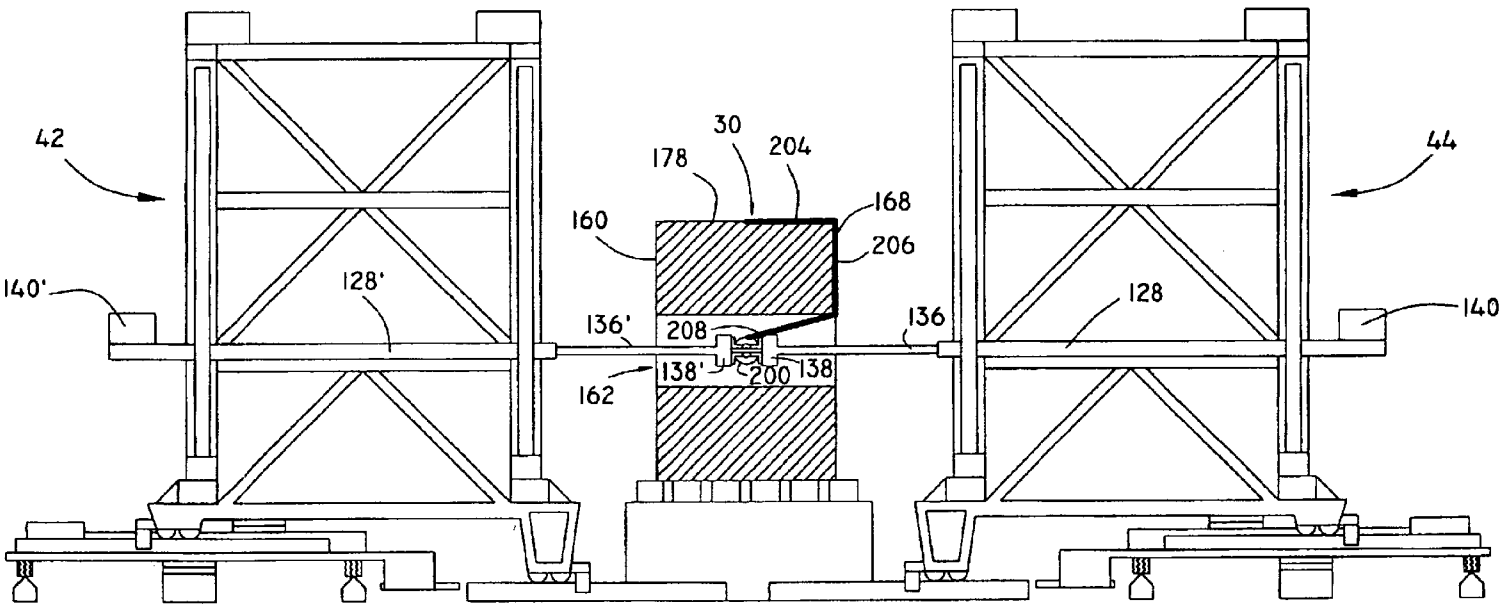

Turning to FIG. 7, robotic arm motors 140, 140' are simultaneously activated to synchronously extend both telescopic pistons 136, 136' and their respective grippers 138, 138' to meet centrally within core 162, along the cylindrical rotational axis 170. Jaws 156, 158 of gripper 138 continue to hold the handles 209 of roll 200, while jaws 156', 158' of gripper 138' reach and grasp handles 209 from the other side. Note that the jaws of both grippers are closed. (FIG. 17, to be discussed later, is an enlarged view that more clearly shows roll 200 being handed off from one gripper to the other.) In the process, wrap leader 204 has been drawn tightly against top 178, and peeled strip 206 has been drawn tightly against end face 168 of annulus 160 of coil 30, sealing that portion of annulus 160. Note that when in the hand-off or exchange position, peeled strip 206 of roll 200 actually stretches tightly against the top 208 of peripheral edge 144 of mounting plate 142 (FIG. 4). It was discovered during development of the instant invention that if mounting plate 142 had a rectangular periphery with sharp corners, strip 206 tended to tear, requiring shutting down operations to reattach the wrapping material to coil 30. Furthermore, beveling the sharp edge of the rectangular plate reduced did not alleviate the problem. The problem continued to persist until mounting plate 142 was designed to include the combination of an arcuate peripheral edge 144 plus a forward bevel 146 (as shown in FIG. 4A), another of the creative innovations arising from the development of the present wrapping process.

Figure 8:
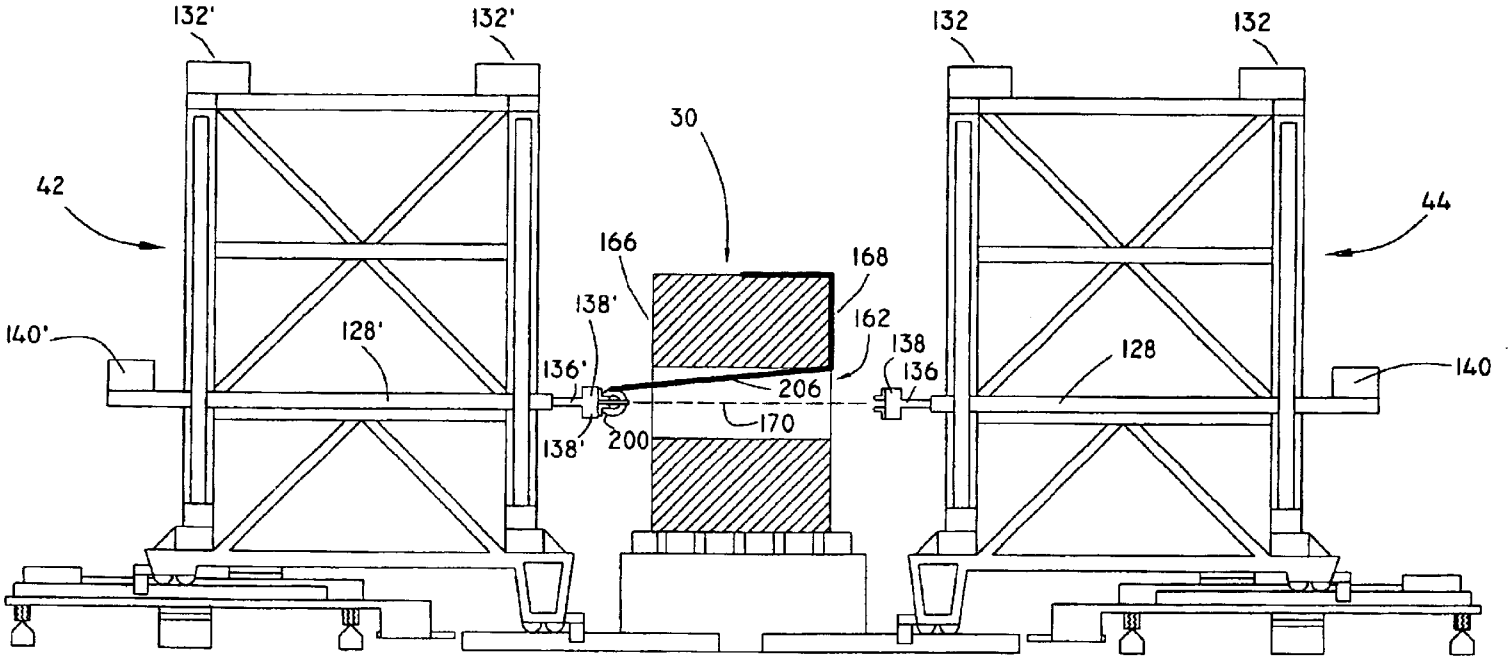

In FIG. 8, jaws 154, 156 of gripper 138 have opened, releasing handles 209, so that roll 200 is now completely in the grasp of gripper 138'. Telescopic pistons 136, 136' have been retracted by motors 140, 140', and strip 206 are being drawn through hollow, cylindrical core 162 of coil 30. Thus far, robotic arms 128; 128' have remained stationary on vertical slide actuators 120, 120' in alignment with the rotational axis 170.

Figure 9:
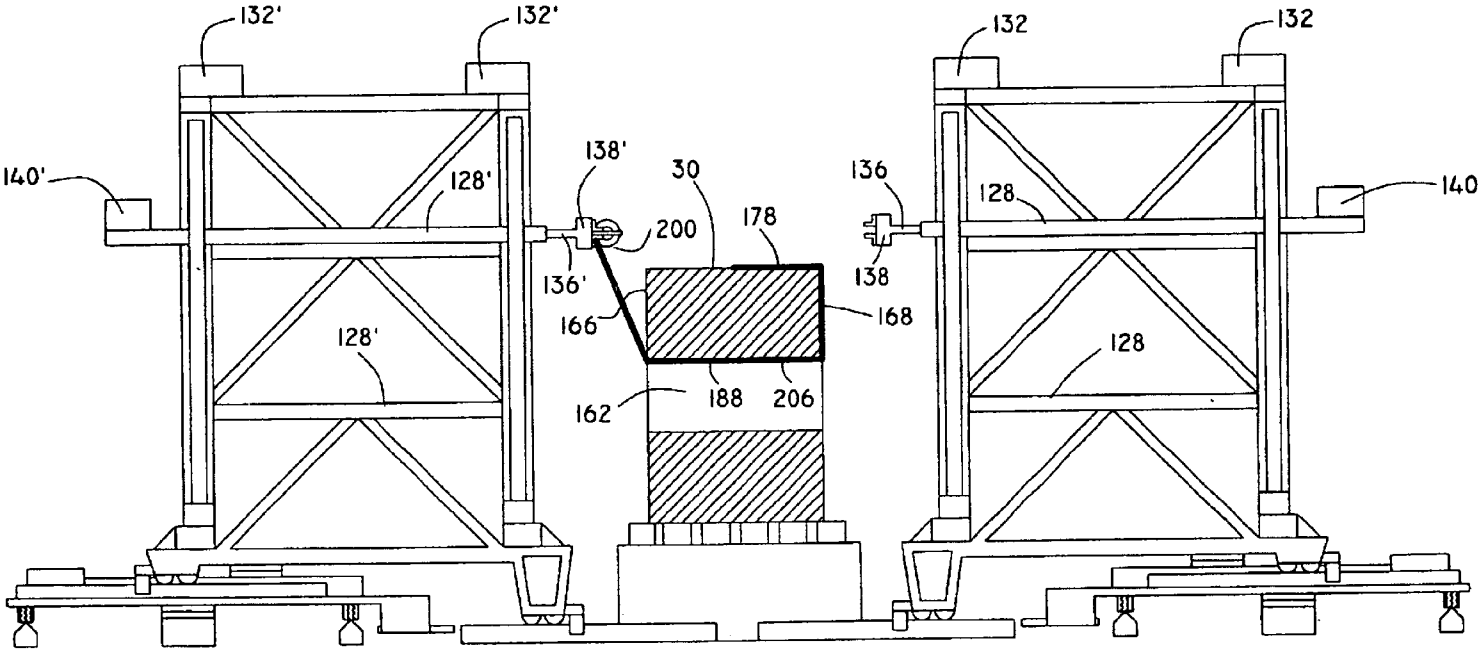

When both grippers 138, 138' have been retracted sufficiently to clear side edges 166, 168 of coil 30, (preferably about six inches as measured from end faces 166, 168 to the centerline, i.e., rotational axis, of roll 200), motors 140, 140' are deactivated, which holds telescopic pistons 136, 136' in their retracted position, while motors 132, 132' are simultaneously activated to synchronously raise robotic arms 128, 128' to the position shown in FIG. 9. This draws the portion 206 of roll 200 that is within cylindrical core 162 tightly against the internal surface 188 of core 162. Robotic arms 128, 128' remain in relative alignment with each other, and have stopped their vertical travel at a selected distance above the top 178 of coil 30, preferably about seven inches to the roll centerline. Roll 200 is still in the grasp of gripper 138', while gripper 138 remains open.

Figure 10:
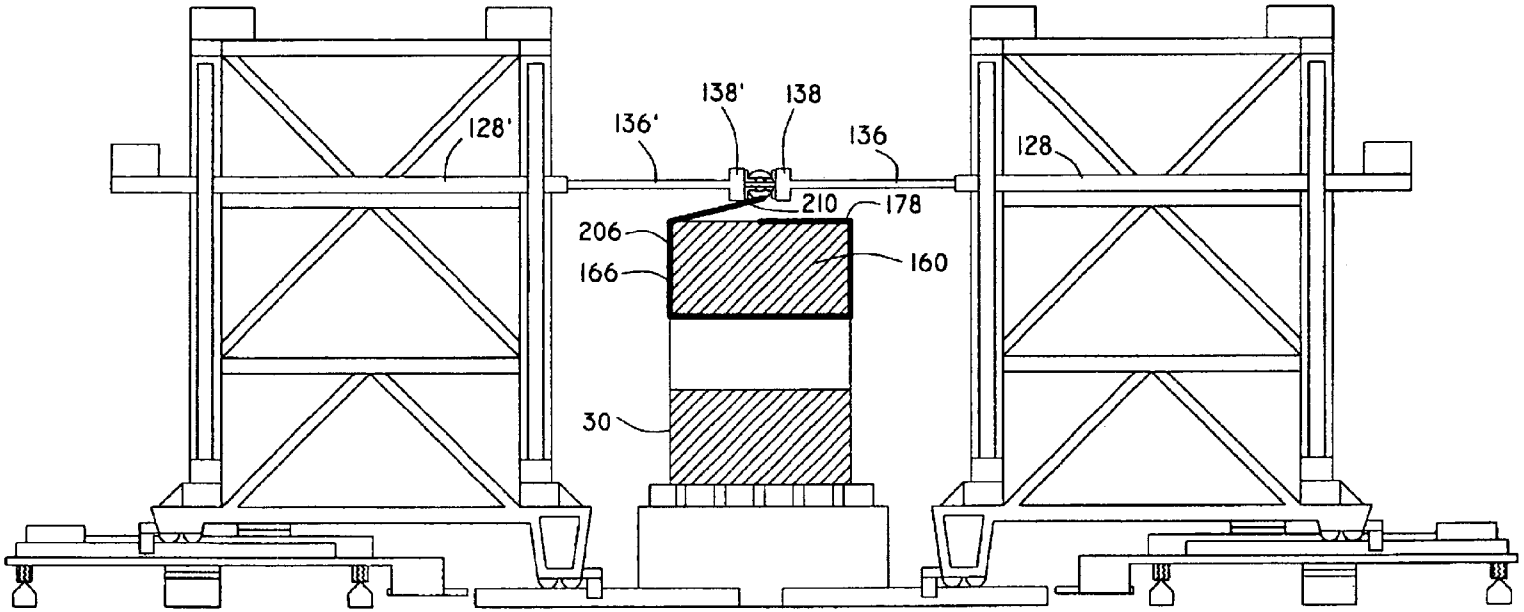

The next step is shown in FIG. 10. Vertical slides 120 remain motionless while the arms 128, 128' once again extend their telescopic pistons 136, 136' so that grippers 138, 138' meet once again centrally of coil 30 above top 178, preferably in the exact center. A part of strip 206 is drawn tightly against end face 166 of annulus 160 to seal it. Another part of strip 206 bears against the bottom edge 210' of mounting plate 142' for gripper 138' (see FIG. 4). It is because of the tension created by pulling strip 206 across the top and bottom peripheral edges 144 and 210 of mounting plate 142 that these edges must be rounded off arcuately and with a forward bevel 146. Here as in FIG. 7, the jaws of both grippers 138, 138' have handles 209 in their grasp, while they are in the process of handing off roll 200.

Figure 11:
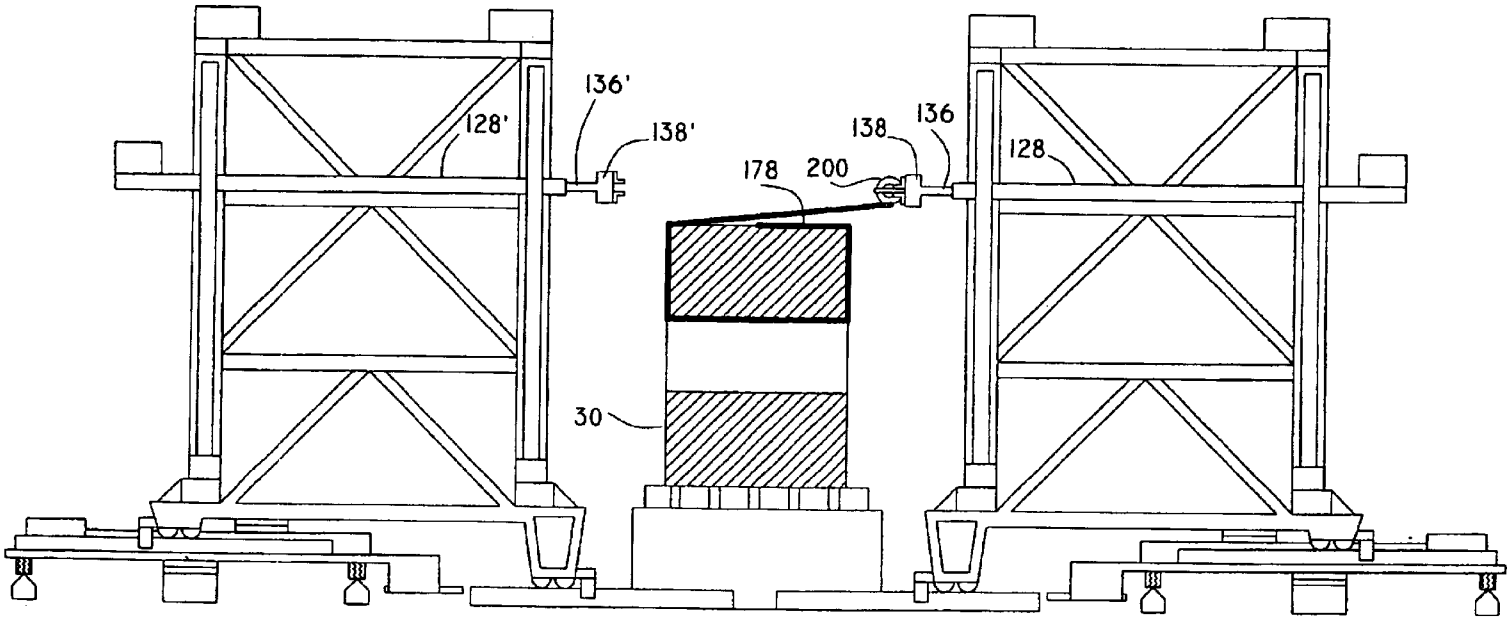

In FIG. 11, telescopic pistons 136, 136' have again been retracted into their respective arms 128, 128'. Roll 200 is once again in the grasp of gripper 138, and the jaws of gripper 138' have been opened to complete the exchange. Roll 200 has been pulled across top 178 of coil 30.

Figure 12:
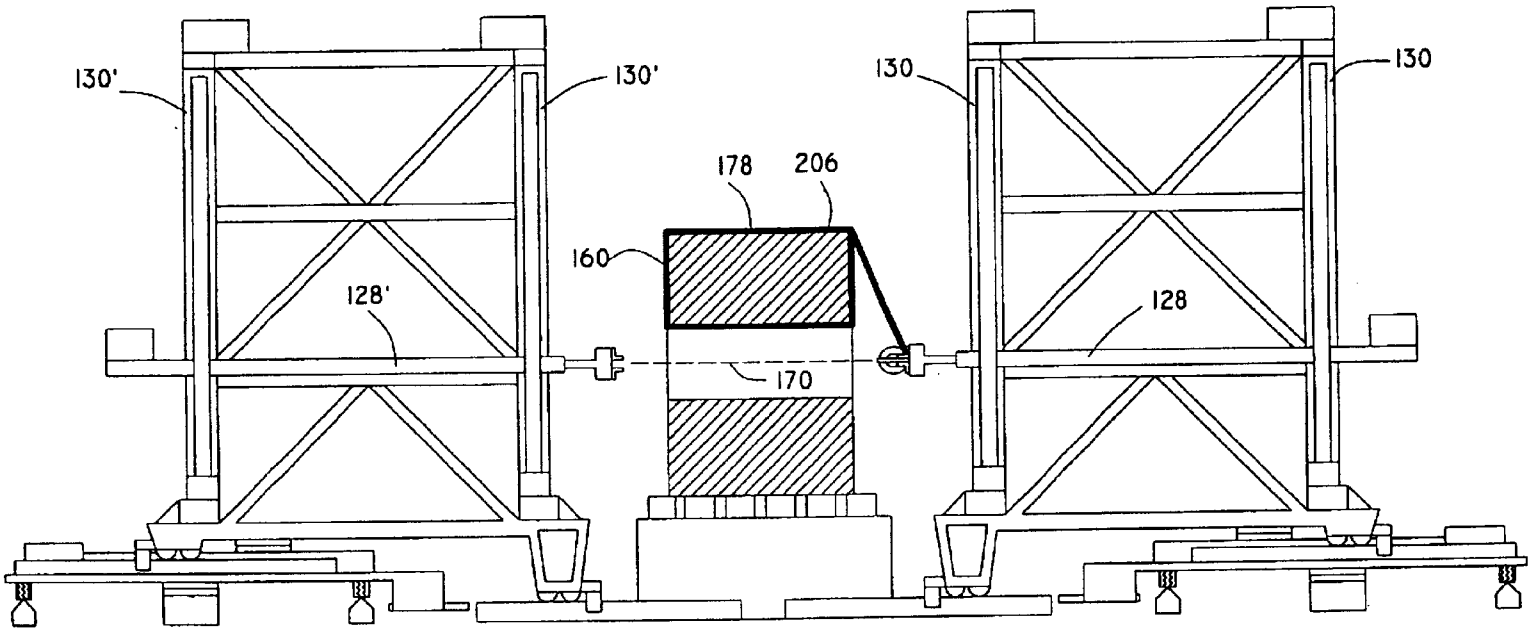
Figure 13:
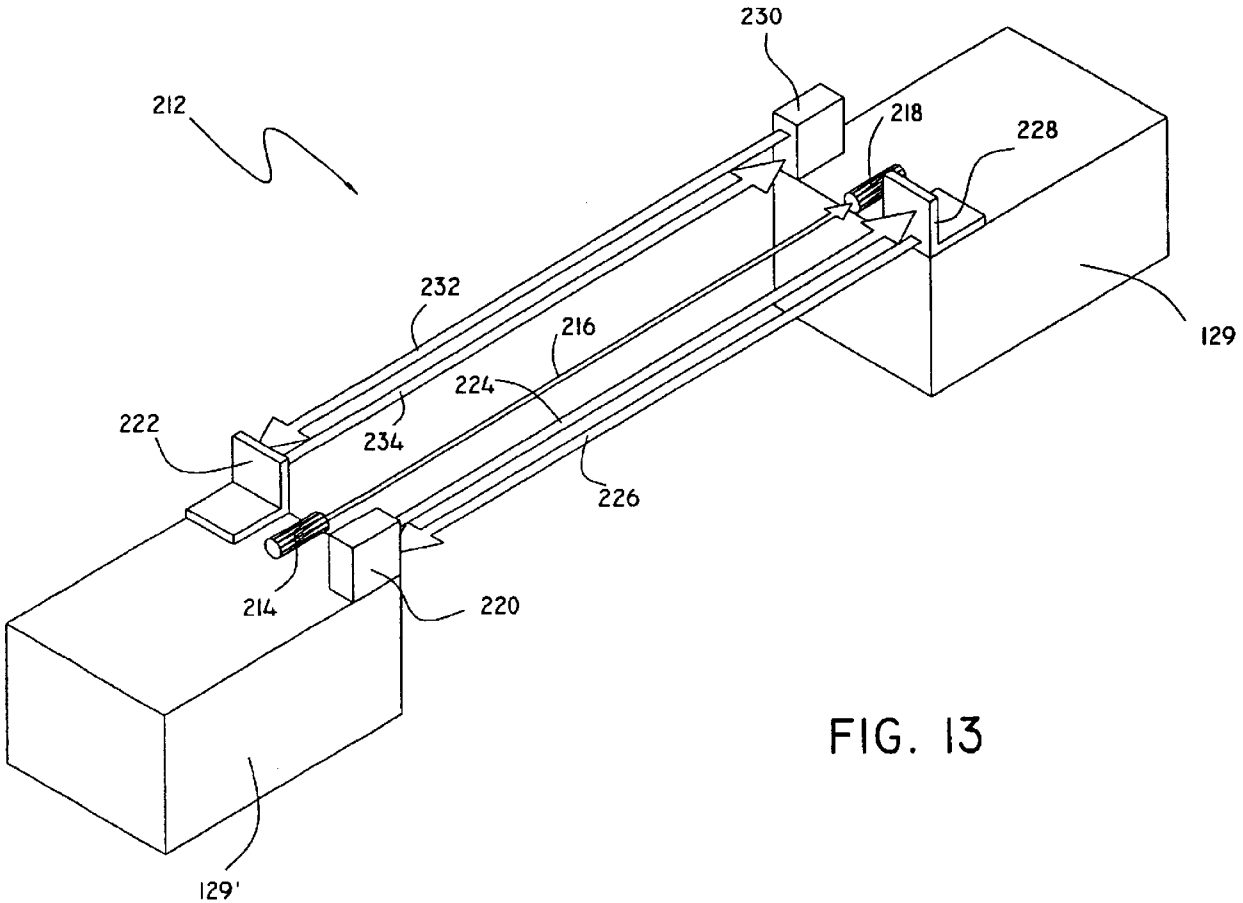
FIGS. 13–16 show the method and apparatus for properly positioning the robots relative to the coil to be wrapped, including the methods for precisely sensing the dimensions of the coil.

The step shown in FIG. 12 completes one pass of the wrapping process. Robotic arms 128, 128' have been lowered by slide actuators 130, 130' to the starting position shown in FIG. 6, where they align once again with the cylindrical rotational axis 170 of coil 30. The strip portion 206 of roll 200 now extends over top 178 and has been drawn tightly there against. FIG. 12 shows clearly how one complete segment of annulus 160 has now been sealed, and that the robotic arms 128, 128' are ready to begin a new pass around the coil.

When the whole coil 30 has been wrapped, telescopic pistons 136, 136' end up at the position shown in FIGS. 6 and 12, where arms 128, 128' are in the Ready position to perform a second wrap. If a double-wrap is not required, robots 48, 48' are then withdrawn along rails 196 to their Standby position and trailing strip 206 is cut with a blade, with the loose end placed against coil 30. Robots 48, 48' are then retracted to their Home positions on platforms 46, 46', respectively, and gantries 42, 44 are thereafter sent to the next work station to repeat the process with the next coil.

Since coil 30 is being rotated slowly by rollers 34, 36 of coil roller 28, each time the wrap cycle shown in FIGS. 6–12 has been completed, a strip 206 of wrapping material is applied to a segment of annulus 160. The width of the segment is preferably that of the standard 12-inch wide wrapping material on roll 200 "necked down" by the tension to roughly 10 inches. The path of the strip around annulus 160 is not strictly radial, however; rather, because of the slow rotation of coil 30, the path traverses coil 30 at a slight angle. The result is, that as the wrapping pass of FIGS. 6–12 is repeated time and again, the annulus 160 is wrapped in a helical fashion until the entire outer surface of coil 30 has been sealed, i.e., such that no surface area of coil 30 is left exposed. To securely cover the entire surface of coil 30, an overlap of adjacent strips of wrapping material is necessary. The resulting amount of material overlap is determined by the reduced size of the 'work envelope' for the robotic arms, the linear speed of the arms through that envelope, and the rotational speed of coil 30. This overlap ranges from six inches (first wrap) to one inch (second wrap), to ensure an effective, airtight seal of coil 30. To do this, the present configuration holds the robotic arm speed constant while varying the rotating speed of coil roller 28 linearly with the width and height of coil 30. This is because, the larger the coil, the greater its circumference; and hence, the faster coil roller 28 must turn the coil to rotate its outer edge through the desired 6" of overlap. How the software varies the coil roller speed is explained in detail with FIGS. 25–37.

As viable, albeit less efficient alternatives to the present configuration, it would be apparent to one of ordinary skill in the art to hold the coil roller speed constant while varying the linear speed of the robotic arms; to rotate the vertical wrap cycle (FIGS. 6–12) 90 degrees into a mirror-image horizontal wrap cycle; or, to send a single telescopic arm across the full width of the coil to a non-telescopic arm on the opposite side of the coil.

In one important illustrative embodiment, the wrapping apparatus can be adapted to various sizes of coils. Most coils to be wrapped, especially sheet metal, are not of a single, uniform size. They differ in coil width, height, thickness of the annulus, and the internal diameter of the hollow core. Adapting the wrapping apparatus to the differing coil dimensions minimizes the wrapping time, thereby increasing productivity, and reduces wear and tear on the hardware, thereby saving money over time.

Grippers 138, 138' must be located at least a minimum distance from the side edges 166, 168 of coil 30, where robots 48, 48' are ready to begin wrapping of coil 30. This Ready position is typically six inches from end faces 166, 168 to the centerline (rotational axis) of roll 200. This Ready position acts as a "buffer zone" for roll 200 to clear coil 30 during the arms' vertical movements (FIGS. 8–9 and 11–12). At the same time, locating grippers 138, 138' a minimum distance from end faces 166, 168 of coil 30 minimizes the time required for telescopic pistons 136, 136' to extend from their initial Ready position adjacent end faces 166, 168 (FIGS. 6, 9, and 12) to the hand-off position either centrally within hollow core 162 (FIG. 7) or centrally above top 178 of coil 30 (FIG. 10) and to retract back to said initial position (FIGS. 8, 11). As a preliminary to properly positioning robots 48, 48' at their Ready position, the system senses the width 164 of coil 30.

The system also senses the thickness 184 of annulus 160 and the height 172 which allows the CPU to define the lower and upper limits of vertical travel of robotic arms 128, 128'. The lower limit aligns robotic arms 128, 128' vertically with the rotational axis 170 of coil 30 (FIGS. 6–8 and 12), which is the Ready position for robotic arms 128, 128'. The upper limit positions robotic arms 128, 128' approximately seven inches above top 178 (again to the centerline of roll 200) which acts as a "buffer zone" for roll 200 to clear coil 30 during the arms' horizontal movement ( FIG. 9–11). By properly setting these two variable limits, the distance required for robotic arms 128, 128' to travel is further minimized.

Turning now to FIGS. 13–16, the system sensors will be described which enable precise positioning of robots 48, 48' and their robotic arms 128, 128' for each wrap session. FIG. 13 shows the sensor system 212, used in sensing the positions of robots 48, 48' relative to coil 30, mounted on top of large blocks 129 fixed to the end of arms 128, 128'. Telescopic pistons 136, 136', grippers 138, 138', and arms 128, 128' have been removed from these drawings for clarity.

A laser emitter 214 is mounted in the center of the front end block 129 of arm 128 (FIG. 13). Emitter 214 projects a collimated laser beam 216 to its laser receiver 218, likewise mounted in the center of the front end on block 129 of opposing arm 128. Laser receiver 218 generates an ON/OFF signal indicative of whether laser beam 216 is present or has been broken. The combination of laser emitter 214 and receiver 218 performs many operational functions, including sensing dimensions of the coil 30 (described below), aligning the robotic arms 128 and 128', verifying that both platforms 42 and 44 are at the same station, etc.

Flanking laser emitter 214 on block 129 is a range-finding photocell 220 and a reflector 222. Photocell 220 emits an infrared beam 224 that is reflected as beam 226 from a reflector 228 mounted on opposing block 129' adjacent laser receiver 218. Another range-finding photocell 230 is likewise mounted on opposing block 129' adjacent laser receiver 218. Its infrared beam 232 is reflected from reflector 222 as beam 234.

Photocells 220 and 230 are off-the-shelf sensors that combine an emitter and receiver in one housing. Photocells were selected as a preferred mode over other types of distance sensors for several reasons. They have a large sensing range (four inches to over sixteen feet); their normal output of zero to ten volts DC can be calibrated to any range within these limits; they exhibit a high degree of reliability, repeatability, and accuracy (i.e., typically down below ¼-inch resolution); the beam 224 spreads less than 2½ inches at its sixteen foot maximum distance so that only a 3-inch reflector 228 is required; and settling time (about 50 milliseconds after the robot 48 has come to a stop) to reach stable sampling oscillations is negligible (i.e., effectively down to ¼-inch resolution). Photocells 220 and 230 measure the distance between robots 48, 48', if there are no intervening objects, or from their respective arms 128, 128' to the reflecting end faces of a coil therebetween. The electrical connections of the active components in the sensing system 212 (FIG. 13) which provide information to the CPU are shown later in the hardware drawing of FIG. 24.

Figure 14:
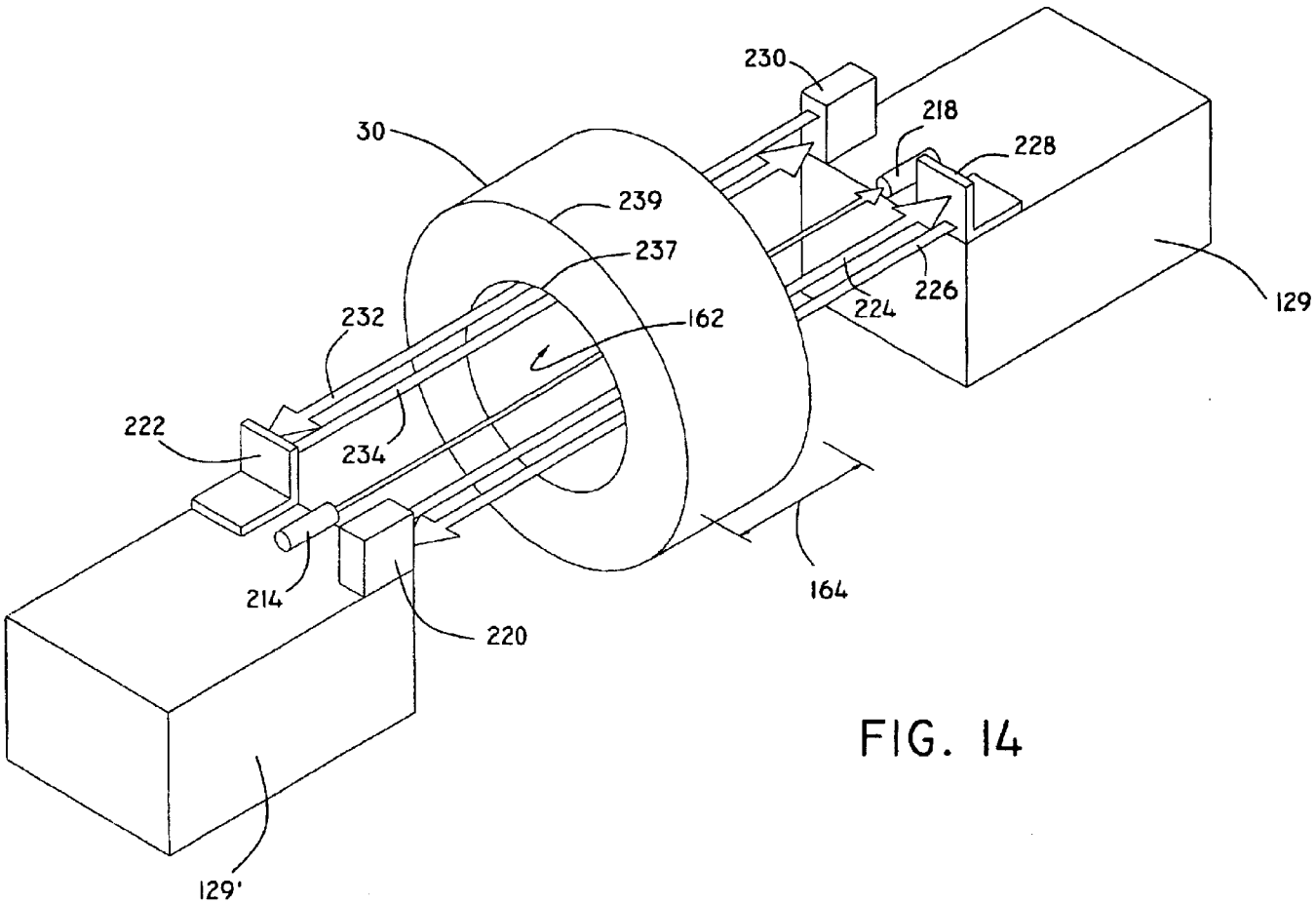
Figure 15:
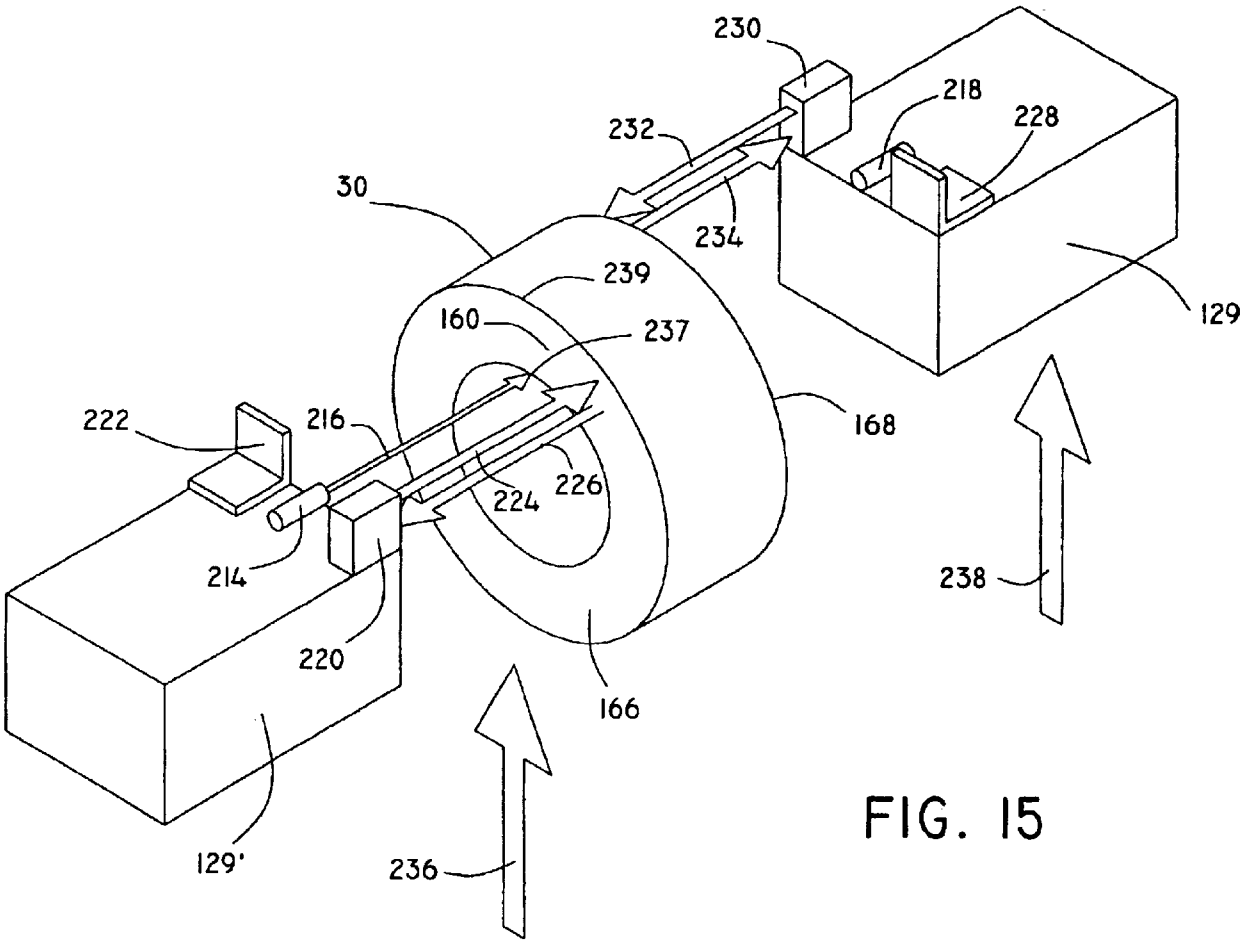

FIGS. 14–16 illustrate the sensing process of at least one illustrative embodiment.

When gantries 42 and 44 are properly positioned relative to tracks 190 (FIG. 2), robots 48, 48' are moved from the aforementioned Home position on platform 46 to a Standby position spaced apart a predetermined distance, e.g., large enough to safely accommodate the largest anticipated coil width of 6 feet (FIG. 14). Moving platforms 104, 104' to this fixed Standby position is routinely accomplished by X-axis actuators 82, 82' (see FIGS. 1, 1A and 2). At this point in time, the system does not yet know the dimensions of coil 30, so robots 48, 48' cannot be sent down yet to their optimal distance of six inches from coil 30 for wrapping, i.e., to their Ready position. The variable nature of the Ready position also takes into account that it is virtually impossible for the overhead crane to load coil 30 in the center of rollers 34, 36, so that robots 48 and 48' are rarely, if ever, equally spaced from coil 30.

The Home "zero" height of robotic arms 128, 128' has been strategically set at about 25" above platform 104 such that sensors 212 will always face each other through the open cylindrical core 162 of any standard size coil 30. Being unobstructed, the beams 224, 226 and 232, 234 from photocells 220, 230 can continuously measure the distance between robot arms 128, 128'. As an option for purposes of ensuring distance data integrity and reliability, a redundant "backup" pair of photocells can be installed on robotic arms 128, 128'. These photocells (not shown) would be mirror-images of photocells 220, 230 and their reflectors 228, 222 but would be installed beneath grippers 138, 138', so that they can take the exact same measurements as photocells 220, 230.

In order to obtain reliable measurements of the coil's exact inside diameter (or ID) and exact height (or OD), laser beam 216 has been aligned with vertical centerline 174 of coil 30 as robotic arms 128, 128' are raised and lowered. To ensure this critical alignment, sensor system 212 and grippers 138, 138' have been precisely mounted on robots 48, 48' such that laser beam 216 aligns with a vertical plane between, parallel to, and equidistant from rotating rollers 34, 36. This is a direct result of careful alignment, during the installation of the system, of coil roller 28 and X-axis rails 196 with stub rails 96 and 98, and thereby rails 78 and 80 (see FIGS. 1–2). Due to the symmetry of the coil roller 28 about said vertical plane, the rotational axis 170 and vertical centerline 174 of any cylindrical coil resting on its side on rotating rollers 34, 36 must of necessity also lie in this vertical plane. Beam 216 is not necessarily initially coincident with coil axis 170, however, since the diameter of coil 30, and thereby its axis of rotation, has not yet been determined. The process for finding the dimensions of any given coil will now be described.

In FIG. 15, robotic arms 128, 128' are being raised in unison along the coil's vertical centerline 174 as indicated by upward arrows 236, 238. In the position shown, annulus 160 of coil 30 is now blocking all of the sensor beams 216, 224, and 232. Most importantly, laser beam 216 is now being broken by the coil, right at the edge of its ID 237. Laser receiver 218 is now cut off from laser beam 216 and notifies the CPU by outputting an "OFF" signal the instant the beam was broken. Upon its receipt, the CPU registers the height of the coil's ID 237, which is the apex of cylindrical core 162 of coil 30 (i.e., at the intersection of vertical centerline 174 with the internal surface 188 of core 162 in FIG. 5D). Since the height of robotic arms 128, 128' is always known relative to their location on vertical slides 120, 120', and since the dimensions of all permanent structures (such as tracks 14, 16, gantries 42, 44, and each station's coil roller 28) are constants, their horizontal and vertical displacements are easily accounted for in the calculations of the dimensions of coil 30.

At this point in FIG. 15, infrared beam 224 emitted by photocell 220 is being reflected by beam 226 off of coil end face 166 of annulus 160, which allows photocell 220 to measure the distance from robot 48' to coil 30. At the same time, infrared beam 232 emitted by photocell 230 is likewise being reflected by beam 234 off of the opposite end face 168 of annulus 160, so that the CPU also can now calculate relatively how far robot 48 is from coil 30. Using this information, the position of robots 48 and 48' in the X-direction 50 can be individually adjusted relative to coil 30 by actuators 82, 82' until they are in their Ready positions (see FIG. 1A).

The movement of robotic arms 128, 128' continues upward along arrows 236, 238, eventually reaching the coil's OD 239 (FIG. 15) just as beams 216, 224, and 232 rise above coil 30, as shown in FIG. 16. Since laser beam 216 is always aligned with the coil's vertical centerline 174, the laser beam 216 traverses coil 30 radially as robotic arms 128, 128' raise. As soon as laser beam 216 clears coil OD 239 on top of annulus 160, the laser beam 216 is re-established with laser receiver 218, which sends the CPU an "ON" signal reflecting relative height 172 of coil 30. Combining these two measurements of laser "OFF" and "ON", with the known constants, the CPU can now compute the pertinent dimensions of coil 30, namely, the thickness 184 of annulus 160 (computed by simply subtracting the "OFF" reading from the "ON" reading), the coil's OD or outside diameter 172, the coil's ID or inside diameter 182, and the relative vertical height of the coil's rotational axis 170 within the coil ID. With this information, the limits of the vertical travel, or "work envelope", of robotic arms 128, 128' (FIGS. 8–9) can now be calculated by the CPU. The upper limit is set seven inches above coil ID 239 and the lower limit is set coincident with the coil's rotational axis 170, such that the total vertical rise for both arms equals the radius of the annulus plus seven inches.

As robotic arms 128, 128' return downward to the position shown in FIG. 14, range-finding photocells 220, 230 continue to take distance measurements to the coil end faces 166, 168 confirming their distance from the coil. The width 164 of coil 30 can easily be determined by subtracting the combined variable distances robots 48, 48' are from each coil face 166, 168 from the fixed distance robotic arms 128, 128' are apart at Standby. This data establishes the horizontal distance each arm must travel to meet substantially at the center of coil 30, such that grippers 138, 138' will travel the same distance to where they will meet for the wrap transfer. As a long term benefit, minimizing the arms' horizontal and vertical paths in the above manner also reduces wear and tear on all high speed parts, thus prolonging the working life of the wrapping apparatus at its most critical point.

As other alternatives for measuring distance, it would be apparent to one of ordinary skill in the art to use other sensing devices such as laser range finders, or other techniques, such as locating the coil end faces by breaking photocell beams disposed transversely across the front of the X-axis platforms. Moreover, it should be noted that for each measurement by photocells 220, 230, duplicate measurements can also be taken by mirror-image photocells (not shown) mounted on the underside of front end blocks 129, 129'. Such redundant measurements ensure the reliability and integrity of resulting distance calculations. That is, the two sets of photocells take duplicate measurements at key positions as the arms rise up to the ID 237, then to OD 239 and then return to the coil's rotational axis 170. Such redundant data allows the CPU to find a "consensus" among up to 5 duplicate data points to calculate more accurate distances to the coil, as will be discussed later in the flow charts of FIGS. 25–37.

FIGS. 17–22 show variable-tension handles of at least one illustrative embodiment.

Also critical to the success of the wrapping process is that the extended strip 204 of wrapping material removed from roll 200 must be maintained under an operator-selected level of tension. FIG. 17 shows a schematic close-up, with all non-essential parts removed for clarity, of a roll 200 of wrapping material being handed off from jaws 156, 158 to jaws 156', 158'. Pneumatic grippers 154 and 154' have been actuated by the CPU to close jaws 156', 158' on handles 209. A pair of variable-tension handles 240 securely clench opposite ends of the coil wrap roll 200 while allowing the wrapping material to unravel smoothly at a controlled dispensing rate. As shown previously in FIGS. 6–12, a uniform tension is imposed on strip 206 as the grippers 138, 138' pull roll 200 back and forth around annulus 160. If the roll 200 were allowed to "free-wheel" without any tension, strip 206 would flap about, crinkle, and end up being applied haphazardly to coil 30; this is not conducive to effective stretch wrapping of coil 30. The handles 240 carrying roll 200 not only provide it with a rotatable axle with uniform tension, but also allow it to be handed off smoothly between opposing grippers 138 and 138'. Tension in the handles 240 resists the pull imposed by grippers 138, 138', which translates into tension on strip 206, "necking" it down by several inches, so that the wrap ends up being applied to coil 30 smoothly and, tautly across all surfaces.

Figure 18:
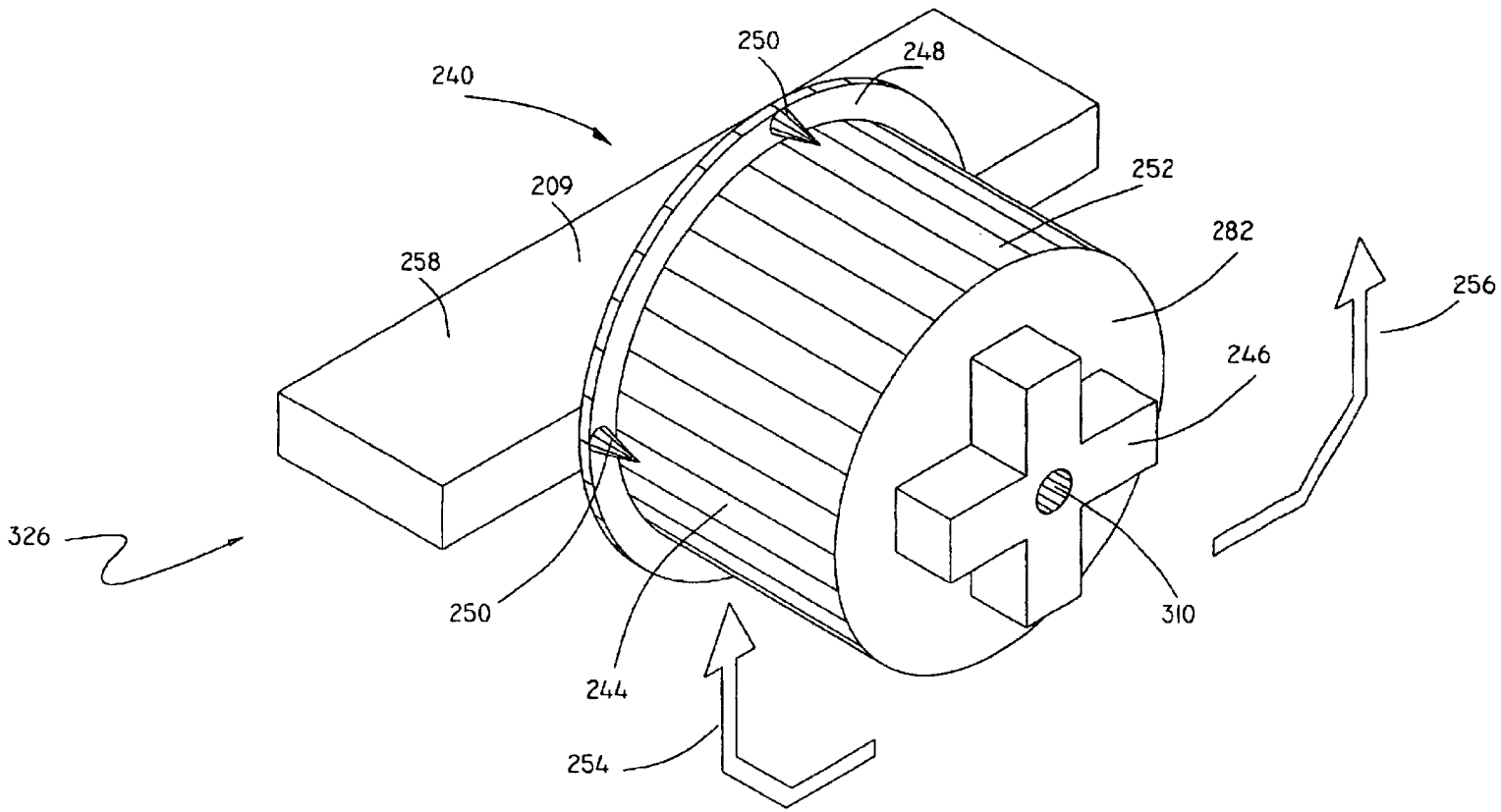

The variable-tension handles 240 are another innovation inspired during development of many of the present illustrative embodiments. The handles shown in FIGS. 17–22 provide tension in the stretch wrap by continuously braking the rotation of the wrap with the tension being pre-set by means of operator-selected adjustment to either, or both, of handles 240. These handles allow precise, infinitely variable tension adjustment of the braking resistance applied to roll 200, and thereby, allows the operator to select the optimum tension in strip 206. FIG. 18 shows an assembled handle 240, while in FIG. 19 an exploded view of the handles reveals the internal tensioning mechanism.

Although any wrapping material on a dispensable roll can be used, the preferred wrapping material is the aforementioned VCI stretch wrap, namely, a plastic wrap having a protective side treated with a corrosion inhibitor which goes directly up against the exposed surfaces of coil 30. (An inspection of FIGS. 6–12 will confirm that the inner side of the wrap is always applied directly to coil 30 during the wrapping cycle.) The roll 200 itself has a center cardboard tube 242 which has an industry-standard 3-inch internal diameter ID. The description of the handles 240 and associated roll 200 will be in terms of that wrap. However, any material that would seal coil 30 from contamination due to moisture and/or foreign matter; for example, a continuous, flexible plastic film, a continuous strip of cloth, or a continuous strip of paper, is within the purview of the appended claims. It would be apparent to one skilled in the art to adapt of handles 240 to rolls of such other materials in view of the following disclosure. In fact, the variable-tension handles 240 will find utility wherever a compact, controlled braking resistance for a rotating sleeve is desired, regardless of what is mounted thereon for rotation.

The wrapping material comes in various "gauges" or thickness. The most common gauges used in wrapping steel coils are 60 gauge, 100 gauge, and a considerably more-expensive 120 gauge. The fact that inexpensive 100 gauge wrap can typically be stretched to over 150 percent of its original length without tearing, makes it a good choice for use in the present invention. As a general rule, the greater the stretch, the lesser the amount of wrap consumed. In addition, the greater the stretch, the tighter the wrap on coil 30, which translates into better sealing of coil 30. Under-tensioning the handles 240 leads to a looser wrap with a "puffy" trailing edge which, although maintaining air-tight integrity on the leading edge, can be prone to being snagged and/or punctured. Over-tensioning, on the other hand, runs the risk of tearing the wrap, thus requiring not only loss of material but extra time to restart the wrap process. It is therefore desirable to be able to selectively vary the tension incrementally on the wrap to find the optimum balance between the two extremes.

Referring to FIG. 18, the external features of handles 240 are discernible, comprising a flat bar handle 209, a tubular sleeve 244, and a tension adjusting knob 246, conveniently but not necessarily shaped like a "plus" sign. Rotation of adjusting knob 246 relative to handle bar 209 in the directions of arrows 254 or 256, respectively tightens and loosens an internal braking mechanism within the tubular sleeve 244 of handle 240. When two handles 240 are assembled together (described below), their combined tension acts as the braking force on roll 200.

Sleeve 244 is structurally reinforced by an integrally connected outside flange 248 which supports a plurality of locking spikes 250 mounted to extend therefrom parallel to, but spaced slightly outward from, the outside surface 252 of sleeve 244. Outside surface 252 is slightly less in diameter (0.0010") than the 3-inch ID of cardboard tube 242 so that it fits snugly therewithin for dispensing material off of roll 200. As a practical matter, sleeve 244 is slightly tapered to permit smooth, but snug, gradually tightening entry into cardboard tube 242. Locking spikes 250 allow the handles to accommodate small manufacturing variations in the diameter and/or thickness of cardboard tube 242. The locking spikes 250 face inward from outside flange 248 toward the end of cardboard tube 242, where they sink into the end 334 of tube 242 as each sleeve 244 slides into tube 242. Minor variations in tube diameter are thus absorbed by spikes 250. Any tube diameter less than the concentric ring of spikes is held fast by the snug fit therein of sleeve 244. Spikes 250 also serve to hold tube 242 in place so that it cannot spin around sleeve 244.

Figure 20:
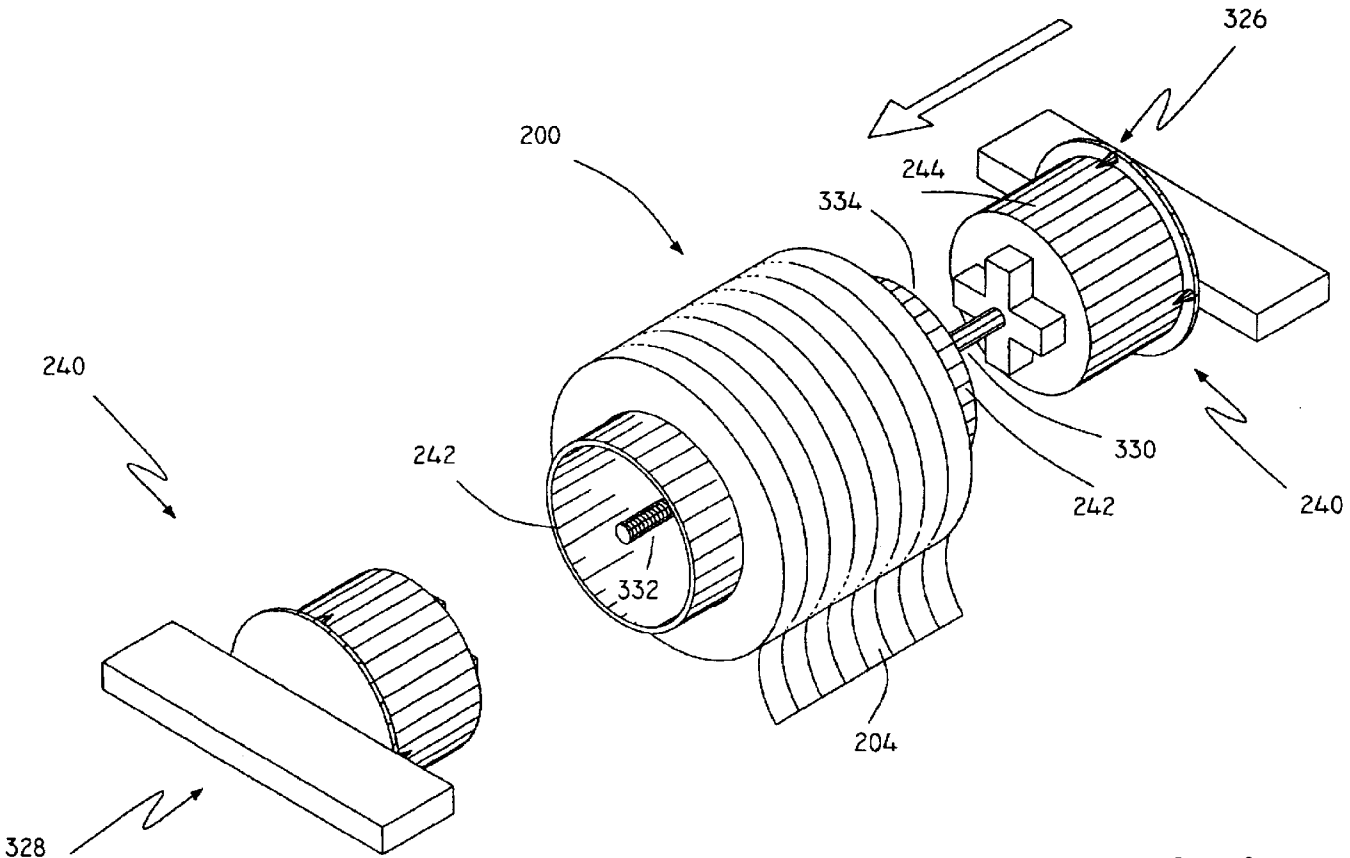

All handles 240 are identical and will rotate with the same tension in either direction. Thus, by simply flipping any given handle over 180 degrees, it can be inserted into either end of tube 242 (FIG. 20).

Figure 19:
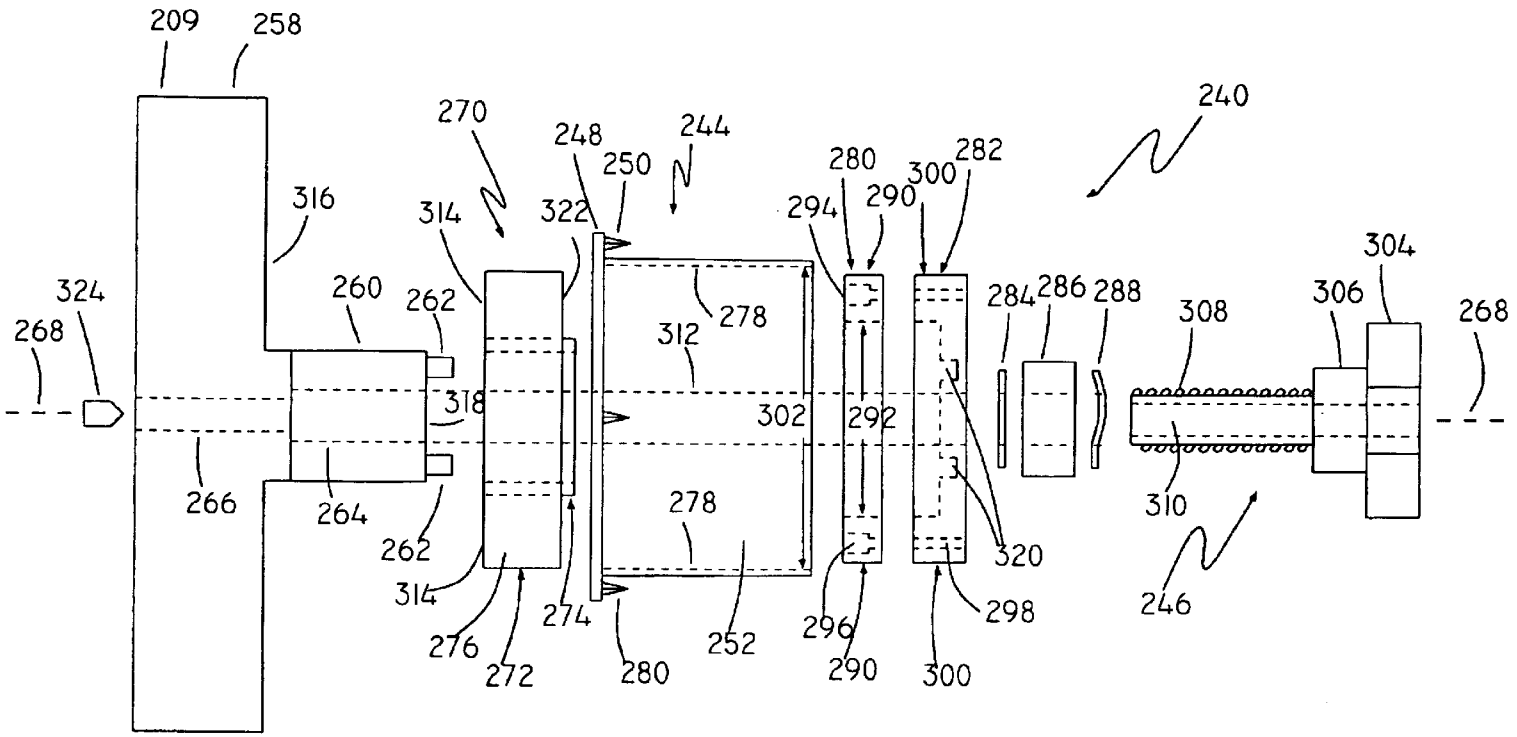

The internal construction of handle 240 is shown in FIG. 19. Handle bar 209 is T-shaped, comprising, preferably, a flat aluminum bar 258 with an integral cylindrical shaft 260 extending therefrom. Projecting axially from shaft 260 is a pair of locking pins 262 which are spaced apart one hundred eighty degrees. Shaft 260 has a large, internally threaded bore 264, while flat bar 258 has a smaller, internally threaded bore 266. Bores 264 and 266 are coaxial with the longitudinal rotational axis 268 of handle 240 but are of different diameters, as is clearly seen in FIG. 19. The size difference between them allows them to mate with two different, externally threaded components having different diameters. Bearing 270 is a conventional, off-the-shelf needle bearing which has an annular outer race 272 mounted on a slightly wider, tubular inner race 274 for rotational movement. When press fit onto shaft 260, inner race 274 and shaft 260 are effectively locked together due to the frictional contact therebetween. Similarly, when outer surface 276 of outer race 272 is press fit into the inner surface 278 of tubular sleeve 244, outer race 272 and sleeve 244 are also effectively locked together. Thus, outer race 272 and sleeve 244 are free to rotate about rotational axis 268. Consequently, when handle bar 209 is held firmly by grippers 138, 138', and roll 200 is press fit on outer race 272, roll 200 also rotates freely unless braked by some other means.

The remainder of the components in shown FIG. 19 serve to provide variable resistance to this "free wheeling" rotation, namely, a high temperature brake pad 280, a brake plate 282, a low friction washer 284 (preferably one made of Nylon™ or Teflon™), an annular spacer 286, a spring washer 288, and a tension adjustment knob 246.

Brake pad 280 is donut-shaped with an external diameter 290, an internal diameter 292, and an annular braking face 294. Pad 280 is held onto brake plate 282 by locking screws (not shown) which fit through countersunk sockets 296 into threaded apertures 298, a plurality of which are spaced around brake pad 280 and brake plate 282. This allows convenient replacement of pad 280 as needed. The external diameter 300 of plate 282 is the same as the external diameter 290 of pad 280, and both are slightly smaller than the internal diameter 302 of sleeve 244 for clearance therebetween.

Adjusting knob 246 comprises a four armed head 304, a stepped-down shoulder 306, and an externally threaded shaft 308. A smooth, unthreaded center bore 310 passes axially through adjusting knob 246; bore 310 has the same diameter as internally threaded bore 266 in flat bar 258 of handle bar 209. Externally threaded shaft 308 faces an unobstructed path, indicated by the dashed lines 312, through the hollow interiors of all intermediate components into internal threads 264 of shaft 260.

Handle 240 is assembled as follows: Needle bearing 270 is press fit onto shaft 260 until the outside face 314 lines up with the outside edge of shaft 260 nearest the inner surface 316 of flat bar 258. Such terms as "outside" and "inside" refer herein to their positions with respect to the center of roll 200, as seen in FIGS. 17 and 20–22. Brake pad 280 is attached to brake plate 282 with locking screws (not shown), and the assembly is pressed against the end 318 of shaft 260 such that locking pins 262 fit snugly into blind mating apertures 320 in brake plate 282. In this position, braking face 294 of brake pad 280 comes into direct contact with an annular braking surface 322 of outer race 272. Sleeve 244 is easily slipped over brake pad 280 and brake plate 282, due to its small clearance of about one-thirty-secondth of an inch, and is press fit onto outer surface 276 of needle bearing 270. Threaded shaft 308 of adjusting knob 246 is then inserted through open path 312 and threaded into bore 264 of shaft 260. The continuously variable nature of the adjustment of handle 240 should now be clear from the assembly of its parts.

Assume that handle 240 is a fixed reference system, as it effectively is when in the grasp of jaws 156, 158 and/or, 156', 158'. The parts of handle 240 that do not rotate are: inner race 274 of needle bearing 270, being press fit on handle shaft 260; brake plate 282, held from rotating by the locking action of the locking pins 262 mating with blind apertures 320; brake pad 280, fixed to brake plate 282 by locking screws (not shown); and the combination of low friction spring 284, spacer 286, and spring washer 288, all held with variable force against brake plate 282 by adjusting knob 246. Adjusting knob 246 rotates relative to handle bar 209, since it is threaded into threaded bore 264, but only when it is deliberately turned to create more or less tension. Low-friction washer 284 facilitates smooth turning of knob 246 against the metal surface of brake plate 282, while spring washer 288 maintains critical tension between knob 246 and brake pad 280, so as to prevent adjusting knob 246 from inadvertently rotating within threaded bore 264 on its own.

As a result, sleeve 244 freely rotates with outer race 272 around the handle's rotational axis 268, due to the inner and outer races 274 and 272 within needle bearing 270. It is thus readily apparent that all of the components of variable-tension handle 240 are effectively fixed except outer race 272 and sleeve 244. Hence, when a roll of wrap 200 is mounted onto sleeve 244, it too will rotate freely around rotational axis 268 unless braked by the handle 240.

The braking tension on roll 200 is adjusted by turning the adjusting knob 246. After adjusting knob 246 has been screwed into handle bar 209, clockwise rotation 254 of knob 246 increases the pressure of the "fixed" annular braking face 294 of brake pad 280 against the concentric, "rotating" braking surface 322 of the outer race 272 of needle bearing 270. Conversely, counterclockwise rotation 256 reduces the pressure therebetween. Adjusting knob 246 can be rotated back and forth until the desired braking tension has been reached. With this arrangement, brake tension can be infinitely adjusted continuously from free-wheeling (no braking) to full stop (maximum braking). This gives the operator complete flexibility to select tension based on the gauge of the wrap and the desired tautness. In practice, tension may roughly vary from 33 percent of maximum braking force for 60-gauge wrap, to 67 percent for 100-gauge wrap, to 83 percent for 120-gauge wrap. Finally, as shown in FIG. 19, an externally threaded set screw 324 threads into internally threads 266 of flat handle bar 209 for a purpose described below.

Referring to FIGS. 18–22, the preparing of a roll for wrapping will now be described. Preliminary thereto, two handles 326 and 328 are assembled in the manner just described.

Figure 21:
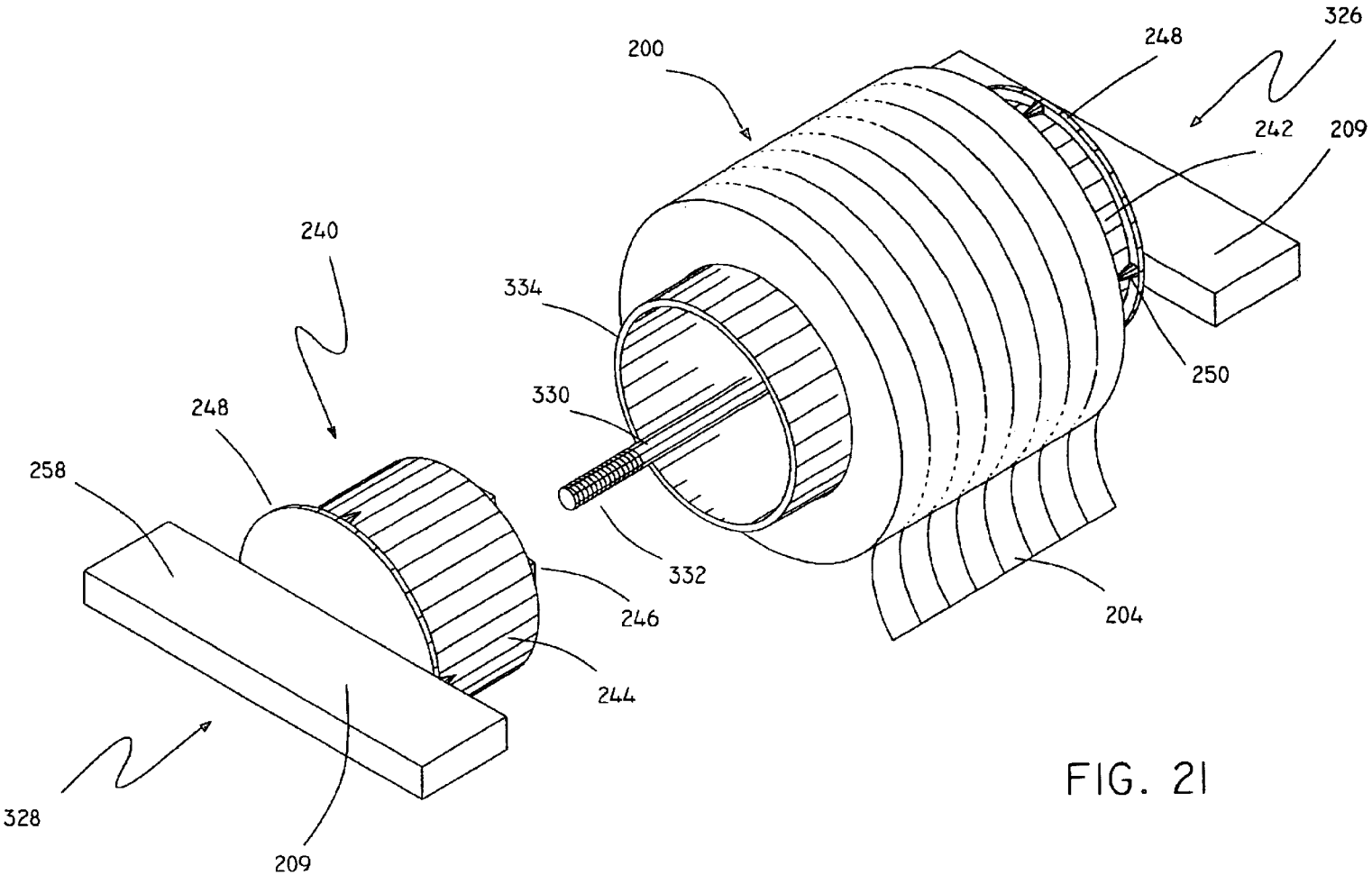
Figure 22:
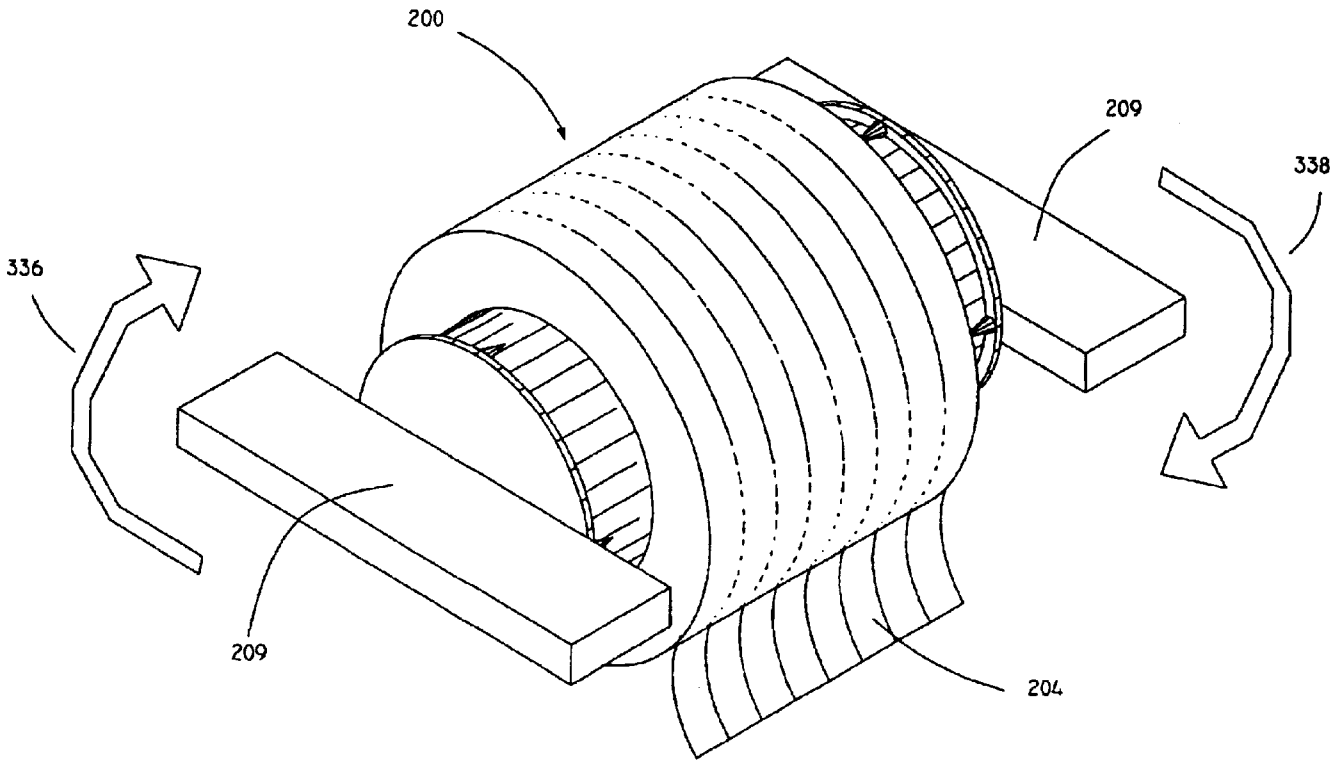

To work as an integral braking device, the two handles 326 and 328 are interconnected by the operator via an interconnect rod 330 (FIGS. 20–21). Rod 330 has a diameter slightly less than unthreaded bore 310 and is externally threaded on its ends 332 to mate with internal threads 266 in handle bar 258. In assembling, one end of rod 330 is passed into handle 326 through bore 310 of adjusting knob 246 and is threaded into internal threads 266 of handle bar 258 (FIG. 17). Set screw 324 is pre-loaded into threads 266 in the opposite direction so that it will bind with rod 330 to prevent handles 326 and 328 from loosening.

The greatest advantage of interconnect rod 330 is to tighten the opposing handles 326, 328 together against cardboard tube 242 (FIG. 17). As shown in FIG. 20, handle 326 is turned over and rod 330 is passed through the interior of cardboard tube 242. Sleeve 244 is inserted into tube 242 until spikes 250 penetrate the soft end 334 of cardboard tube 242 (FIG. 21). The free end 332 of rod 330 is theln inserted into bore 310 of adjusting knob 246 of handle 328 and threaded into internal threads 266 of flat handle bar 258. Either or both handle bars 209 of handles 326 and 328 are turned clockwise, as shown by arrows 336 and 338 in FIG. 22, until the free end 332 of rod 330 starts to turn into threads 266 in handle bar 209 of handle 328. In this manner, handles 326 and 328 are uniformly drawn together against the ends 334 of cardboard tube 242. Under this novel design, width variations of tube 242 can be taken up by rod 330 as it is turned a variable distance into the handle holes. Should the diameter of the ring of spikes 250 exceed that of tube 242, due to variant manufacturing tolerances, the snug fit of sleeve 244 plus the pressure of outside flanges 248 against ends 334 will then combine to keep the roll 200 from rotating around their surfaces. Handles 209 are further rotated clockwise, as above, until both flat bars 258 are parallel, i.e., such that both bars end up in the same horizontal plane. Parallel handlebars 258 assure gripper jaws 156, 158 and 156', 158' of securely grasping handles 209 (FIG. 17) during the exchange of roll 200. Finally, set screw 324 of handle 328 is threaded into its threads 266 to prevent loosening of interconnect rod 330 in handle 328. Roll 200 is now ready to be loaded into grippers 138 to begin the wrapping process (FIG. 6).

Coils of sheet metal strip, as described above, come in a variety of sizes. The standard internal diameter (ID) for such coils found in the industry is 20 inches. Some wrapping systems find it difficult to accommodate such a small diameter, especially those that wrap the inside surfaces of the hollow center core of the coil. The unique, compact design of handle 240 comfortably accommodates the standard ID with room to spare; in fact, it can actually pass through a coil ID as small as 16 inches.

Each roll 200 of VCI stretch wrap is supplied in industry-standard 12-inch lengths wound upon ⅛-inch thick cardboard tubes 242 that are 3 inches in diameter (FIG. 20). When sleeve 244 fits snugly within tube 242, each of handles 209 of tensioners 240 extends approximately two inches beyond outer end 334 thereof, making the entire combination of tensioners and roll approximately 16 inches in axial length. A two-inch clearance therefore continuously exists between each end 334 and the internal surface 188 of coil 30, when the lower limit of the vertical travel of robotic arms 128, 128' is coincident with the rotational axis 170 of coil 30. As a practical matter, such a clearance is desirable in order to avoid undesired contact with parts of the coil which might protrude into a coil's ID, such as a sagging inner "tail" end of the coil.

As other viable alternatives for wrapping, it would be obvious to one of ordinary skill in the art to expand or contract the axial length of handles 240 for use with smaller 8- or 10-inch rolls (for smaller IDs) or with larger 16- to 20-inch rolls (for larger IDs). In addition, the compactness of handles 240 make them ideally suited for use in other applications requiring large rotational braking forces.

Before proceeding to the specific hardware and software for at least one of the illustrative embodiments, it should be noted that the greater the care taken during installation to achieve and maintain as close as possible to a perfect alignment and/or orthogonality between horizontal and vertical elements (e.g., X-axis to Z-axis tracks, vertical slides to horizontal platforms and horizontal arms to vertical slides), the greater will be the rewards later on in terms of smoother and more reliable operation of the resulting apparatus.

Figure 23:
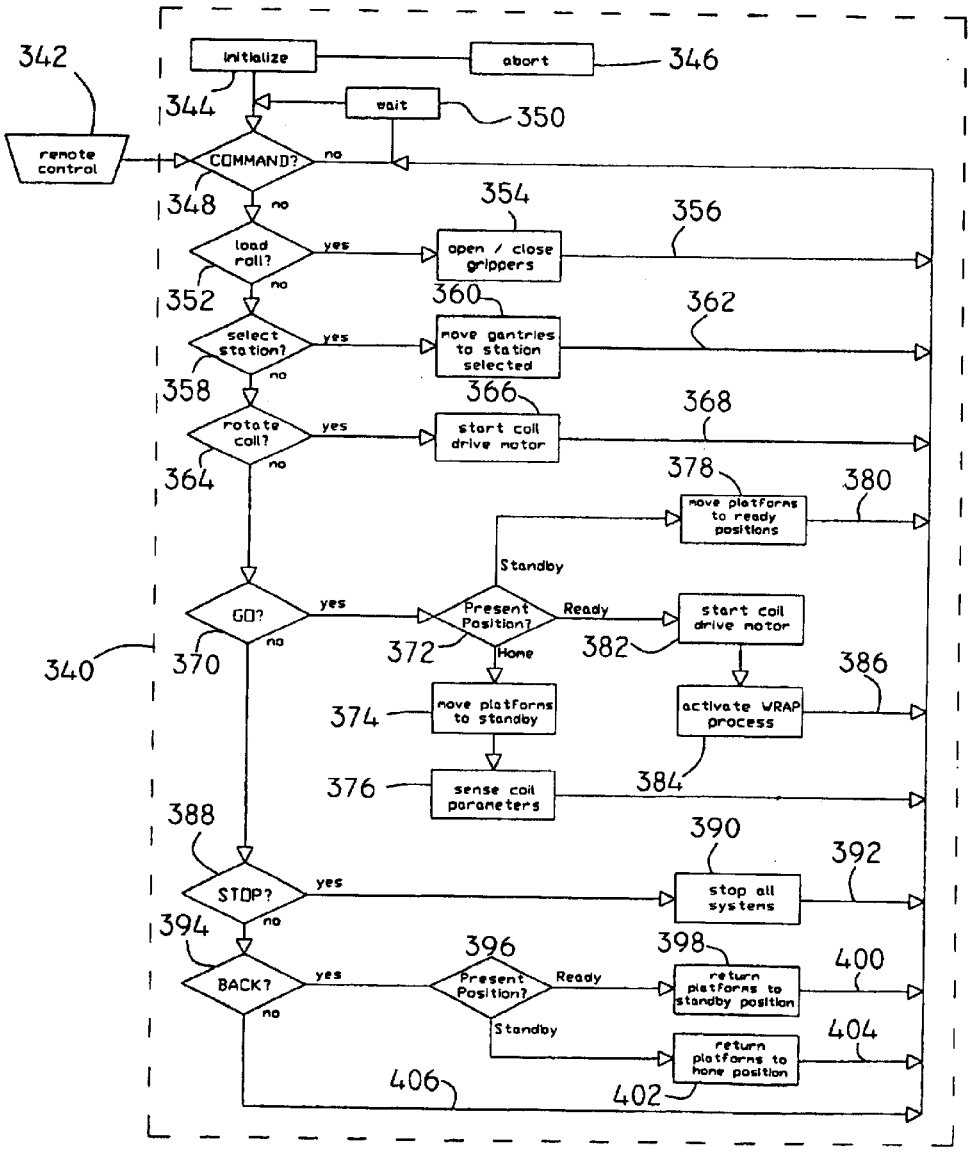
FIG. 23 is an overview block diagram of the computer program that controls the apparatus and method of the invention.

With reference to FIG. 23, the process of wrapping a coil will now be described. It is convenient to describe the process with reference to the programming of the CPU.

Programmed into the CPU is a mainline loop 340 that, in response to manually actuated signals from a manually carried remote 342, controls the wrapping operations of production line 10. As a matter of design choice, system functions are initiated through the use of a hand-held remote control that is easily carried and permits direct observation of all activity related to the coil wrap process. The remote control equipment selected is a lightweight commercially available unit that operates at 435 MHz, a frequency that is isolated from potentially competing units such as those in the 450 MHz range. The unit operates at distances up to 100 feet away, giving an operator complete freedom to move about the plant. The hand-held remote control unit has 8 momentary pushbutton outputs that have been linked to appropriate software within the CPU.

When the operator turns,the power to the system ON, mainline loop 340 tests the initialization 344 of all hardware and software to ensure that they are operational and set at their default values. If any of the tests fail, an abort signal 346, is enabled, typically an audio/visual combination, which "kills" the system until the source of the failure is corrected (e.g., by turning on the pneumatic air supply, if it tests Fff).

After a successful initialization, a COMMAND test 348 continuously recycles to sample the instant the operator manually enters a command. If a command has not been entered, control returns via a wait state 350 to start another sampling cycle. If a command has been entered, control is passed to a series of decision modules to determine which command has been entered. Once the type of command is identified, mainline loop 340 implements the command and returns control to COMMAND test 348 to await the next command. Note that the order of decisions shown in FIG. 23 is not critical to the process flow. They have merely been arranged as shown, since that order roughly corresponds to the usual order of steps of the inventive process. As a practical matter, the sampling loop of FIG. 23 must go through wait state 350 (e.g., 400 mSecs) to avoid sampling the same operator command more than once per second, i.e., allowing enough time for the operator to release the remote control button.

The first decision step 352 tests whether the operator has indicated a desire to load or reload a roll of stretch wrap. If the answer is Yes, alternate depression of the open/close remote control button alternately opens and closes grippers 156, 158 and 156', 158' in the programmed sequence at process step 354, e.g., including (156, 158 opened, 156', 158' closed) and (156, 158 closed, 156', 158' opened), respectively. Opening the grippers of the desired gripper assembly for insertion of roll 200 therein and the subsequent closing thereof is effected thereby. Control is then returned over feedback loop 356 to COMMAND test 348 to await the next command from the operator. If the answer is No, control steps to the next decision.

The station select decision step 358 responds to the operator selecting a station by directing the CPU at process step 360 to move the gantries to either station A, station B, or station C. Control is then returned over feedback loop 362 to COMMAND test 348. If no station was selected, control steps to the next decision.

Provisions are included for the operator to independently rotate the coil at any time, in order, for example, to select an appropriate rotation speed, to start a wrap at the next steel band, to restart a wrap at a new position, etc. Decision step 364 responds at process step 366 to the operator's rotate coil command by starting the coil drive motor at the station previously selected. Control is then returned over feedback loop 368 to COMMAND test 348. If no command to start coil rotation is received, control steps to the next decision.

The GO command begins and oversees the wrapping process. In response to a GO command, decision step 370 diverts control to decision step 372 that tests whether the X-axis platforms are at their Home, Standby, or Ready positions. Decision step 372 includes subroutines that determine the locations and attitudes of the gantries 42, 44 and robots 48, 48'. If the wrapping process is just beginning, the platforms will be at Home, and control is passed to process step 374 which moves the robot's platforms 104, 104' to the Standby position to sense the coil. When robots 48, 48' reach Standby, process step 376 then senses the coil's parameters in the manner outlined above relative to FIGS. 13–16 and returns control to COMMAND test 348. If platforms 104, 104' are already at Standby, process step 378 will advance them to their Ready positions next to the coil. Control is then returned over feedback loop 380 to COMMAND test 348. If the dimensions of the coil have already been sensed at Standby, and platforms 104, 104' have already been moved to Ready, the next step is to wrap the coil. Control transfers to process step 382 which starts the coil roller drive motor, and to process step 384 which wraps the coil as set forth previously relative to FIGS. 6–12. Control is then returned over feedback loop 386 to COMMAND test 348. If no GO signal has been input, control steps to the next decision.

The operator must always have the option to STOP all systems, and this is provided to him by the STOP command. It will be recalled that the operator is hand-carrying the remote control while continuously overseeing the operations. If a situation occurs which requires the system to be stopped, e.g., a malfunction of the equipment or a person in the path of the moving platforms, or as simple as he needs a break, the operator can stop all system motion immediately by using the STOP command. When a STOP command is entered, decision step 388 initiates process step 390 that shuts down all system motion immediately. Control is then returned over feedback loop 356 to COMMAND test 348 to await further instructions. If no STOP command has been encountered by decision step 388, control steps to the final decision.

The last decision step 394 tests whether the operator has requested the system to BACK up. If there is a Back command, decision step 396 determines where the platforms 46, 46' are positioned and backs them up one position. If the platforms are in the Ready position, process step 398 returns them to Standby. If at Standby, process step 402 retracts them back to their Home position on the Z-axis gantries. Control is then returned over feedback loops 400 and 404 to COMMAND test 348. If no BACK command was received, control returns to COMMAND test 348 via feedback loop 406 through the wait state 350, as described above for the reiterative sampling cycle.

Figure 24:
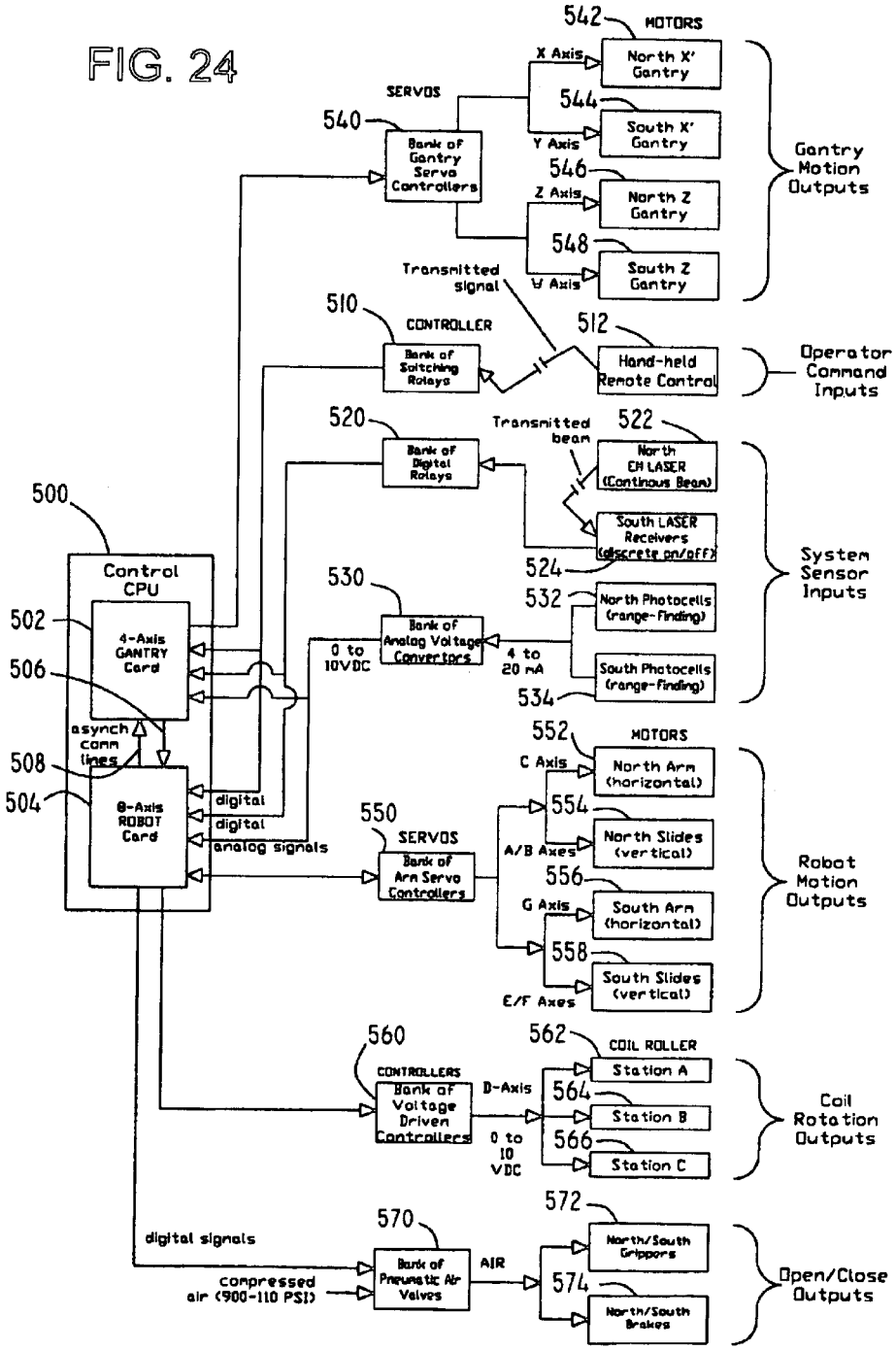
FIG. 24 is a system-level hardware diagram including the major electrical, electromechanical, and pneumatic devices used in the present invention.

FIG. 24 is a system-level hardware diagram interconnecting the major hardware components used in the illustrative embodiments. FIGS. 25–37 delineate a set of program flowcharts as an illustrative embodiment of program software enabling operation of the apparatus and method of the present invention. The flowcharts are intended to show one illustrative example of how the invention can be carried out. They do not in any way limit the scope of the invention, and are not exclusive of other equally effective embodiments which will be obvious to one skilled in the art based upon the disclosure herein, all of which are considered within the scope of the appended claims.

FIG. 24 shows the wrapping system disclosed here under positive control of an ordinary off-the-shelf personal computer (PC), at least a 486 or higher, including a CPU. This is a significant leap forward in robot technology from the antiquated programmable control logic units (PLCs) typically employed for robots in the past. The advantages are too numerous to mention here, but PCs are primarily: more flexible to change (e.g., only a few seconds to change controlling parameters up front in the programs); easier to update (e.g., only a few seconds to modify/add/delete specific instructions, or to replace old program modules with the latest upgrades); and very efficient at multi-tasking (e.g., the PC can independently print but barcodes and labels for the coils being wrapped, tally operational data for system throughput, and feed them to the user's management information system, etc.), all while running the operational robot system.

As a hardware configuration, the PC only requires basic, industry-standard I/O devices, such as a mouse and keyboard for operator/maintainer input, a monitor to display messages, and a floppy drive to backup the system programs externally. Beyond this, several illustrative embodiments are controlled by an eight-button remote control (discussed in detail later), which is purely a matter of design choice since the mouse and keyboard serve in the same capacity. However, a wireless remote control is preferred for several key reasons, primarily because the operator can selectively: perform such functions as "Open/Close grippers" or "Rotate Coil" while standing next to the grippers or boil roller being activated; control preliminary steps of the wrap process while checking out the condition of the coil itself, and monitor the 2–5 minute wrap process from up to 100 feet away while he or she goes off to work on something else.

As shown in FIG. 24, the Control CPU 500 acts, in turn, as a supervisor for two industry-standard, off-the-shelf motion control cards: namely, a master Gantry card 502 which controls all synchronous back and forth motions of the slow-moving North/South platforms via 4 motor axes (X/Y/Z/W); and a slave Robot card 504, which controls all synchronous horizontal and vertical motions of the high-speed robotic arms via 8 motor axes (A/B/ . . . /G/H). Although the cards operate independently, the Gantry program acting as the overall "master" of the two cards must interlace their required actions sequentially. Such coordination of 2 independent cards is facilitated in part by two pairs of asynchronous communication lines 506/508 which observe the following protocol (discussed further with the program flowcharts in FIGS. 25–37):

Asynchronous Communication between the Gantry Card and the Robot Card

| Asynch Comm 1st line/2nd line [see FIG. 24] | | Gantry Card Commands to the Robot Card [on Comm Lines 506] | Robot Card Responses to the Gantry Card [on Comm Lines 508] |
|---|---|---|---|
| 0 | 0 | Gantry card is in control - waiting for operator command | Robot card is in control - requested task is in progress |
| 0 | 1 | Calibrate the system - X/Z gantries are at Home | Operator aborted task - task was not finished |
| 1 | 0 | SENSE the current coil - X gantries are at Standby | Error encountered - error must be corrected |
| 1 | 1 | WRAP the current coil - X gantries are at Ready | Task was successful - OK to proceed to next step |

The next 3 paragraphs illustrates how this simple, bidirectional asynch protocol is used to launch a given coil wrap, with the platforms starting from Home position at any Station A/B/C, with reference to the operator's remote control commands shown in FIG. 23 (described above).

Whenever the system is idle, both Gantry and Robot cards are in a wait loop (comprising command test 348 and wait state 402), awaiting the operator's next remote control command. When the operator presses the remote control 'GO' button (GO test 370), the Gantry card first sends the North/South platforms from Home to Standby position (move step 374). When they arrive at Standby, the master Gantry card commands the slave Robot card to SENSE the dimensions of the coil at hand (via command '10' on lines 506), and then goes into its wait loop. The Robot card responds (with command '00' on lines 508) indicating it is "busy" as it performs the commanded task to Sense (process step 376). When done, the Robot card reports back whether the coil sensing was successful or not (that is, it sends '01' if aborted, '10' if an error, or '11' if successful, on lines 508), and then goes into its wait loop.

At the same time, the Gantry card comes out of its wait loop upon the Robot card response. If it was successful (command '11' on lines 508), upon the operator's 2nd 'GO' command, the Gantry card next sends the platforms down to the Ready position (move step 378), preferably 6 inches from each end face of the coil. At Ready, both cards confirm that all is in order and await the operator's final approval to go ahead. Upon the operator's 3rd and final "GO", the Gantry card commands the Robot card to WRAP the coil (command '11' on lines 506) and reverts to its wait loop. Once again, the Robot card responds (with command '00') indicating it is busy as it performs the requested Wrap (process step 384). When done, the Robot card reports back whether the coil wrap was successful or not (e.g., command '11') and reverts to its wait loop, as above. Once again, the Gantry card detects the Robot card response and reverts to its wait loop awaiting the operator's next command, i.e., either 'BACK' up to Standby (Back test 394 plus process step 396), or 'GO' wrap again (GO test 370 as above).

By commanding the Robot card to Sense or Wrap, the Gantry card is declaring that the platforms have reached their correct Standby or Ready position and no errors have been detected. Thus, these two pairs of asynch hardware lines allow the programs to command, interrupt, wait for, and pass results back to the other, while preserving each card's right to 'kill' the process upon any error. This simple, back-and-forth protocol (i.e., program commands and responses across dedicated I/O lines) effectively interlaces the major tasks sequentially between the two independent cards, which otherwise have no convenient mechanism for "talking" to each other.

FIG. 24 shows the enabling hardware configuration for the present illustrative embodiments. As a rule, all system elements are standard, off-the-shelf components, available from a variety of industry sources. Hence, each element in this diagram will be addressed and discussed generically, since it has no special requirements beyond those mentioned herein. The inputs are derived from industry-standard lasers, photocells, Hall effect position sensors, etc. The outputs are used to control industry-standard servos/motors, which run a variety of gear-coupled actuators, and pneumatic air valves, which energize a variety of single- and double-solenoid grippers.

To begin with on FIG. 24, the Control CPU 500 is nothing more than a conventional PC with standard I/O devices (not shown) as briefly described above. The 4-axis Gantry card 502 and 8-axis Control card 504 control their respective low-speed gantries and high-speed robotic arms, also as mentioned above. They accept both digital and analog input signals, primarily as remote control commands from the operator, initial coil dimension data (coil ID, coil OD, etc.)

and normal operational feedback (laser On/Off, brakes On/Off, Station B sensors On, etc.). Based on this input data, computer programs loaded in the cards (discussed below) decide what the next step should be, where and how far to send the platforms, and how high and how far to launch the arms. These program decisions are then translated into specific digital and analog output signals, which are actually commands for the various electromechanical and pneumatic controllers, telling them which direction and how far to drive their respective actuators.

FIG. 24 shows the most important system inputs as: the hand-held remote control 512 and the sensor inputs, comprising the laser emitters 522 and laser receivers 524, and the North/South range-finding photocells 532 and 534. When the operator presses a command button on the remote control 512, the control 512 transmits one of 8 distinct signals identifying that button to its controller 510, which sets an associated internal switching relay. Both control cards 502 and 504 continuously poll these 8 switching relays in controller 510 for the next operator command (see FIG. 25).

As depicted earlier in FIGS. 13–16, a laser emitter 214 on the North platform transmits a continuous beam to its associated laser receiver 218 on the opposing South platform. Under normal system conditions, the laser receiver 218 is always On, reflecting that the arms are properly calibrated vertically and horizontally (within a prescribed tolerance of ⅛ inch). This permits the laser to precisely measure the inside and outside diameter (ID and OD) of the present coil, as fully described in FIGS. 13–16. The laser is also useful for verifying that both platforms, North and South, are in fact at the same Station before launching a new wrap session. There is also another, identical laser mounted on the rear of robotic arms 48 (not shown), which is used to align and calibrate the arms to a horizontal Home position. Although the rear laser does reduce the time for calibrating the arms considerably, such alignment can be done just as accurately manually via incremental up/down motion commands to the Robot card.

While the inputs from remote control 512 and laser receiver 218 are by definition digital On/Off signals, the off-the-shelf photocells 532 and 534 measure distance continuously from as close as 6 inches to as far as 16 feet from their 3-inch white targets 228 (within a ¼-inch tolerance). Such continuously varying output can only be represented by an analog signal, ranging in this case from 4-to-20 milliamps (note that the manufacturer chose milliamps over millivolts here to minimize inevitable long-line transmission 'noise'). Hence, their output of 4-to-20 mA must be converted to 0-to-10 Volts DC at the other end of the signal line by analog-to-voltage converters 530 so that these vital distance inputs can be recognized and processed by cards 502 and 504.

FIG. 24 further shows the most important system outputs as: a set of servo motors driving the low-speed Gantry actuators, another set of servo motors driving the high-speed Robot actuators, three independent coil rollers for rotating the coil at Stations A/B/C, and a set of North/South pneumatic grippers and pneumatic brakes. Each actuator in each set is commanded in turn by its own controller, in one form or another, which are collectively organized into physical clusters called 'banks'—hence, the many 'banks' of controllers delineated on FIG. 24. To simplify I/O signals/cables to a minimum, the grippers 572 have been wired together in groups of two (North/South), and the brakes 574, in groups of four (North X/Z, South X/Z).

Based on remote control commands from the operator, Gantry card 502 sends the North and South platforms toward the coil at hand with the North X' motor 542 (via its internal X axis) and the South X' motor 544 (via its internal Y axis), respectively. Similarly, based on remote control command inputs, Gantry card 502 sends the North and South platforms synchronously down to the next Station A/B/C with the North Z motor 546 (via its internal Z axis) and the South Z motor 548 (via its internal W axis).

Upon receiving specific 'SENSE' and 'WRAP' commands from the Gantry card 502, the Robot card 504 calculates its motion outputs based on distance inputs from laser emitter/receiver 522/524 and range-finding photocells 532/534. Robot card 504 launches the robot arms 128 horizontally in and out of the coil via the North arm motor 552 (internal C axis) and the South arm motor 556 (internal G axis) the same distance. Based on the same inputs, Robot card 504 also raises and lowers the robot arms vertically via the North slide motors 554 (internal A/B axes) and the South slide motors 558 (internal E/F axes) the same distance.

Both of these sets of Gantry and Robot motors are controlled by an associated bank of Gantry servo controllers 540 and Robot servo controllers 550, respectively, one servo controller for each motor. To do this, the Gantry and Robot cards simply send a prescribed command voltage to each controller (ranging from −10 to +10 volts), which indicates how far in which direction the given actuator must travel. These servos provide feedback to the 2 control cards reflecting the distance traveled in terms of precise motor 'counts' which are used to calculate, monitor, and confirm actuator travel distances. It should be noted that such servomotor control and feedback is old and well established in the art, so that such conventional command/feedback techniques and signal wiring will not be discussed here, nor shown in FIG. 24 for the sake of clarity. It is also noted that both control cards are connected to the remote sensors, grippers, etc., via 50-pin signal cables and breakout boxes, which are also basic conventions well-established in the art and, hence, are likewise not shown in FIG. 24.

As shown in FIG. 24, there are three coil rollers in the system, one for each Station A/B/C. Since they are only used during the coil wrap process, these coil rollers 562/564/566 are under the exclusive control of the Robot card via the bank of voltage-driven controllers 560. Due to the tremendous weight they must turn (i.e., up to 30 tons), these coil rollers are driven by large, commercially-available 1-HP motors with very large coupling gears (i.e., 365-to-1 ratio) which enable them to provide large torque at low speeds, as needed for the present process. These motors operate in the same manner as the smaller Gantry and Robot motors, but in their 'voltage' mode rather than their normal 'servo' mode. That is, the size of their 0-to-10 volt control signal dictates how fast they should turn—ultimately turning a typical coil from ½ to 2 RPM. To reduce hardware requirements and I/O axes, these three coil roller motors 562/564/566 are all multiplexed on the Robot card's H axis. That is, since only one motor is needed at a time, the Robot card switches its H axis between them as the Gantry card moves to Stations A/B/C, respectively.

Finally, FIG. 24 shows the system's pneumatic outputs as the North/South grippers 572 and the North/South brakes 574, serviced by a bank of pneumatic air valves 570. For this output, a constant flow of compressed air must be supplied to keep the system working (between 90–110 PSI). Once again, the pneumatic air valves 570 are selectively turned On and Off by the control cards 502 and 504, depending on which set of grippers or brakes must be activated. For example, to maintain positive control over the transfer of stretch wrap roll 200 between robot arms 128 and 128', the South receiving grippers 138' must be closed just prior to release by the North sending grippers 138 (about 200 mSecs early) to prevent handles 240 from twisting out of the grasp of the grippers.

FIGS. 25–37 delineate a set of program flowcharts that represent an exemplary illustrative embodiment of program software capable of monitoring and controlling the apparatus and method cited in the attached claims.

The following listings discuss each of the present program flowcharts, wherein each flowchart represents at least one program module identified by its program filename [found in a rectangular box at the top of its associated figure].

System Control [refers to components in the hardware diagram of FIG. 24]

The present wrapping system is under complete control of a typical off-the-shelf PC [486 or higher]

PC has a keyboard/mouse for operator/maintainer input and a monitor to display messages The PC is in turn under dedicated control of 2 off-the-shelf motion control cards [see above]:

4-axis Gantry card controls synchronous back & forth motions of the North/South Platforms 8-axis Robot card controls synchronous up & down motions of the opposing robotic Arms Although cards operate independently, their required actions must be sequentially interlaced e.g, 4-axis card sends platforms down the Gantries, 8-axis card puts Arms in motion to wrap Their independent operation is tied together by just 4 asynch command lines [see below]

The 4-axis card also indicates current system operating state via a set of 4-color stack lights System software controlling AW is completely modular and parametric for higher efficiency Related system operations are grouped functionally into their respective system modules For example, all setup and initialization functions are grouped into the Startup module Within each module, all functions are grouped according to their priority and commonality e.g., specific positioning/sensing/wrapping functions appear in separate subroutines The most common subroutine, which micro-adjusts positions to small 'deltas', has up to 5 calls All parameters are set upfront, so that one update changes that parameter throughout the entire program System software running the 2 control cards consists of 2 sets of parallel, interactive modules:

Startup Program for each card initializes the system, the motors, & the cards themselves Startup must be run after system power up, but prior to turning on power to the motors Operate Program for each card moves the platforms into position and wraps a given coil Operate is run after successful Startup [i.e., no init errors], prior to moving platforms The following listing describes both the StartupGantry and StartupRobot programs generically, since they are essentially identical in structure and function Startup Program [operation indicated by steady Red stack light]

step ST1 checks whether the current program is loaded in correct card, 4-axis or 8-axis [Err1 out]

step ST2 determines if the other control card, 8-axis or 4-axis, is also 'up and running' [Err1 out]

step ST3 'inits' or initializes the system, the motors, and the cards themselves—for example:

Init system by setting program parameters, such as how data will be displayed to operator Init motors by setting feedback parameters, speed/accel/decel, and resetting counts to zero Init cards themselves by configuring I/O blocks, and establishing inter-card asynch protocol step ST4 verifies that all motor counts/error counts are reset to zero [Err2 out]

step ST5 releases power interlocks [one for each card] so that operator can turn motor power ON vital interlock prevents accidental, haphazard 'firing' of motors upon power up that is, operator is precluded from turning motors ON until both cards have performed reset Operator notified with flashing Green stack light & message "OK to turn on motor power"

step ST6 waits for operator to turn motor power ON, subject to a reminder every 2 minutes step ST7 resets all motor position/error counts to zero again upon motor power ON [Err2 out]

this is a vital reset, since all motors power up with random counts rather than desired zero step ST8 verifies that all motor position/error counts are reset to zero again [Err2 out]

step ST9 determines if North platform is at Station A, B or C, verified by A/B/C switch [Err3 out]

step ST10 determines if South platform is likewise at A/B/C, verified by A/B/C switch [Err3 out]

e.g., both platforms must be at same station in order for them to roll synchronously i.e., if not, operator must call maintainer to move errant platform to same station as the other step ST11 verifies all system sensors are ON, or 'up & running', in normal default state [Err4 out]

step ST12 determines whether both front/rear Lasers are ON [Err4 out upon 3rd attempt to cal]

step ST13 calibrates the front with the rear laser, or vice versa, depending on which is ON this calibration is important, since it 'fixes' the opposing robot arms in exact same horiz plane since at least one laser is ON, it can easily be centered to act as a reference for 2nd laser 2nd laser can then be turned ON/centered by slowly moving its vertical slide up/down ¼"

step ST14 determines whether all actuators are back at Home [Err5 out upon 3rd attempt to reset]

step ST15 resets any actuator whose Home switch is not ON, usually by micro-adjusting its motor this is an important reset since it 'fixes' the starting position of every significant system element step ST16 verifies that all limit switches are OFF prior to startup [e.g., max and min travel]

step ST17 turns all motors ON, upon successful confirmation of all the above system tests step ST18 illustrates asynch protocol conducted between the cards to release brakes on the arms:

i.e., AW has brakes on all 4 vertical slides to keep the arms from falling when motors OFF in this case, the 4-axis card controls the brakes, and the 8-axis card controls the slide motors in step ST19, 4-axis card commands 4-axis card to turn motors ON, expecting a response back in step ST20, 8-axis card confirms all arm/slide motors are ON, starting up the asynch comm.

in step ST21, 4-axis card responds by releasing the North/South slide brakes for slide motion in turn, the 4-axis card confirms that the slide brakes are OFF, and it's safe to 'go ahead' in step ST22, 8-axis card acknowledges the 'go-ahead' signal, ending its end of asynch comm.

in step ST23, 4-axis card acknowledges 8-axis 'OK' signal, and terminates this asynch comm.

step ST24 initializes the sensor baseline arrays [setup at installation time]for Operate sensor use serves to strategically offload this massive data load from the more complex Operate program the concept, structure and format of these sensor arrays were described earlier step ST25 determines if current Max sensor readings exceed ¼" tolerance over Max array data if so, step ST26 makes a calibration run to find current sensor 'deltas' at each 6" interval as the program moves the platforms slowly together from Max to Min separation [140"→32"]

step ST27 updates sensor baseline arrays by adding the 'deltas' registered at each 6" interval step ST28 calls up the Operate Program [in each card] to begin normal Gantry/Robot operations until this time, operator is precluded from Remote Control until Startup is OK on both cards that is, 4-axis card uses asynch protocol again to determine if 8-axis Startup was successful If so, operator notified with steady Yellow stack light & message "OK to begin Operation"

Figure 25:
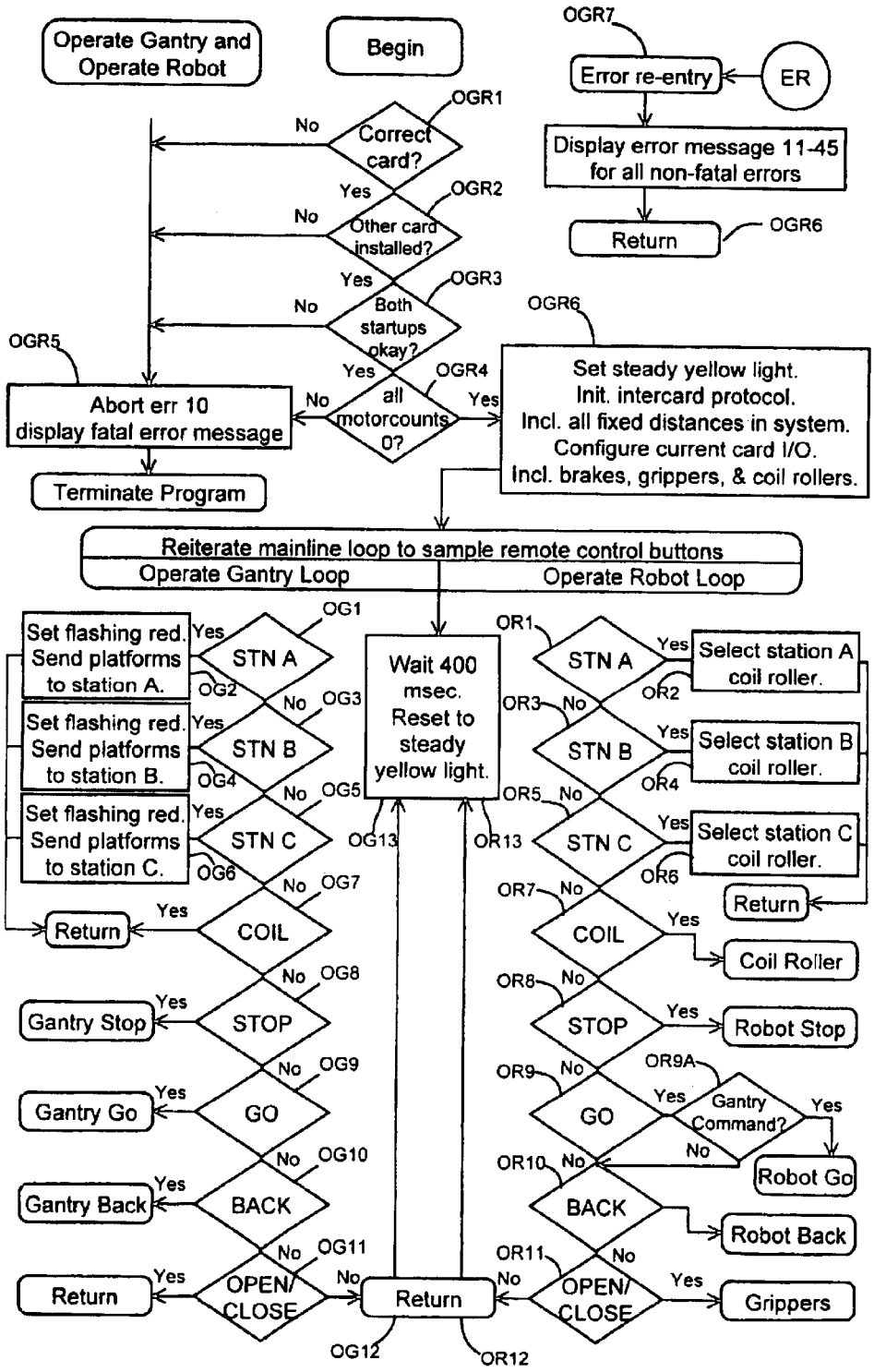
FIGS. 25–37 delineate a set of program flowcharts as an illustrative embodiment of program software for monitoring and controlling the apparatus and method of the invention described herein.

Otherwise, step ST29 turns on steady Red stack light if there was any error [Err1–5] during Startup on either the 4-axis or 8-axis card, and displays "Program Terminated" message to operator FIG. 25 charts the mainline loops for the OperateGantry and OperateRobot programs, which are essentially identical in structure and function, as described in detail in the following listing, including their exceptional differences:

Operate Program [operation indicated by steady Yellow stack light]

As with the Startup Program, both the Gantry and Robot card have parallel Operate Programs where Gantry moves the platforms into position, and Robot moves the arms to sense and wrap Since both the Init and Mainline Loops are virtually identical on both cards, the flow of their common structure is shown side-by-side for ease of understanding, as follows:

Init Loop tests whether both cards are successfully 'up & running' before enabling [Err10 out]

In step OGR1, each Operate program self-determines whether it is loaded in the correct card [i.e., by interrogating an extended I/O pair only available on the Gantry card]

In steps OGR2/3, each card tests whether the other card has been enabled and the startup was successful [via interlocking I/O]

In step OGR4, each card verifies that its own Startup Program has zeroed all motor counts In step OGR5, both cards display an Abort error mssg and terminate if any above test fails If all above tests are successful for both cards, then step OGR6 proceeds to init each card:

Init intercard asynch protocol as a sort of initial 'handshake' signifying successful Init Init program parameters, including all fixed distances in system entered at install time Configure card I/O, including brakes released, grippers open, and coil roller axis ON After successful init, Mainline Loop continuously recycles to sample the instant the operator depresses any of the [8] function buttons on the AW Remote Control [note that Mainline is shown here as two parallel paths for Operate Gantry pgm and Operate Robot pgm]:

Step OG1 tests whether button 1 is ON to Goto Station A

If so, step OG2 sends both platforms to Station A with flashing Red light as described above [note: Mainline sampling loop is suspended until both platforms have arrived at Station A]

At same time, step OR1 senses button 1 ON and step OR2 selects Coil Roller A at Station A [note: this allows all 3 coil rollers to be multiplexed into one axis, which is activated later]

Similarly, step OG3 tests whether button 3 is ON to Goto Station B

If so, steps OG3 proceeds to Station B, and steps OR1/OR2 selects Coil Roller B, as above Similarly, step OG5 tests whether button 5 is ON to Goto Station C If so, steps OG3 proceeds to Station C, and steps OR1/OR2 selects Coil Roller C, as above Step OR7 tests whether button 7 is ON to call Coil Roller rtn to selectively rotate present CR Note that step OG7 ignores command, since Gantry card has no control over Coil Rollers Step OG8 tests whether button 8 is ON to call Gantry Stop routine to immediately stop gantry At same time, step OR8 tests button 8 to call Robot Stop to immediately stop any arm motion Step OG9 tests whether button 9 is ON to call Gantry Go routine to send platforms toward coil at same time, step OR9 tests button 9 to call RobotGo to either sense or wrap the present coil Step OR9*a* ignores this Go cmd unless Gantry issues an associated Sense or Wrap command Step OG10 tests whether button lo is ON to call GantryBack to retract platforms back from coil At same time, step OR10 tests button 10 to call Robot Back to retract arms back Home Step OR11 tests whether button 8 is ON to call Open/Close routine to open/close the grippers Note that step OG11 ignores command, since Gantry card has no control over the grippers Steps OG12/OR12 represent the focal point where all routines Return to the Mainline Loop i.e., this is common point at which all called routines re-enter loop at end of their execution For example, step OGR7 shows the common re-entry point for errors in all Operate routines Steps OGR8/9 displays the associated message for Errors 11–45 and returns to OG12/OR12

Figure 26:
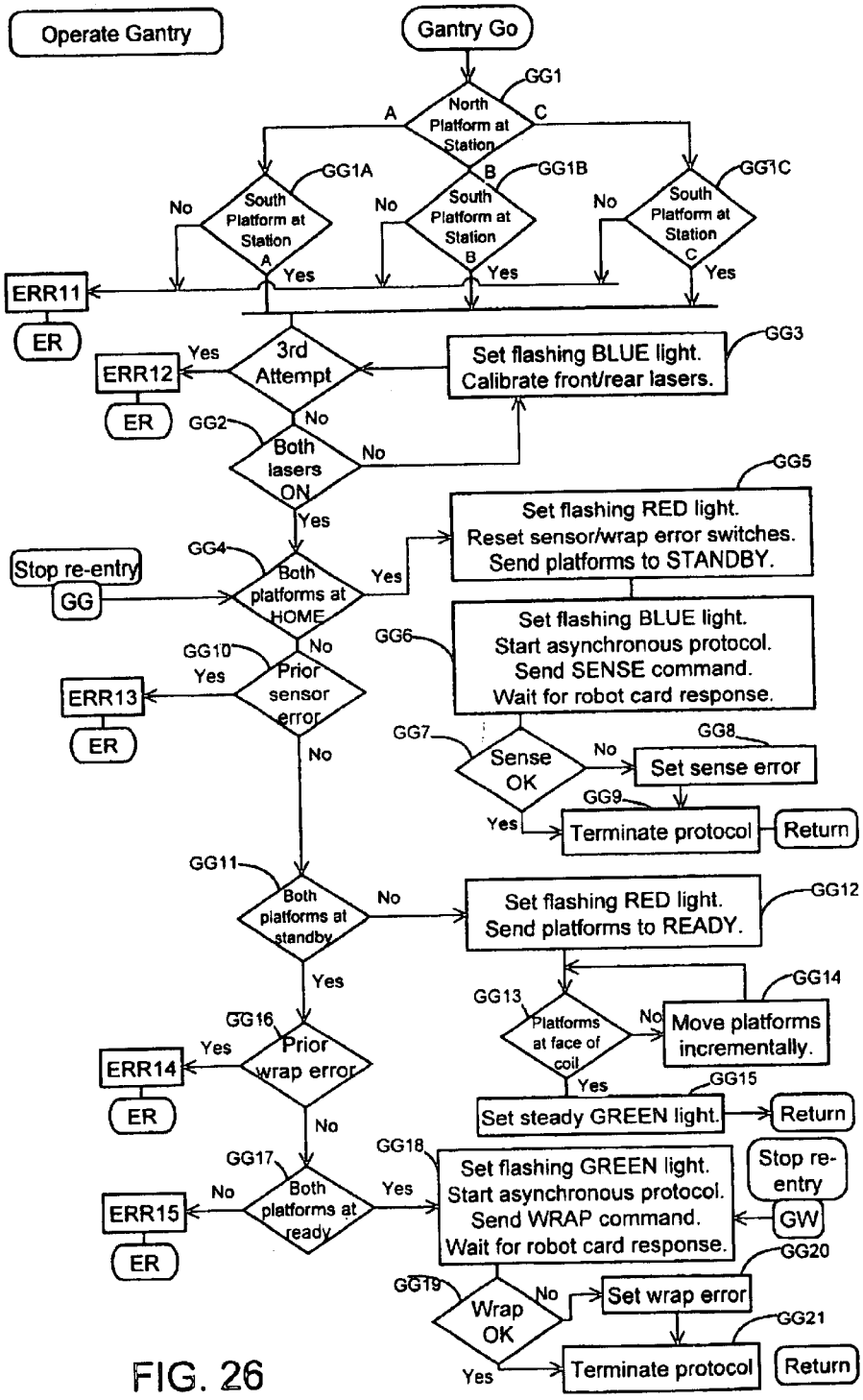

Step OR13 resets to default color, steady Yellow light, from whatever color is passed into loop OR13 then waits 400 mSec before recycling through the Mainline loop for next command This is a delicate timing constraint that avoids unwanted 'double-bounce' registration of the same command, & allows both cards to asynchronously register same cmd within same sec FIG. 26 charts the GantryGo Routine for the OverateGantry program, which is described in detail in the following listing:

Operate Gantry: Gantry Go Routine [indicated by flashing Red or Blue light]

The Gantry Go routine performs 4 major tasks:

Determines if it is safe for platforms to approach the present coil

If so, Go sends the platforms to the coil, first to Standby, then to Ready

At Standby, it commands the Robot card to sense the dimensions of the coil

At Ready, it commands the Robot card to wrap the coil, and awaits its response

Step GG1 tests whether the North platform is at Station A, B, or C

Steps GG1A/B/C test whether South platform is at the corresponding station [Err11 out]

Step GG2 tests if both lasers are ON [Err12 out after 3rd attempt to calibrate]

Step GG3 sets flashing Blue light, and calibrates the front/rear lasers by raising/lowering the OFF laser up to ½" until it comes ON, and then adjusting each laser to its preset centerline Step GG4 tests whether both platforms are at Home, on their respective Z tracks If so, step GG5 sets flashing Red light, resets Sense/Wrap Error switches, and sends platforms to Standby [note: Go suspends all activity until platforms arrive at Standby]

Step GG6 sets flashing Blue light, starts the asynch protocol, and sends the Sense command to Robot card [note: Go goes into a programmed wait state awaiting Robot response at GS]

Step GG7 tests Robot response for errors during process—if so, step GG8 sets Sense Error Step GG9 then terminates the Sense asynch protocol, and returns to Mainline If platforms are already out from Home, step GG10 tests for prior Sensor Error [Err13 out]

Step GG11 then tests whether both platforms are at Standby, on their respective X' tracks If so, step GG12 sets flashing Red light, and sends platforms to Ready, directly in front of coil Step GG13 tests whether each platform has arrived at the face of the coil on its side If not, step GG14 moves each platform forward, initially in ½" increments, then in 1/16"

Upon reaching face of coil, Step GG15 sets steady Green light and returns to Mainline If platforms are already past Standby, step GG16 tests for prior Wrap Error [Err14 out]

Step GG17 then tests whether both platforms are at Ready, on their X' tracks [Err15 out]

If so, step GG18 sets flashing Green light, starts the asynch protocol, and sends the Wrap command to Robot card [as above, Go goes into wait state awaiting Robot response at GW]

Step GG19 tests Robot response for errors during process—if so, step GG20 sets Wrap Error Step GG21 then terminates the Wrap asynch protocol, and returns to Mainline FIG. 27 charts the GantryBack Routine for the OperateGantry program, which is described in detail in the following listing:

Operate Gantry: Gantry Back Routine [indicated by flashing Red stack light]

The Gantry Back routine performs the singular task of retracting the platforms back Home:

Back first determines whether either platform is beyond the last position it was sent to It then sends the platfortm[s] from the coil, first to Ready, then to Standby, then Home Note: no significant errors arise here since the platforms are withdrawing over known paths Step GB1 tests whether either or both platforms are beyond Ready [on the X' tracks]

Figure 27A:
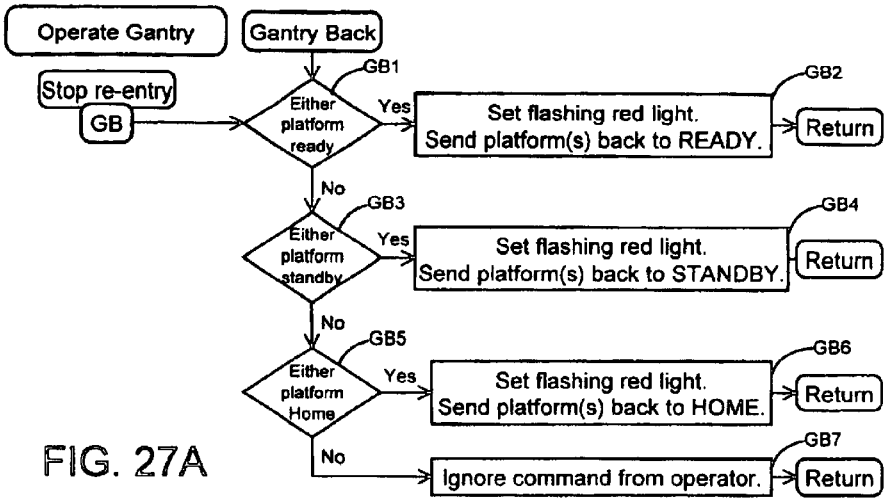
Figure 27B:
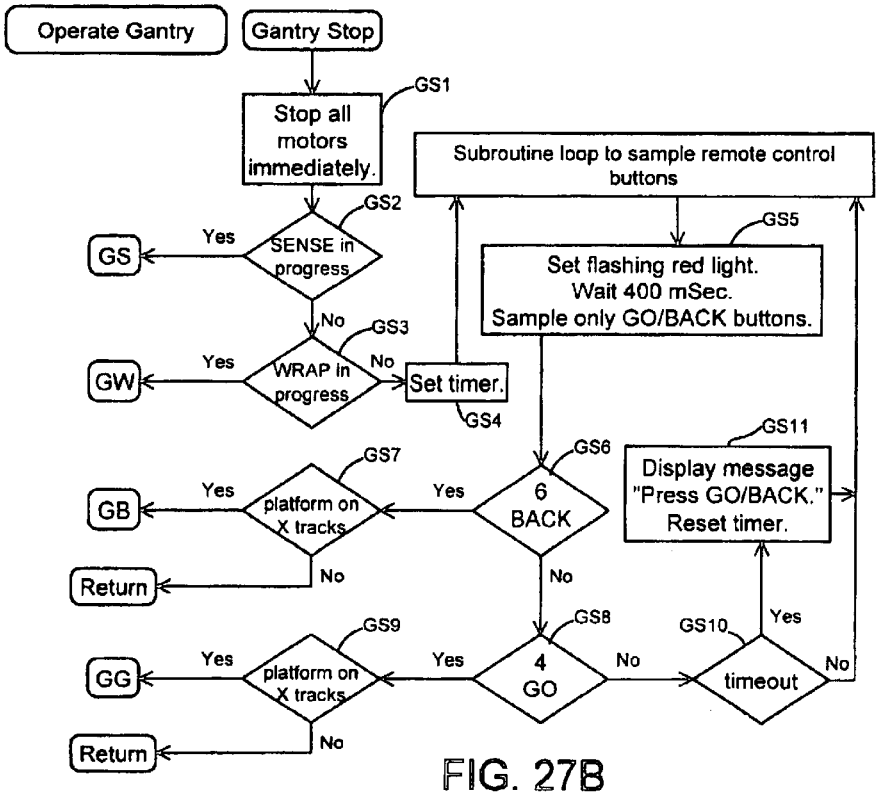

If so, step GB2 sets flashing Red light, sends platform[s] back to Ready, and returns Step GB3 tests whether either or both platforms are beyond Standby If so, step GB4 sets flashing Red light, sends platform[s] back to Standby, and returns Step GB5 tests whether either or both platforms are beyond Home If so, step GB6 sets flashing Red light, sends platform[s] back Home, and returns If platforms already Home, step GB7 ignores this Back command from operator, and returns FIG. 27 also charts the GantryStop Routine for the OverateGantry program, which is described in detail in the following listing:

Operate Gantry: Gantry Stop Routine [indicated by flashing Red light]

The Gantry Stop routine performs 4 major tasks:

It immediately 'soft' stops all motors, as opposed to a 'hard' Emergency stop [note: this is an important distinction, since the soft stop acts as a 'pause' that can be quickly resumed]

Figure 28A:
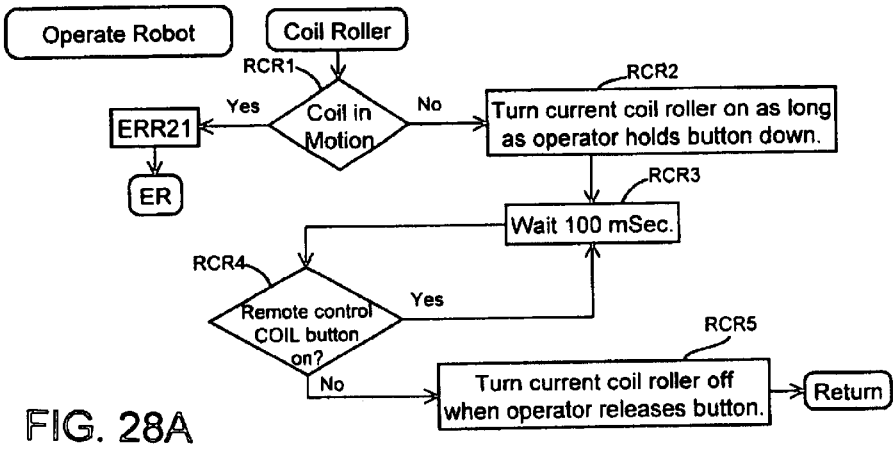
Figure 28B:
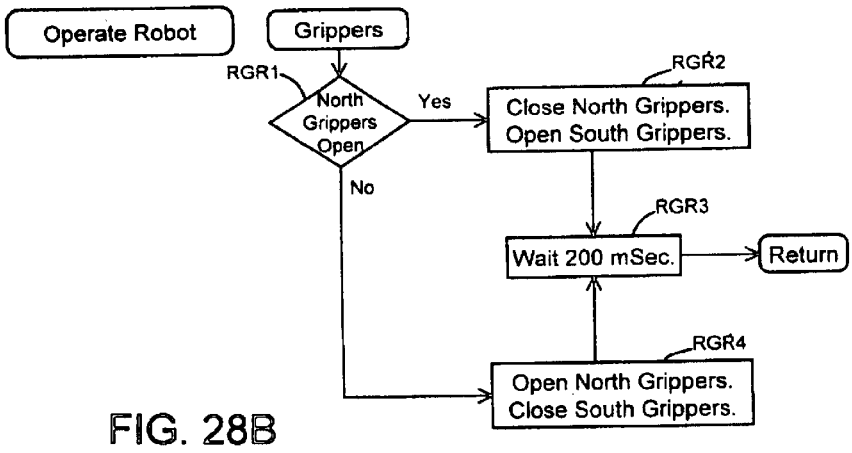

Stop then goes into an independent sampling loop, awaiting a remote control Go or Back Upon a Go command, it re-enters the Gantry Go routine at the proper position Upon a Back command, it re-enters the Gantry Back routine at the beginning Step GS1 immediately stops all Gantry motors, including North/South Z axis and X' axis Step GS2 tests if a Sense routine is currently in progress—if so, it returns via GS to Go routine Step GS3 tests if a Wrap routine is currently in progress—if so, it returns via GW to Go routine Step GS4 sets a timer to display reminder messages to the operator Step GS5 sets flashing Red light, and waits 400 mSec to start next cycle thru the sampling loop Step GS6 tests whether button 6 is ON to call Gantry Back to retract platforms back from coil If ON, step GS7 tests whether platforms are on the X' tracks—if not, it returns to Mainline If so, it re-enters the Gantry Back routine via re-entry GB at the beginning Step GS8 tests whether button 4 is ON to call Gantry Go routine to send platforms toward coil If ON, step GS9 tests whether platforms are on the X' tracks—if not, it returns to Mainline If so, it re-enters the Gantry Go routine via re-entry GG at the midpoint If neither Go or Back was pressed, step GS10 tests if the current timeout has expired If so, step GS11 displays a 'Press GO or BACK' message to operator, and resets timer Gantry Stop cycles through this sampling loop indefinitely, awaiting operator's next command FIG. 28 charts the CoilRoller and Grippers Routine for the OperateRobot program, which is described in detail in the following listing:

Operate Robot: Coil Roller Routine [indicated by flashing Blue stack light]

The Coil Roller routine performs the task of rotating current Coil Roller, at operator discretion e.g., operator may want to rotate coil to restart wrap, or start wrap at next steel band k Step RCR1 tests whether coil is currently in motion—i.e., already being wrapped [Err21 out]

If not, step RCR2 turns current Coil Roller ON that was selected by operator as Station A/B/C Steps RCR3/4 are a wait loop that permits operator to rotate coil as long as he holds button ON Once Remote Control button 7 is released, step RCR5 turns current Coil Roller Off, and returns Operate Robot: Grippers Routine [indicated by flashing Blue stack light]

The Grippers routine performs the task of opening/closing grippers, at operator discretion e.g., operator presses this command when he needs to load/reload a new roll of stretch wrap North/South grippers are opened/closed in alternating sequence, just as during wrap process Step RGR1 tests whether the North grippers are currently open, implying South grippers closed If so, step RGR2 closes North grippers and opens South grippers If not, step RGR4 opens North grippers and closes South grippers, alternating with step RGR2

Both steps next wait for 200 mSec at step RGR3 for jaws to finish motion, and then return FIG. 29 charts the RobotBack Routine for the OperateRobot program, which is described in detail in the following listing:

Operate Robot: Robot Back Routine [indicated by flashing Yellow stack light]

Figure 29A:
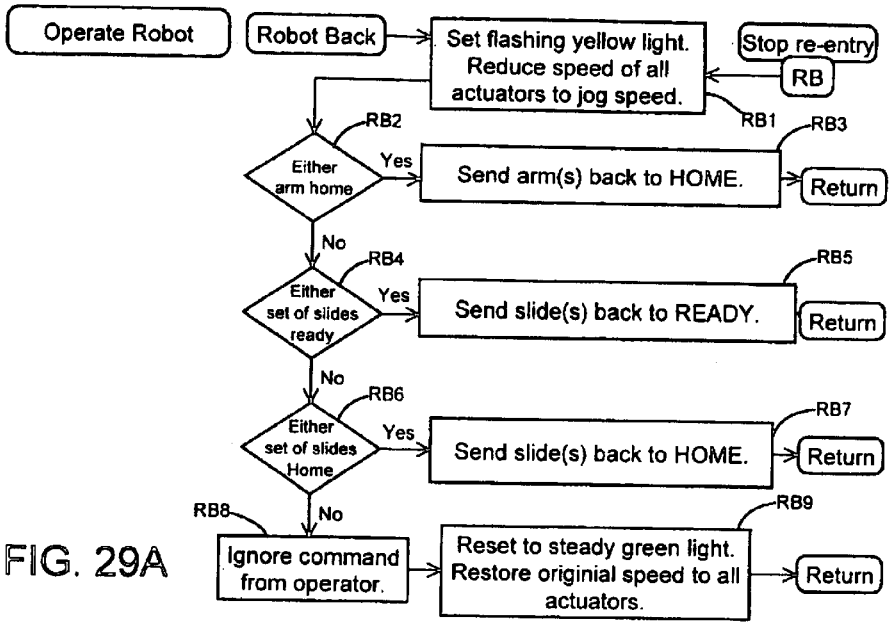
Figure 29B:
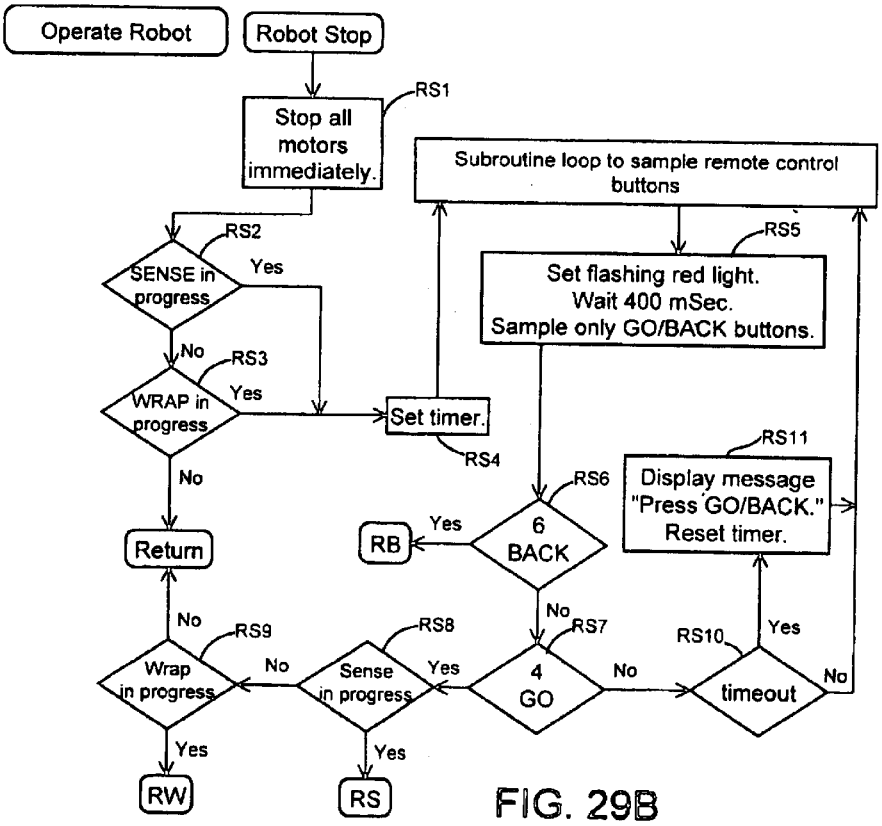

The Robot Back routine performs the singular task of retracting the arms/slides back Home:

Back first determines it either or both arms are out past Home, and brings them back Home It then retracts the slides from their current position, first to Ready, then Home Note: no significant errors arise here since arms/slides are withdrawing over known paths Step RB1 sets flashing Yellow light, and reduces speed of all actuators down to jog speed Step RB2 tests whether either or both arms are beyond their normal horizontal Home If so, step RB3 sends arm[s] back Home, where they are completely withdrawn, and returns Step RB4 tests whether either North or South slides are beyond Ready at coil centerline If so, step RB5 sends slide[s] back to Ready, and returns to Mainline Step RB6 tests whether either North or South slides are beyond Home If so, step RB7 sends slide[s] back Home, and returns to Mainline If arms/slides already Home, step RB8 ignores this Back command from operator, and returns FIG. 29 also charts the RobotStop Routine for the OperateRobot program, which is described in detail in the following listing:

Operate Robot: Robot Stop Routine [indicated by flashing Red while system is motionless]

The Robot Stop routine performs 4 major tasks, functionally similar to the Gantry Stop routine:

It immediately 'soft' stops all motors, as opposed to a 'hard' Emergency stop [note: this is an important distinction, since the soft stop acts as a 'pause' that can be quickly resumed]

Figure 30:
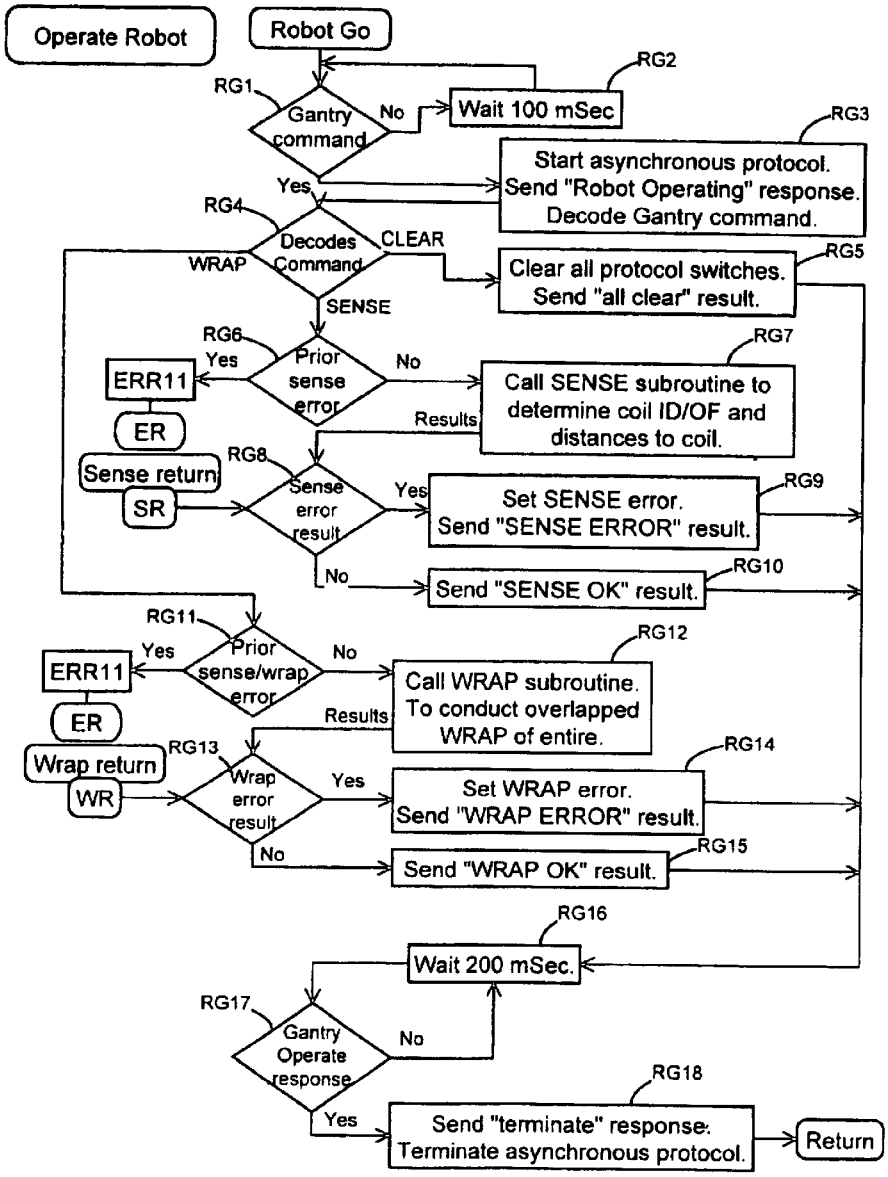

Stop then goes into an independent sampling loop, awaiting a remote control Go or Back Upon a Go command, it re-enters the Robot Go routine at the proper position Upon a Back command, it re-enters the Robot Back routine at the beginning Step RS1 immediately stops all Robot motors, including both North/South arms and slides Steps RS2/3 test if the Sense or Wrap routine is currently in progress—if not, it returns Step RS4 sets a timer to display reminder messages to the operator Step RS5 sets flashing Red light, and waits 400 mSec to start next cycle thru the sampling loop Step RS6 tests whether Back button 6 is ON to call Robot Back to retract arms back from coil If ON, it re-enters the Robot Back routine via re-entry RB at the beginning Step RS7 tests whether Go button 4 is ON to call Sense or Wrap subroutine to sense/wrap coil If Sense in progress, step RS8 re-enters the Sense subroutine via re-entry RS at beginning If Wrap in progress, step RS9 re-enters the Wrap subroutine via special Stop re-entry RW If no subroutines are active, step RS9 routinely returns to Mainline If neither Go or Back was pressed, step RS10 tests if the current timeout has expired If so, step RS11 displays a 'Press GO or BACK' message to operator, and resets timer Robot Stop cycles through this sampling loop indefinitely, awaiting operator's next command FIG. 30 charts the RobotGo Routine for the OperateRobot program, which is described in detail in the following listing:

Operate Robot: Robot Go Routine [indicated by steady Yellow or Green light]

The Robot Go routine performs 3 major tasks to get the current coil wrapped:

It awaits and decodes Gantry commands sent via asynch protocol to coordinate the 2 cards If Sense command, Go calls the Sense subroutine, and awaits its results as 'OK' or 'Error'

If Wrap command, Go calls the Wrap subroutine, and awaits its results as 'OK' or 'Error'

Step RG1 tests whether Gantry command has been completed [i.e., both bits set/reset]

If so, step RG3 starts up the asynch protocol, which comprises 2 steps:

If not, step RG2 waits 100 mSec, which is enough time for Gantry card to send both bits Sends back 'Robot Operating' response, to put Gantry card on hold while Robot operates Decodes Gantry command, sent as 2 encoded I/O bits [asynch protocol discussed above]

Step RG4 tests whether current Gantry command is to Sense, to Wrap, or simply to Clear If CLEAR command, step RG5 clears all protocol switches, and sends back 'all clear' result If SENSE command, the following chain of steps are taken:

Step RG6 tests if there was a prior Sense error during current approach [Err22 out]

If not, step RG7 calls SENSE subroutine to determine Coil ID/OD, and X' distances to coil Step RG8 tests the results of SENSE, subroutine as Sense session came out 'OK' or 'Error'

If Error, step RG9 sets the Sense Error for the current approach, and sends 'Sense Error'

If OK, which is normal successful result, step RG10 sends 'Sense OK' result to Gantry If WRAP command, the following chain of steps are taken:

Step RG11 tests if there was a prior Sense or Wrap error during current approach [err23 out]

If not, step RG12 calls WRAP subroutine to conduct overlapped wrap of entire coil Step RG13 tests the results of WRAP subroutine as Wrap session came out 'OK' or 'Error'

If Error, step RG14 sets the Wrap Error for the current approach, and sends 'Wrap Error'

Figure 33:
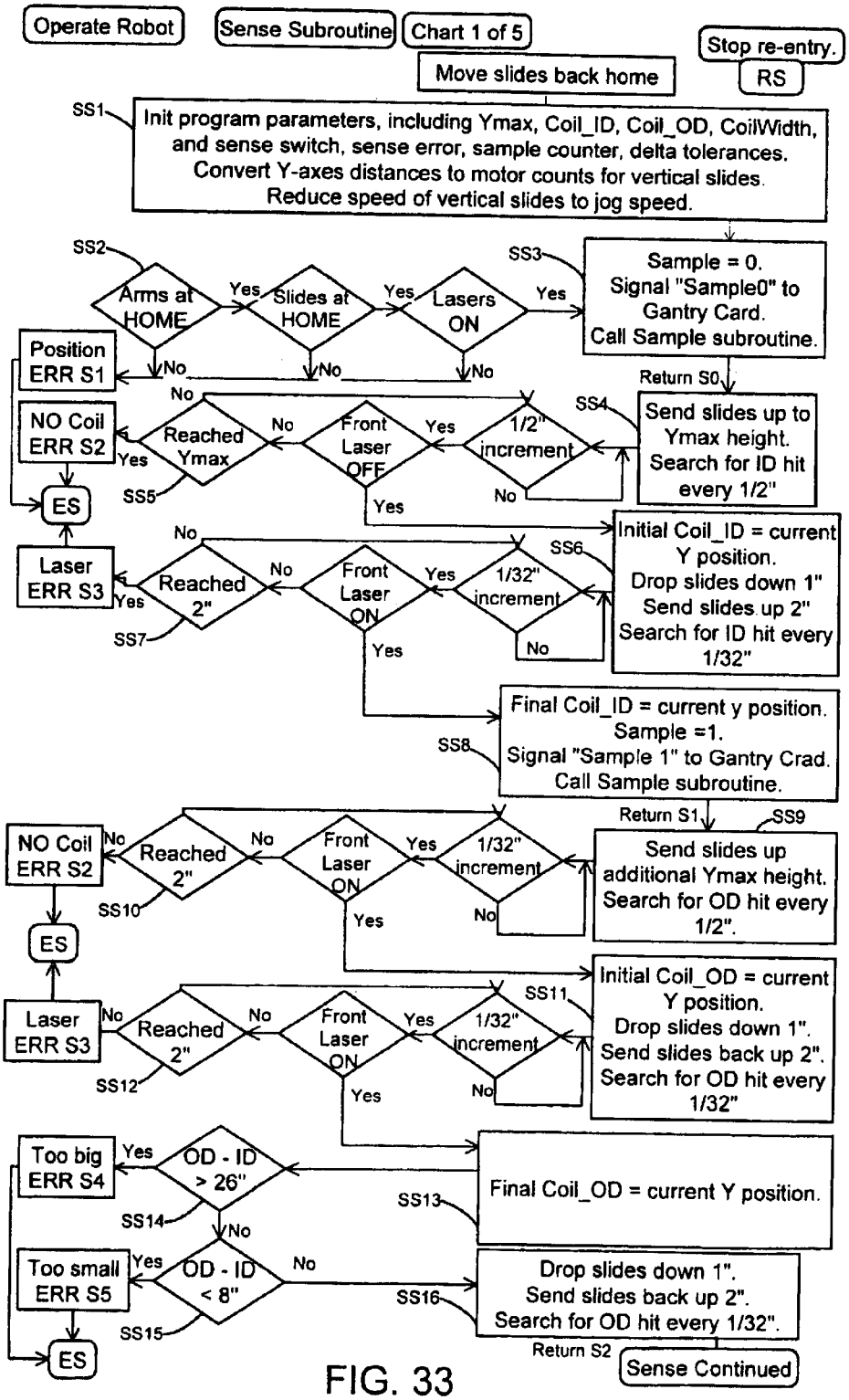

If OK, which is normal successful result, step RG15 sends 'Wrap OK' result to Gantry Upon completion of SENSE or WRAP, step RG3 finishes asynch protocol, comprising 2 steps:

Step RG16 enters a 200-mSec wait loop, awaiting Gantry response to Robot results just sent Specifically, Step RG17 awaits 'Gantry Operating' response before releasing Robot card upon Gantry response, step RG18 sends 'terminate protocol' response & returns to Mainline This essentially terminates the current asynch protocol, which committed the Robot card to execute a specific Gantry command, and returns the Robot Operate program to its normal state of sampling for the next operator command via the Remote Control in the Mainline loop FIG. 33 charts the major Sense Subroutine for the OperateRobot program, which is described in detail in the following listing:

Operate Robot: SENSE Subroutine [operation indicated by flashing Blue light]

The SENSE subroutine performs 4 major tasks to determine coil dimensions and coil distances:

It searches for absolute vertical height of the coil ID & coil OD to the nearest 1/32" accuracy It finds horizontal distance to North&South faces of coil to define coil width [via 5 samples]

At the same time, it samples/confirms the horizontal distance between the North/South arms For each distance, it determines the best consensus among the 5 sampled values [at 3 levels]to provide distances with highest level of confidence for platform X' travel and arm X travel Step SS1 inits all program parameters, such as Ymax, CoilID, CoilOD, and Coil Width, plus Sense switch, Sense Error, Sample counter, Delta tolerance for finding a consensus [e.g., .¼"]

SS1 also converts Y-axis distances to motor counts for vertical slide travel and reduces speed of vertical slides down to jog speed for more precise measurements Step SS2 initially tests whether the arms and slides are Home, and both lasers ON [ErrS1 out]

If so, step SS3 sets Sample=0, signals 'Sample 0' to the Gantry card, and calls Sample subrtn After taking the initial reference or '0th' sample, the Sample subrtn re-enters at return S0

Step SS4 then sends the slides up to Ymax height searching for a 'hit' on the coil ID every ½"

As the slides rise up, step SS5 repetitively queries if they have moved a ½" increment yet If so, SS5 then tests whether the front laser has gone OFF, indicating a hit on the coil ID If not, SS5 next tests if slides have reached Ymax yet, indicating there is no coil [ErrS2 out]

If the front laser is OFF, step SS6 sets the initial CoilID= current Y position of the slides SS6 then drops slides 1" and sends them back up 2" searching for a 'hit' on coil ID every 1/32"

As slides rise up 2", step SS7 repetitively queries if they have moved a 1/32" increment yet If so, SS7 then tests whether the front laser has gone ON, indicating a hit on the coil ID If not, SS7 next tests if the slides have reached 2" yet, indicating a laser error [ErrS3 out]

When the front laser goes ON, step SS8 sets the final CoilID=current Y position of the slides Step SS8 then sets Sample=1, signals 'Sample 1' to the Gantry card, and calls Sample subrtn After taking the 1st sample, the Sample subrtn re-enters SENSE at return S1

Next, to find the coil OD, above steps SS4 through SS8 are essentially repeated in this segment as steps SS9 through SS13, with laser polarity reversed, as follows:

Step SS9 sends the slides up to Ymax height searching for a 'hit' on the coil OD every ½"

As the slides rise up, step SS10 acts just as step SS5, except it looks for front laser to go ON If the slides reach Ymax without a hit on coil OD, then the coil is too big to wrap [ErrS4 out]

SS11 drops slides 1" and sends them back up 2" searching for a hit on coil OD every 1/32"

As slides rise up 2", step SS12 acts just as step SS7, except it looks for front laser to go OFF When the front laser goes OFF, step SS13 sets the final CoilOD=current Y position of slides As a cross-check, SS14/15 test if coil is too big [OD>72"] or too small [OD<36"][ErrS4/5 out]

Step SS16 then sends the slides to coil ID+17" [which can be up or down] for the next sample SS16 sets Sample=2, signals 'Sample 2' to the Gantry card, and calls the Sample subrtn After taking the 2nd sample, the Sample subrtn re-enters SENSE at return S2

Figure 34:
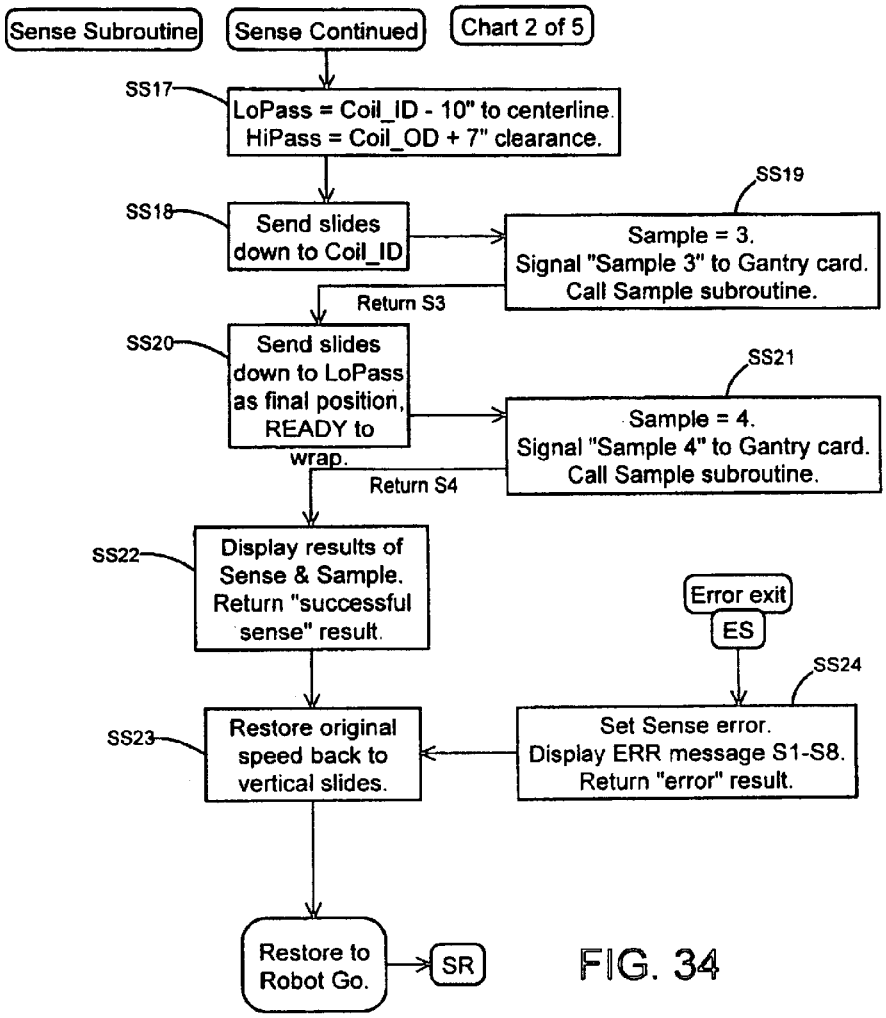

FIG. 34 charts the Sense Subroutine [continued] for the OperateRobot program, which is described in detail in the following listing:

SENSE Subroutine [continued]

Step SS17 calculates HiPass CoilOD+7" and LoPass= CoilID−10" from above parameters Step SS18 sends the slides back down to the Coil ID, just discovered above Step SS19 sets Sample=3, signals 'Sample 3' to the Gantry card, and calls the Sample subrtn After taking the 3rd sample, the Sample subrtn re-enters SENSE at return S3

Step SS20 sends the slides further down to LoPass, just calculated above, for the final sample, which puts the slides at the final Ready position, ready to begin the wrap Step SS21 sets Sample=4, signals 'Sample 4' to the Gantry card, and calls the Sample subrtn After taking the 4th sample, the Sample subrtn re-enters SENSE at return S4

Step SS22 displays coil parameters found by SENSE subrtn & distances calculated by Sample, including the best consensus among the 5 samples selected for each X distance SS22 then returns a successful 'Sense OK' result Step SS23 restores original speed back to vertical slides, and returns to Robot Go at re-entry SR Any error encountered in SENSE returns to err exit ES, where Step SS24 sets the Sense Error, displays the appropriate Error message S1–S8, returns a 'Sense Error' result, and exits via SS23

Figure 35:
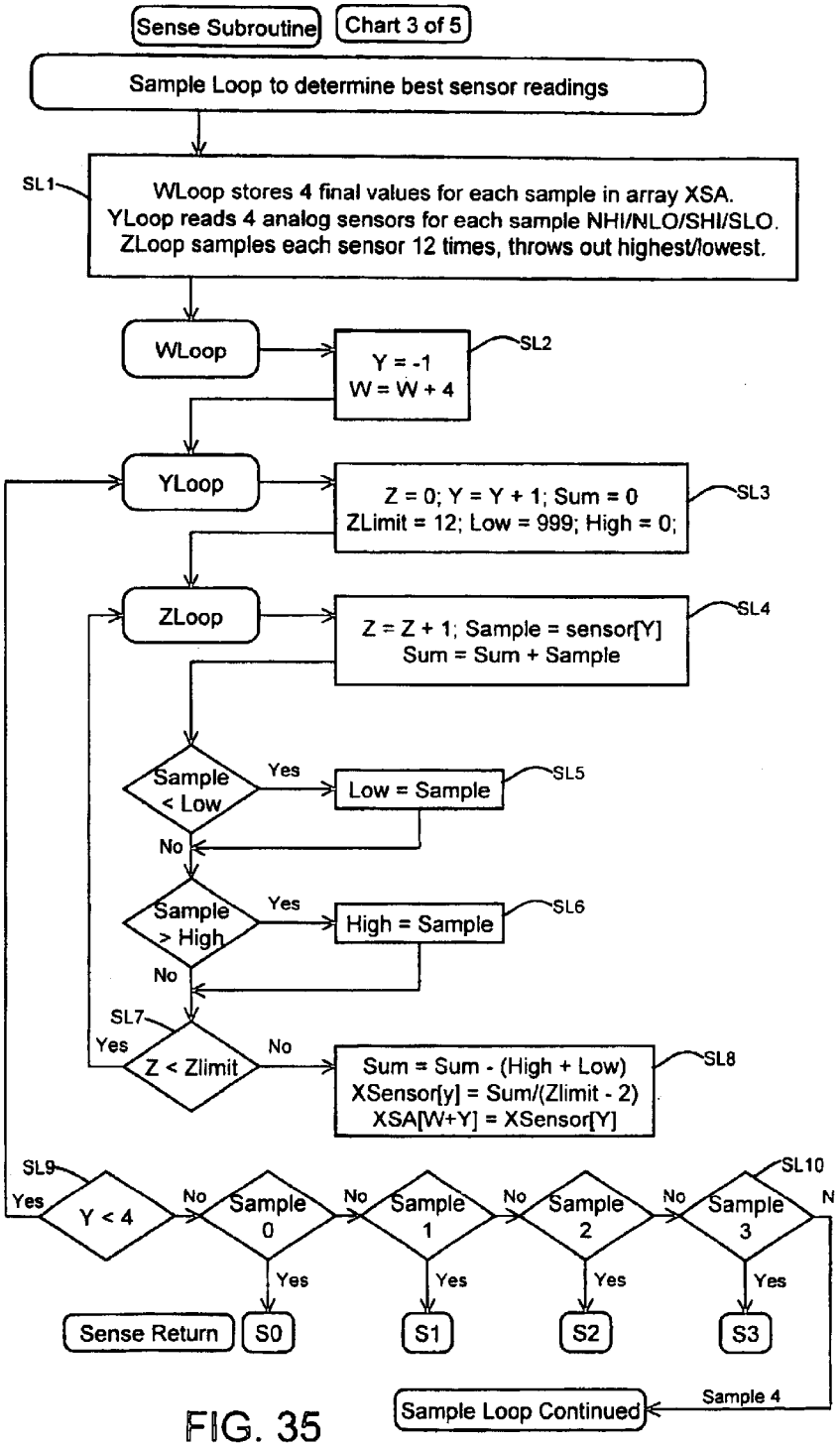

FIG. 35 charts the Sense Subroutine: Sample Loop for the OperateRobot program, which is described in detail in the following listing:

SENSE Subroutine: Sample Loop

The Sample Loop is called by SENSE to perform 4 major sampling functions:

It takes 12 successive readings [from each sensor], throws out the highest & lowest, finds the avg. of the middle 10, and stores resulting values in array XSA for later processing Upon the last sample [sample 4], it then loads 4 groups of 5 related samples into array WSA [1 group per desired distance], converts them from input mVolts to common motor counts by running conventional table lookups in the Sensor Baseline Arrays [see Sensor Overview]

Note that these North/South sensor samples are labeled with a letter plus a numeral [that is, H=high or L=low+ sample 0–4] such that HO first high sample & L4=last low sample For each of the 4 groups, Sample calls the Consensus subroutine to find the best consensus among its 5 samples, from which the best average 'Value' is returned for later calculation:

N.Coil Value=distance from North platform to the North face of the coil

S.Coil Value=distance from South platform to the South face of the coil

N.Arm Value=distance from North platform to South platform

S.Arm Value=distance from South platform to North platform [redundant cross-check]

From these 4 returned Values, Sample calculates the distance each arm must travel [i.e., to meet in the center of the coil without a collision], and the width of the coil Step SL1 summarizes the recycling function of each loop within Sample Loop:

The innermost ZLOOP samples each sensor 12 times, throws out hi/lo, and finds the avg.

For each sample, middle YLOOP steps ZLOOP thru the 4 analog sensors, Nhi/Nlo/Shi/Slo The outermost WLOOP stores the 4 final values for each sample 0 thru 4 in array XSA As the outermost control loop, WLOOP is recycled upon each successive call from SENSE WLOOP step SL2 increments its own loop counter W, and resets the next YLOOP counter Y prior to entering YLOOP YLOOP step SL3 increments its own loop counter Y, resets the next ZLOOP counter Z, and inits all ZLOOP variables including SUM, Zlimit, LOW, and HIGH, prior to entering ZLOOP ZLOOP step SL4 increments its own loop counter Z, takes another SAMPLE from sensor Y, and adds it to the cumulative total SUM for the current sensor ZLOOP step SL5 tests whether the current sample is below LOW—if so, it updates LOW ZLOOP step SL6 tests whether the current sample is above HIGH—if so, it updates HIGH ZLOOP step SL7 tests if loop counter Z has reached ZLIMIT, representing all 12 samples if not, it returns to recycle through ZLOOP at step SL4

If so, step SL8 subtracts out the high & low value from SUM, calculates the average of the remaining 10 samples, and stores them in array XSA [indexed by W+Y] for later processing YLOOP step SL9 tests if loop counter Y has reached 4, representing all 4 analog sensors if not, it returns to recycle through YLOOP at step SL3

If so, YLOOP step SL10 tests the variable 'Sample' to determine the proper return to SENSE at re-entry points S0/S1/S2/S3

Figure 36:
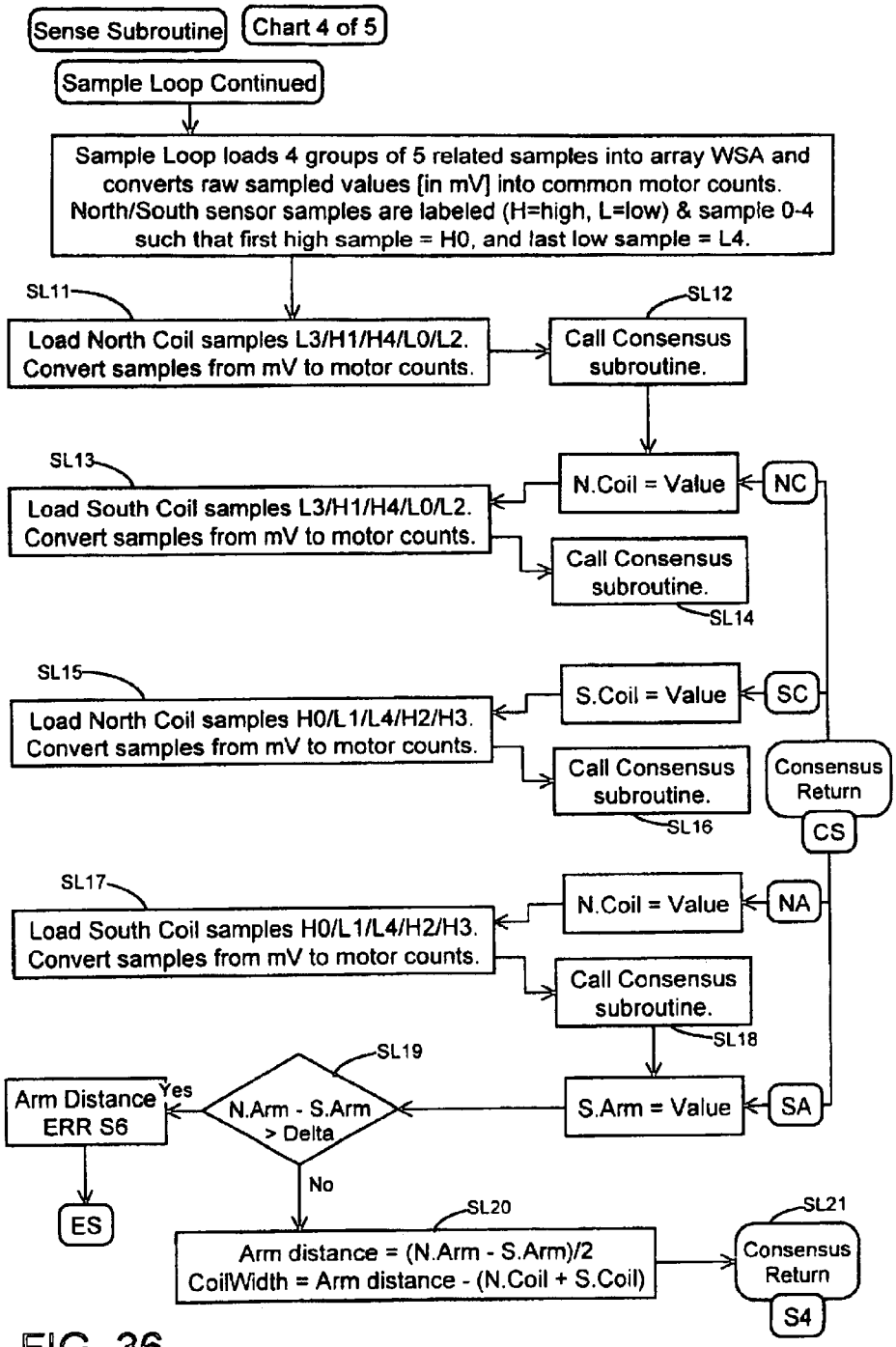

FIG. 36 charts the Sense Subroutine: Sample Loop [con't.] for the OperateRobot program, which is described in detail in the following listing:

Sample Loop [continued]

Upon taking the last or 4th sample, the Sample Loop loads up each of the 4 groups of 5 related samples into array WSA for subsequent processing by the Consensus subroutine Step SL11 loads the 5 related North Coil samples L3/H1/H4/L0/L2 into WSA[1], [2], . . . , [5]

It converts each of the samples from mVolts to motor counts by table lookup in SBA arrays Step SL12 calls the Consensus subroutine to find the best consensus among these 5 samples Consensus returns the best consensus it could find at return NC, which is stored in N.Coil Steps SL13/14 essentially repeat same process for South Coil samples, storing result in S.Coil Step SL15 loads the 5 related North Arm samples HO/L1/L4/H2/H3 into WSA[1], [2], . . . , [5]

It converts each of the samples from mVolts to motor counts by table lookup in SBA arrays Step SL16 calls the Consensus subroutine to find the best consensus among these 5 samples Consensus returns the best consensus it could find at return NA, which is stored in N.Arm Steps SL17/18 essentially repeat same process for South Arm samples, storing result in S.Arm Upon finding the best consensus value for all 4 groups, Consensus makes final calculations:

Step SL19 tests whether N.Arm and S.Arm values differ by more than given tolerance Delta If so, arms can't be brought together with acceptable certainty of not colliding [ErrS6 out]

Figure 37:
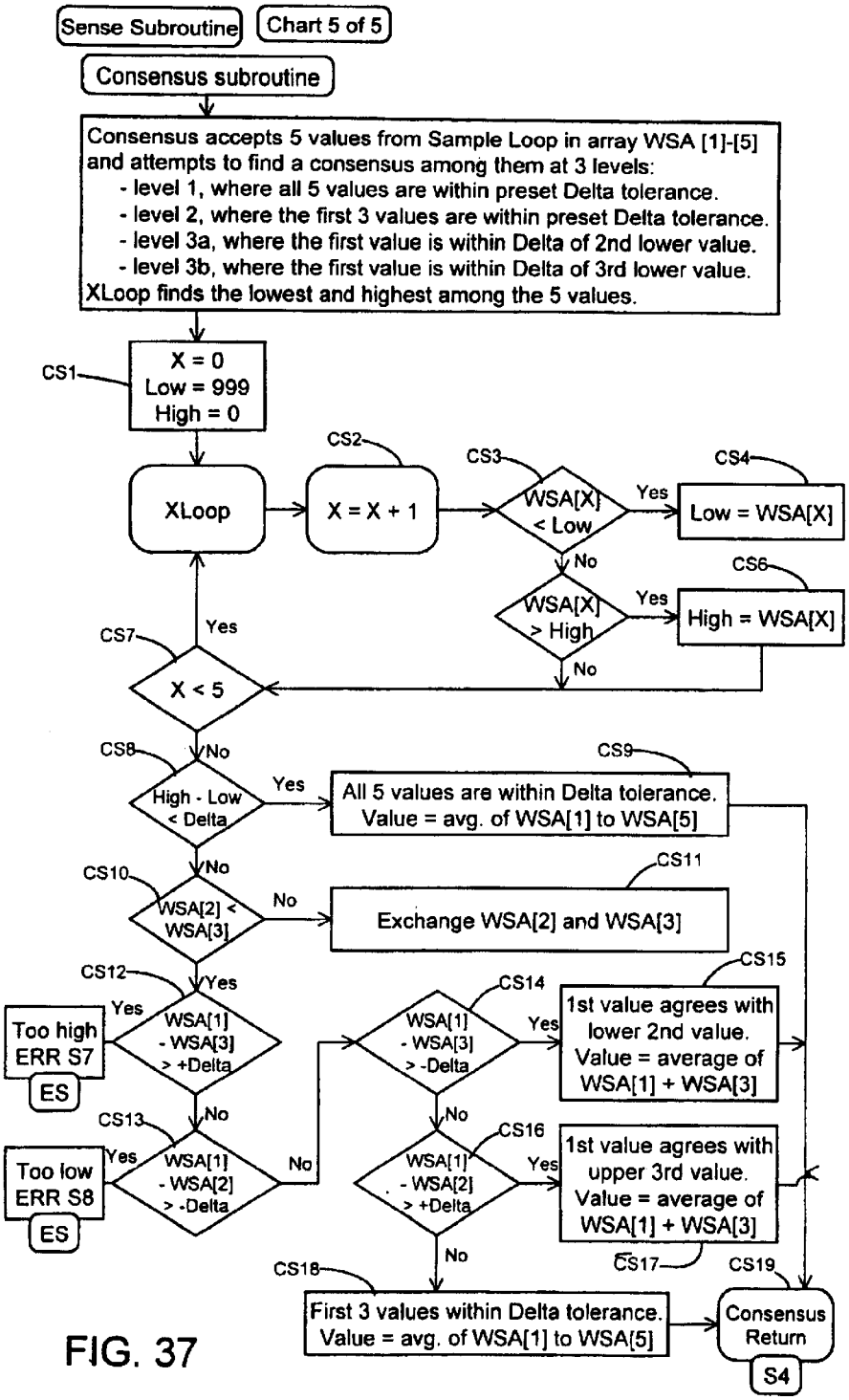

If not, step SL20 calculates a safe Arm travel distance from N.Arm/S.Arm values, representing a valid consensus of all 4 sensors, and then the Coil width from N.Coil and S.Coil values Step SL21 returns to re-entry point S4 in the calling SENSE routine FIG. 37 charts the Sense Subroutine: Consensus Subroutine for the OperateRobot program, which is described in detail in the following listing:

Sample Loop: Consensus Subroutine

The Consensus subroutine accept 5 values from the Sample Loop pre-loaded in Array WSA, and attempts to find the best consensus among each 5 samples at 3 levels of confidence:

Highest level 1: where all 5 values are within prescribed Delta tolerance

Middle level 2: where the first 3 values are within prescribed Delta tolerance Low level 3*a*: where the first value is within Delta tolerance of 2nd [next lower] value Low level 3*b*: where the first value is within Delta tolerance of 3rd [next higher] value If none of these tests are met, no 2 of the 4 sensors agree, returning a too high/too low error It then finds avg. of all values lying within Delta tolerance, & returns that avg. value to Sample Step CS1 resets XLOOP counters X, LOW, and HIGH prior to entering XLOOP which serves to find the high & low of all 5 values in array WSA[1], . . . , [5] via the following steps:

Step CS2 increments its own counter X

Step CS3 tests it current value WSA[X] is below LOW—if so, step CS4 updates LOW Step CS5 tests it current value WSA[X] is above HIGH—if so, step CS6 updates HIGH Step CS7 tests if loop counter X has reached 5, representing all 5 samples to be tested if not, it returns to recycle through XLOOP at step CS2

When XLOOP is done, step CS8 determines if all 5 values are within Delta tolerance, representing best possible outcome where Hi/Lo sensors completely agree [confidence level 1]

If so, step CS9 sets VALUE the average of all 5 values in WSA, and returns to Sample If not, step CS10 tests if 2nd value is below 3rd value—if not, CS11 exchanges them Step CS12 tests if 1st value is more than a Delta higher than 3rd—if so, Too High ErrS7 out Step CS13 tests if 1st value is more than a Delta lower than 2nd—if so, Too Low ErrS8 out Step CS14 determines if 1st value is less than a Delta lower than 3rd value If so, the 1st value agrees with the lower 2nd value [confidence level 3*a*]

step CS15 sets VALUE=the average of the first two values in WSA, and returns to Sample Similarly, step CS16 determines if 1st value is more than a Delta higher than 2nd value If so, the 1st value agrees with the higher 3rd value [confidence level 3*b*]

step CS17 sets VALUE=the average of the 1st&3rd values in WSA, and returns to Sample If neither test is met, then by deduction the first 3 values are within Delta tolerance, representing next best outcome where 3 proximate Hi/Lo samples agree [confidence level 2]

step CS18 sets VALUE=the average of the first 3 values in WSA, and returns to Sample Step CS19 shows the above 4 returns to Sample Loop via re-entry point CS which represents, in turn, subrtn returns at the appropriate re-entry points NC/SC/NA/SA from which Consensus was called [see preceding Sample flowchart]

Figure 31:
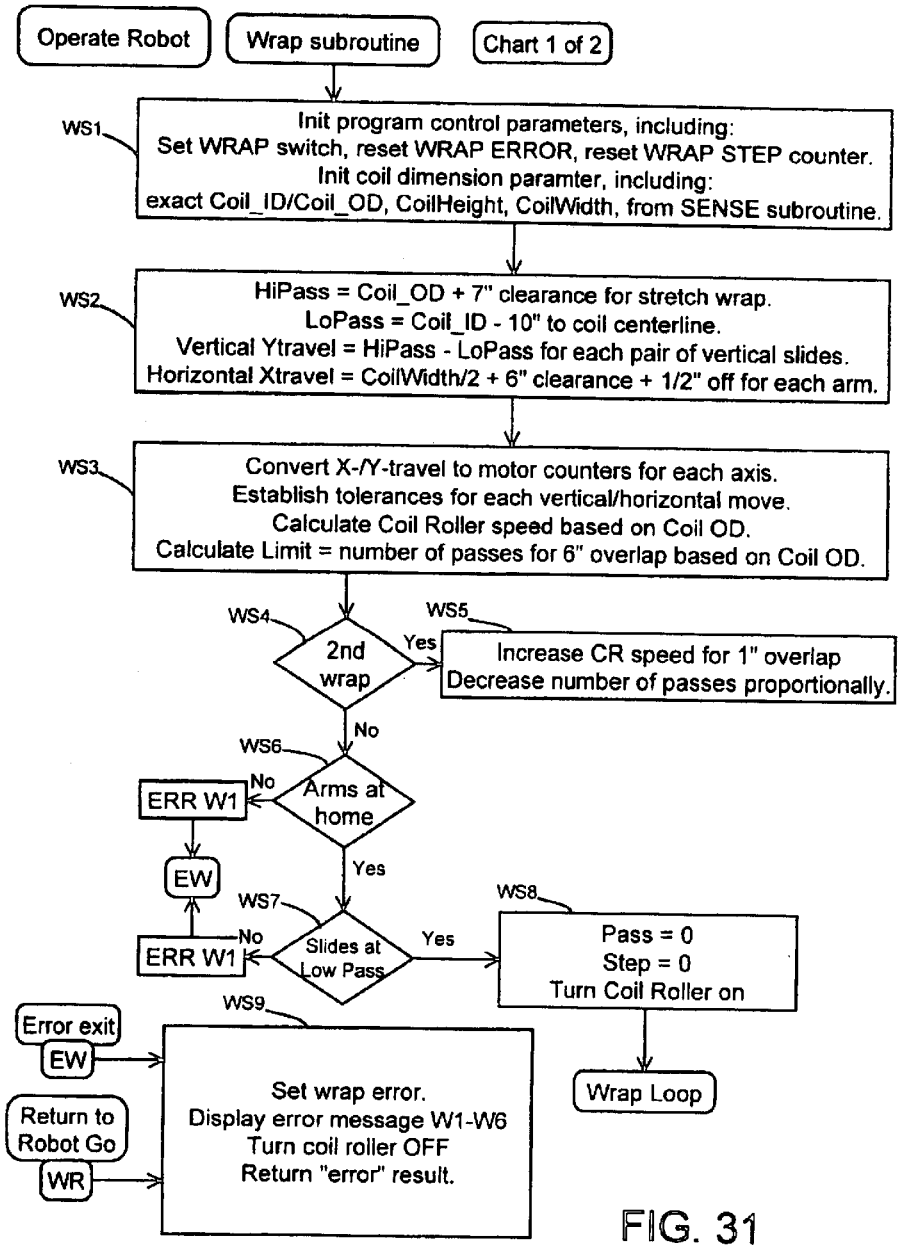

FIG. 31 charts the major Wrap Subroutine for the OperateRobot program, which is described in detail in the following listing:

Operate Robot: WRAP Subroutine [operation indicated by steady Green light]

The WRAP subroutine performs 4 major tasks necessary to wrap the coil, pass-by-pass:

It calculates arm/slide travel distances from coil parameters sensed by SENSE subrtn It also calculates Coil Roller speed and number of passes required from same parameters It then methodically executes successive 6-movement wrap passes to wrap entire coil Prior to each move, it confirms that current arm/slide positions are within wrap tolerances Step WS1 inits all program control parameters, such as Wrap switch, Wrap Error, Step counter WS1 also inits coil dimension parameters, such as Coil ID/OD/Width from SENSE subrtn [note that height from bottom of coil is factored in to find Coil ID/OD absolute height]

Step WS2 finds the vertical height required for the arms to cross the coil, high and low:

HiPass=CoilOD+7" to allow sufficient clearance for stretch wrap to clear top of coil LoPass=CoilID−10" to center the arms at the centerline of the coil's 20" ID [note that LoPass is dropped an additional 2" for any coil with a 24" ID]

Vertical Y-axis travel=HiPass−LoPass, for both North and South vertical slides

Horizontal X-axis travel=Coil Width/2+6" clearance+½" handle offset, for each arm Step WS3 converts X/Y travel into motor counts for each corresponding arm/slide axis, and establishes allowable tolerances for each horizontal/vertical move [checked prior to each move]

Based on Coil OD, WS3 also calculates the specific Coil Roller rotation speed required and calculates Limit= number of passes to yield a 6" overlap in successive passes, in accordance with equations WS30 through WS39 [delineated at the end of this listing]

Step WS4 tests whether this is the 1st or 2nd wrap of current coil

If 2nd, WS5 increases CR speed to yield a 1" overlap & decreases no. of passes proportionately Following are preliminary tests to confirm all actuators are at Ready prior to launching wrap:

Step WS6 tests whether both arms are Home—i.e., within allowed tolerances [ErrW1 out]

Step WS7 similarly tests if both sets of slides are at LoPass, within tolerances [ErrW2 out]

Step WS8 resets loop variables Pass=0 and Step=0, and turns Coil Roller ON to begin wrap If there is a wrap error, all errors lead to error exit EW where step WS9 sets Wrap Error WS9 then turns Off the Coil Roller, displays Error mssg W1–W6, and returns 'Wrap error' result by returning [with Wrap Error set] to re-entry WR in Robot Go calling routine WS3 [continued] the following are step-wise linear equations that calculate coil roller rotational speed as a function of coil height [OD] and coil width:

WS30 ODspeed=1.9+(0.026*coilOD−36) for 36<coilOD<46

WS31 ODspeed=1.16+(0.009*coilOD−46) for 46<coilOD<56

WS32 ODspeed=1.25+(0.006*coilOD−56) for 56<coilOD<66

WS33 ODspeed=1.31+(0.003*coilOD−66) for 66<coilOD<72

WS34 Speed=ODspeed−0.01−(0.034*(width−16)) for 16>width>8

WS35 Speed=ODspeed−0.34−(0.010*(width−26)) for 26>width>16

WS36 Speed=ODspeed−0.44−(0.007*(width−36)) for 72>width>26

WS37 ODratio=5.2+(0.05*coilOD−36)) for 36<coilOD<56

WS38 ODratio=6.2+(0.01*coilOD−36)) for 56<coilOD<72

WS39 Limit (Circumference−ODratio)+2 for 36<coilOD<72

Figure 32:
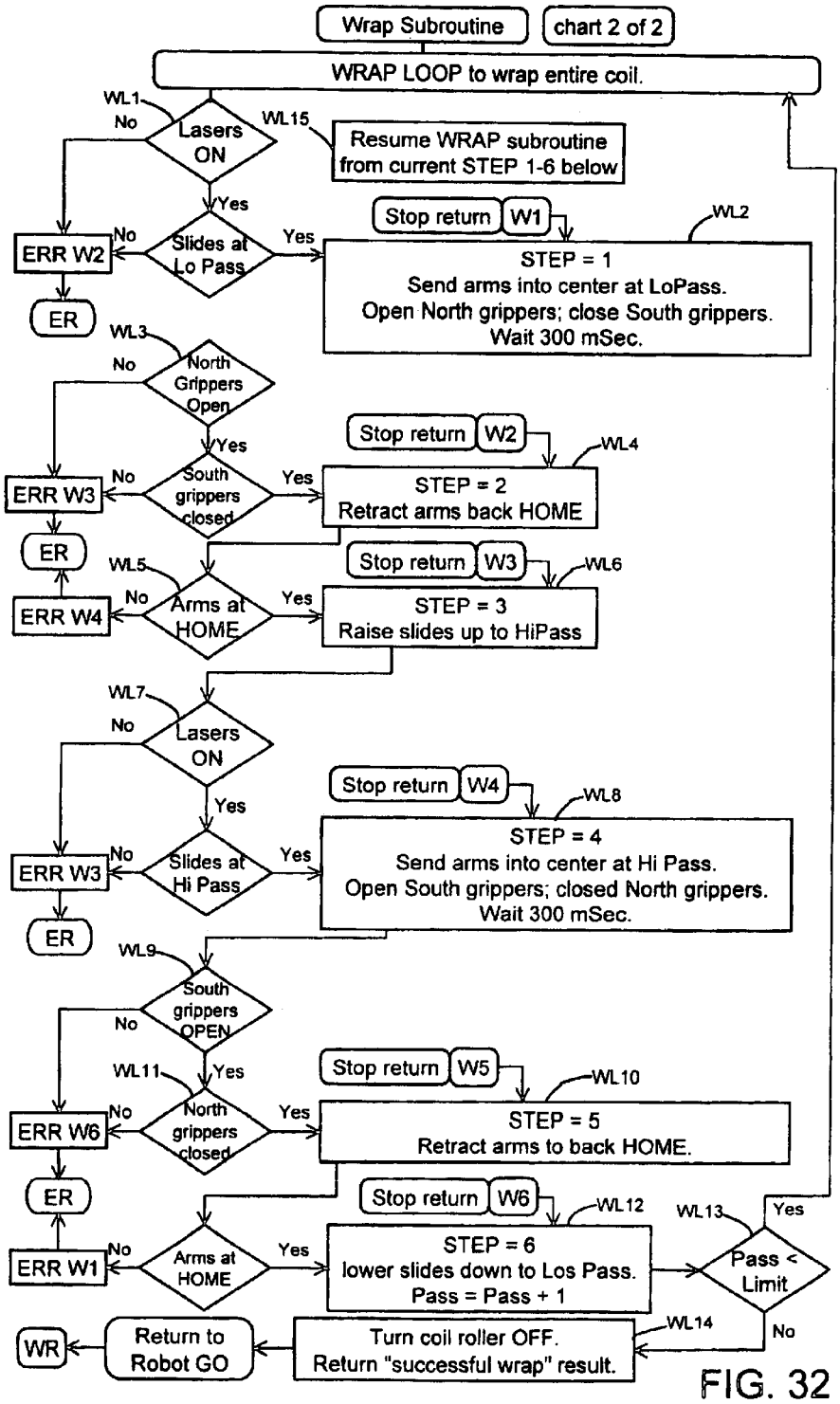

FIG. 32 charts the Wrap Subroutine: Wrap Loop for the OperateRobot program, which is described in detail in the following listing [this is the final flowchart]:

WRAP Subroutine: Wrap Loon [operation indicated by flashing Green light]

The Wrap Loop comprises 6 sequential movements, identified in the program as Step=1, . . . , 6 which permits the stubrtn to be re-entered at the motion in progress [i.e., from an operator Stop]

Taken together, these 6 movements comprise a wrap pass, producing an offset of from 1" to 6" in successive passes, depending on the speed of CR rotation The Wrap Loop is executed reiteratively until it reaches the required no. of passes [i.e., Limit] to completely wrap the entire coil, plus one more pass to seal the original pass Step WL1 tests whether the lasers are ON and the slides are at LoPass, as above [ErrW2 out]

If so, step WL2 increments Step to 1, and sends the arms into the center of the coil at LoPass At the end of arm move at coil center, WL2 opens North grippers and closes South grippers, then waits 300 mSec to allow grippers to fully open/close before launching next move Step WL3 confirms that the North grippers are open and the South grippers closed [ErrW3 out]

If so, step WL4 increments Step to 2, and retracts the arms back Home

Step WL5 tests whether the arms are back Home, which allows the slides to go up [ErrW4 out]

If so, step WL6 increments Step to 3, and raises the North/South vertical slides to HiPass Step WL7 tests whether the lasers are ON and the slides are at HiPass, as at WL1 [ErrW2 out]

If so, step WL8 increments Step to 4, and sends the arms into the center of the coil at HiPass At the end of arm move at coil center, WL8 opens North grippers and closes South grippers, then waits 300 mSec to allow grippers to fully open/close before launching next move Step WL9 confirms that the North grippers are open and the South grippers closed [ErrW3 out]

If so, step WL10 increments Step to 5, and retracts the arms back Home

Step WL11 tests whether the arms are back Home, which allows slides to go down [ErrW4 out]

If so, step WL12 increments Step to 6, and lowers the North/South vertical slides to LoPass WL12 also increments the Wrap loop counter, Pass Finally, step WL13 tests whether the current no. of passes in Pass is still below current Limit If so, the program goes back to cycle through the Wrap Loop one more time If not, step WL14 turns Off the current Coil Roller, which finishes up a successful wrap, and then returns a 'Wrap OK' result by returning to re-entry WR in Robot Go without an error Otherwise, if there was an error, prior step WS9 closes out with 'wrap error' result [see above]

As a special exception, the Wrap Loop can be re-entered at step WL15 via entry point RW [from the Stop routine] at any one of the 6 movements, marked by associated Step=1 to 6 i.e., WL15 resumes wrap at Stop Return W1, W2, . . . , W6 as indexed by Step=1, 2, . . . , 6

While the invention has been described in connection with what are presently considered to be the most practical embodiments, it is to be understood that the invention is not to be limited to the disclosed embodiments, but on the contrary, is intended to cover various modifications and equivalent arrangements included within the spirit and scope of the appended claims.

We claim:

1. A method for wrapping a substantially annular object with wrapping material dispensed as a sheet from a roll, using a rotating device and at least one movable robotic arm under control of a processor, comprising:

generating signals indicative of the size of said annular object;

adapting said robotic arm in response to said signals;

adapting said rotating device in response to said signals;

rotating said annular object about its rotational axis via said rotating device;

grasping said roll of wrapping material with a gripper having two opposing surfaces, mounted on said at least one robotic arm;

carrying said roll of wrapping material, via said robotic arm, around at least one surface of said annular object as it is rotated by said rotating device, said at least one surface including the inside surface of the object's cylindrical hole; and dispensing said material under tension as it is carried around said annular object by said robotic arm, such that the dispensed sheet of material is wrapped substantially taut across each said surface wrapped;

said grasping including securely holding said wrapping material between said opposing surfaces so as to enable said at least one robotic arm to carry the material around said at least one surface of said annular object.

2. A method for wrapping a substantially annular object with wrapping material as in claim 1, further including:

sending command signals to said processor via a remote control, including a plurality of buttons, wherein each of said steps of generating, adapting, rotating, carrying, and dispensing is initiated by pressing at least one of said buttons.

3. A method for wrapping a substantially annular object with wrapping material as in claim 1, wherein:

carrying said wrapping material, via said robotic arm, around said at least one surface of said annular object, includes at least the inner surface of its cylindrical center hole.

4. A method for wrapping a plurality of substantially annular objects with wrapping material as in claim 1, at a plurality of wrapping stations, each station having its own rotating device to rotate one of said plurality of objects, wherein said at least one robotic arm includes a pair of robotic arms, further comprising:

rotating a first annular object at a first wrapping station via a first rotating device;

carrying said wrapping material around said first annular object via said pair of robotic arms;

moving said pair of robotic arms between said first wrapping station and a second wrapping station via a pair of movable platforms, each supporting one of said pair of robotic arms;

rotating a second annular object at said second wrapping station via a second rotating device; and carrying said wrapping material around said second annular object via said pair of robotic arms.

5. A method for wrapping a substantially annular object with wrapping material dispensed as a sheet from a roll, using a rotating device and at least one robotic arm under control of a processor, comprising:

rotating said annular object about its rotational axis;

grasping said roll of wrapping material with at least one gripper having two opposing surfaces, mounted on said at least one robotic arm; and carrying said roll of wrapping material, via said robotic arm, around at least one surface of said annular object as it rotates, including at least the inner surface of its cylindrical center hole;

said grasping including securely holding said wrapping material between said opposing surfaces so as to enable said at least one robotic arm to carry the material around said at least one surface of said annular object.

6. A method for wrapping an annular object as in claim 5, wherein said at least one robotic arm includes a first and second robotic arm, and said at least one gripper includes a first and second pair of grippers, further comprising:

grasping said material with said first pair of grippers mounted on said first arm;

carrying said material around said object to said second arm;

exchanging said material with said second pair of grippers mounted on said second arm; and carrying said material around said object back to said first arm.

7. A method for wrapping an annular object as in claim 6 wherein each robotic arm includes at least one slide, said carrying step further comprising:

raising and lowering each of said robotic arms, via said at least one slide, from the cylindrical center hole to the outside surface of said annular object;

such that said at least one surface of said annular object includes its outer surface and the inner surface of its cylindrical center hole.

8. A method for wrapping an annular object as in claim 5, wherein said at least one robotic arm includes a pair of robotic arms, and said at least one gripper includes two pairs of grippers, further comprising:

grasping said material with a first of said pairs of grippers mounted on a first of said arms;

releasing said material from the second of said pairs of grippers mounted on the second of said arms;

carrying said material around said object via said first arm to the second of said arms; grasping said material with said second pair of grippers mounted on said second arm; releasing said material from said first pair of grippers mounted on the first of said arms;

carrying said material around said object back to said first arm, such that said at least one surface of said annular object includes the inner surface of its cylindrical center hole.

9. A method for wrapping an annular object as in claim 5, further comprising:

generating signals indicative of the size of said annular object via at least one sensing device; and adapting said robotic arm via a processor, in response to signals received from said sensing device.

10. A method for wrapping an annular object as in claim 9, further comprising:

sensing the height of said object and its cylindrical rotational axis, and the distance between said object and said robotic arm; and adapting the movement of said robotic arm to wrap said object in accordance with the sensed height and rotational axis of said object, and the sensed distance to said object.

11. A method for wrapping an annular object as in claim 5, wherein:

adapting said rotating device, via a processor, in response to signals received from said at least one sensing device.

12. A method for wrapping an annular object as in claim 11, wherein:

sensing the height of said object and its cylindrical rotational axis, and the distance between said object and said robotic device;

adapting said robotic device to wrap said object in accordance with the sensed height and rotational axis of said object, and the sensed distance to said object; and adapting said rotating device to wrap said object in accordance with the sensed height and rotational axis of said object, and the width of said object based upon the sensed distance of said robotic device to said object.

13. A method for wrapping a substantially annular object with wrapping material as in claim 5, wherein said carrying step comprises a plurality of tasks, further comprising:

instructing said robotic arm, via a processor, to perform each task of said plurality of carrying tasks; and sending command signals to said processor via a remote control, including a plurality of buttons, wherein each carrying task is initiated by pressing at least one of said buttons.

14. A method for wrapping an annular object as in claim 13, further comprising:

instructing said rotating device to rotate, via said processor, in response to at least one signal received from said remote control; and instructing said at least one gripper to operate, via said processor, in response to at least one signal received from said remote control.

15. A method for wrapping a substantially annular object with wrapping material in claim 5, further comprising:

dispensing the material under tension as said material is carried around said annular object, via at least one variable-tensioning device inserted in said roll of wrapping material.

16. A method for wrapping an annular object as in claim 15, wherein said dispensing step further comprises:

maintaining the braking tension on the wrapping material as it is dispensed during said carrying task, via a non-rotating circular brake in said variable-tensioning device.

17. A method for wrapping an annular object as in claim 15, wherein said at least one robotic arm includes a first and second robotic arm, said at least one gripper includes two pairs of grippers, and said at least one variable-tensioning device includes a pair of variable-tension handles for dispensing said wrapping material, further comprising:

grasping said handles with a first pair of grippers mounted on said first arm;

releasing the handles from a second pair of grippers mounted on said second arm carrying said material around said object, via the first arm, to the second arm;

grasping the handles with the second pair of grippers mounted on the second arm releasing the handles from the first pair of grippers mounted on the first arm; and carrying said material around said object, via the second arm, back to the first arm;

such that said at least one surface of said annular object includes its outside surface and the inside surface of its cylindrical center hole.

18. A method for wrapping an annular object as in claim 17, further comprising:

repeating the cycle of grasping, releasing, and carrying steps as said object rotates, such that all inside and outside surfaces of said object are covered with wrapping material.

19. A method for wrapping a plurality of substantially annular objects with wrapping material as in claim 5, at a plurality of wrapping stations, each station having its own rotating device to rotate one of said plurality of objects, further comprising:

rotating a first annular object at a fist wrapping station via a first rotating device;

carrying said wrapping material around said first annular object via said at least one robotic arm, including a pair of robotic arms;

moving said pair of robotic arms between said first wrapping station and a second wrapping station via a pair of movable platforms, each supporting one of said pair of robotic arms;

rotating a second annular object at said second wrapping station via a second rotating device; and carrying said wrapping material around said second annular object via said pair of robotic arms.

20. A method for wrapping a plurality of substantially annular objects with wrapping material on a plurality of rotating devices as in claim 19, further comprising:

moving said robotic arms to and from said first or said second annular object via a second pair of movable platforms, each also supporting one of said robotic arms.

21. A method for wrapping a plurality of substantially annular objects with wrapping material on a plurality of rotating devices as in claim 20, said plurality of stations including a third wrapping station with its own rotating device, further comprising:

moving said robotic arms between said second and said third stations via said first moving platforms; and moving said robotic arms to and from said third annular object at said third station via said second movable platform.

22. A method for wrapping a substantially annular object with wrapping material dispensed as a sheet from a roll, using a rotating device and at least one robotic device having at least one gripper, under control of a processor, comprising:

generating signals indicative of the size of said annular object via at least one sensing device;

adapting said robotic device, via said processor, to the size of said annular object in response to signals received from said at least one sensing device; and carrying said wrapping material in the grasp of said gripper, via said robotic device, around at least one surface of said annular object as it rotates, including at least the inner surface of its cylindrical center hole.

23. A method for wrapping an annular object as in claim 22, further comprising:

sensing the height of said object and its cylindrical rotational axis, and the distance between said object and said at least one robotic device; and adapting said at least one robotic device to wrap said object in accordance with the sensed height and rotational axis of said object, and the sensed distance to said object.

24. A method for wrapping an annular object as in claim 22, wherein said at least one sensing device includes a plurality of sensing devices, further comprising:

sensing the height of said object and its cylindrical rotational axis via a first sensing device;

sensing the distance between said object and said at least one adaptive robotic device via a second sensing device; and adapting said robotic device, via said processor, to wrap said object in accordance with the height and the rotational axis of said object, and the distance to said object.

25. A method for wrapping an annular object as in claim 22, further comprising:

adapting said rotating device, via said processor, in response to signals received from said at least one sensing device; and rotating said annular object about its rotational axis via said adapted rotating device.

26. A method for wrapping an annular object as in claim 25, further comprising:

sensing the height of said object and its cylindrical rotational axis, and the distance between said object and said robotic device;

adapting said robotic device to wrap said object in accordance with the sensed height and rotational axis of said object, and the sensed distance to said object; and adapting said rotating device to rotate said object in accordance with the sensed height and rotational axis of said object, and the width of said object based upon the sensed distance of said robotic device to said object.

27. A method for wrapping an annular object as in claim 26, further comprising:

adapting said rotating device by adjusting its speed such that a portion of said wrapping material is overlapped on the outer surface of said object as it is wrapped.

28. A method for wrapping an annular object as in claim 25, wherein said at least one sensing device includes a plurality of sensing devices, further comprising:

sensing the height of said object and its cylindrical rotational axis via a first sensing device;

sensing the distance between said object and said adaptive robotic device via a second sensing device; and adapting said robotic device, via said processor, to wrap said object in accordance with the sensed height and rotational axis of said object, and the sensed distance to said object.

29. A method for wrapping a substantially annular object with wrapping material as in claim 22, wherein said carrying step comprises a plurality of tasks, further comprising:

instructing said robotic device, via a processor, to perform each task of said plurality of carrying tasks; and sending signals to said processor via a remote control, including a plurality of buttons, wherein each of said carrying tasks is initiated by pressing at least one of said buttons.

30. A method for wrapping an annular object as in claim 29, further comprising:

rotating said annular object about its rotational axis via said rotating device;

controlling rotation of said rotating device, via said processor, in response to at least one of said signal received from said remote control.

31. A method for wrapping a substantially annular object with wrapping material as in claim 22, further comprising:

dispensing the material under tension as said material is wrapped around said annular object, via at least one variable-tensioning device inserted in said roll of wrapping material.

32. A method for wrapping an annular object as in claim 31, wherein said dispensing step further comprises:

maintaining the braking tension on the wrapping material as it is dispensed during said carrying task, via a non-rotating circular brake in said variable-tensioning device.

33. A method for wrapping an annular object as in claim 31, wherein said at least one robotic device includes a first and second robotic arm, each arm including a pair of grippers, and said at least one variable-tensioning device includes a pair of variable-tension handles for dispensing said wrapping material, further comprising:

grasping said handles with a first pair of grippers mounted on said first arm; releasing the handles from a second pair of grippers mounted on said second arm; carrying said material around said object, via the first arm, to the second arm; grasping the handles with the second pair of grippers mounted on the second arm; releasing the handles from the first pair of grippers mounted on the first arm; and carrying said material around said object, via the second arm, back to the first arm;

such that said at least one surface of said annular object includes its outside surface and the inside surface of its cylindrical center hole.

34. A method for wrapping an annular object as in claim 33, further comprising:

repeating the cycle of grasping, releasing, and carrying steps as said object rotates, such that all inside and outside surfaces of said object are covered with wrapping material.

35. A method for wrapping a plurality of substantially annular objects with wrapping material as in claim 22, at a plurality of wrapping stations, each station having its own rotating device to rotate one of said plurality of objects, further comprising:

rotating a first annular object at a first wrapping station via a first rotating device;

carrying said wrapping material around said first annular object via said at least one robotic device, including a pair of robotic arms;

moving said pair of robotic arms between said first wrapping station and a second wrapping station via a pair of movable platforms, each supporting one of said pair of robotic arms;

rotating a second annular object at said second wrapping station via a second rotating device; and carrying said wrapping material around said second annular object via said pair of robotic arms.

36. A method for wrapping a plurality of substantially annular objects with wrapping material on a plurality of rotating devices as in claim 35, further comprising:

moving said robotic arms to and from said first or said second annular object via a second pair of movable platforms, each also supporting one of said robotic arms.

37. A method for wrapping a plurality of substantially annular objects with wrapping material on a plurality of rotating devices as in claim 36, said plurality of stations including a third wrapping station with its own rotating device, further comprising:

moving said robotic arms between said second and said third stations via said first moving platforms; and moving said robotic arms to and from said third annular object at said third station via said second movable platforms.

38. A method for wrapping an annular object as in claim 22, wherein said processor includes a plurality of control cards, further comprising:

controlling the motion of, and receiving feedback from, all electronic system components including said rotating device, said at least one robotic device, and said sensing devices, via a first card and a second card, each with its own digital and analog inputs/outputs.

39. A method for wrapping an annular object as in claim 38, further comprising:

analyzing the feedback from said digital and analog inputs, and issuing said digital and analog outputs to control the sequence of steps required for each major task, including moving to calculated positions, sensing dimensions of the object, rotating the rotating device, and wrapping the object, via computer programs running continuously within said first and second cards.

40. A method for wrapping an annular object as in claim 39, wherein said computer programs control execution of said major tasks, further comprising:

transferring asynchronous control signals between said first and second cards so as to effect a master/slave relationship between them, respectively, via two pairs of asynchronous communication lines, one pair dedicated to each signal direction; and responsive to said asynchronous control signals, permitting the cards to synchronize events, via said communication lines, by observing asynchronous protocol within the computer programs wherein:

upon operator request, said first master card decides which major tasks will be performed at what time, and sends unique commands to said slave card; and upon receipt of a master command, said second slave card acknowledges each unique command, performs the requested task, and reports back the results of that task.

41. A method for wrapping a substantially annular object with wrapping material dispensed as a sheet from a roll, using a rotating device and at least one robotic device having at least one gripper, under control of a processor, comprising:

generating signals indicative of the size of said annular object via at least one sensing device;

adapting said rotating device, via said processor, in response to signals received from said at least one sensing device; and carrying said wrapping material in the grasp of said gripper, via said robotic device, around at least one surface of said annular object as it rotates, including at least the inner surface of its cylindrical center hole.

42. A method for wrapping an annular object as in claim 41, further comprising:

sensing the height of said object and its cylindrical rotational axis, and the distance between said object and said at least one robotic device; and adapting said rotating device to rotate said object in accordance with the sensed height and rotational axis of said object, and the width of said object based upon the sensed distance of said at least one robotic device to said object.

43. A method for wrapping an annular object as in claim 42, wherein:

Adapting said rotating device by adjusting its speed such that a portion of said wrapping material is overlapped on the outer surface of said object as it is being wrapped.

44. A method for wrapping an annular object as in claim 41, wherein said at least one sensing device includes a plurality of sensing devices, further comprising:

sensing the height of said object and its cylindrical rotational axis via a first sensing device;

sensing the distance between said object and said adaptive robotic device via a second sensing device; and adapting said rotating device, via said processor, to rotate said object in accordance with the sensed height and rotational axis of said object, and the width of said object based upon the sensed distance of said at least one robotic device to said object.

45. A method for wrapping a substantially annular object with wrapping material as in claim 41, wherein said carrying step comprises a plurality of tasks, further comprising:

instructing said robotic device, via a processor, to perform each task of said plurality of carrying tasks; and sending signals to said processor via a remote control, including a plurality of buttons, wherein each of said carrying tasks is initiated by pressing at least one of said buttons.

46. A method for wrapping an annular object as in claim 45, further comprising:

controlling rotation of said rotating device via said processor in accordance with the carrying tasks of said arm, in response to signals received from said remote control.

47. A method for wrapping a substantially annular object with wrapping material as in claim 41, further comprising:

dispensing the material under tension as said material is carried around said annular object, via at least one variable-tensioning device inserted in said roll of wrapping material.

48. A method for wrapping an annular object as in claim 47, wherein said dispensing step further comprises:

maintaining the braking tension on the wrapping material as it is dispensed during said carrying task, via a non-rotating circular brake in said variable-tensioning device.

49. A method for wrapping an annular object as in claim 47, wherein said at least one robotic device includes a first and second robotic arm, each arm including a pair of grippers, and said at least one variable-tensioning device includes a pair of variable-tension handles for dispensing said wrapping material, further comprising:

grasping said handles with a first pair of grippers mounted on said first arm;

releasing the handles from a second pair of grippers mounted on said second arm carrying said material around said object, via the first arm, to the second arm; grasping the handles with the second pair of grippers mounted on the second arm; releasing the handles from the first pair of grippers mounted on the first arm; and carrying said material around said object, via the second arm, back to the first arm;

such that said at least one surface of said annular object includes its outside surface and the inside surface of its cylindrical center hole.

50. A method for wrapping an annular object as in claim 49, further comprising:

repeating the cycle of grasping, releasing, and carrying steps as said object rotates, such that all inside and outside surfaces of said object are covered with wrapping material.

51. A method for wrapping a plurality of substantially annular objects with wrapping material as in claim 41, at a plurality of wrapping stations, each station having its own rotating device to rotate one of said plurality of objects, further comprising:

rotating a first annular object at a first wrapping station via a first rotating device;

carrying said wrapping material around said first annular object via said at least one robotic device, including a pair of robotic arms;

moving said pair of robotic arms between said first wrapping station and a second wrapping station via a pair of movable platforms, each supporting one of said pair of robotic arms;

rotating a second annular object at said second wrapping station via a second rotating device; and carrying said wrapping material around said second annular object via said pair of robotic arms.

52. A method for wrapping a plurality of substantially annular objects with wrapping material on a plurality of rotating devices as in claim 51, further comprising:

moving said robotic arms to and from said first or said second annular object via a second pair of movable platforms, each also supporting one of said robotic arms.

53. A method for wrapping a plurality of substantially annular objects with wrapping material on a plurality of rotating devices as in claim 52, said plurality of stations including a third wrapping station with its own rotating device, further comprising:

moving said robotic arms between said second and said third stations via said first moving platforms; and moving said robotic arms to and from said third annular object at said third station via said second movable platforms.

54. A method for wrapping an annular object as in claim 54, wherein said processor includes a plurality of control cards, further comprising:

controlling the motion of, and receiving feedback from, all electronic system components including said rotating device, said at least one robotic device, and said sensing devices, via a first card and a second card, each with its own digital and analog inputs/outputs.

55. A method for wrapping an annular object as in claim 54, further comprising:

analyzing the feedback from said digital and analog inputs, and issuing said digital and analog outputs to control the sequence of steps required for each major task, including moving to calculated positions, sensing dimensions of the object, rotating the rotating device, and wrapping the object, via computer programs running continuously within said first and second cards.

56. A method for wrapping an annular object as in claim 55 wherein said computer programs control execution of said major tasks, further comprising:

transferring asynchronous control signals between said first and second cards so as to effect a master/slave relationship between them, respectively, via two pairs of asynchronous communication lines, one pair dedicated to each signal direction; and responsive to said asynchronous control signals, permitting the cards to synchronize events, via said communication lines, by observing asynchronous protocol within the computer programs wherein:

upon operator request, said first master card decides which major tasks will be performed at what time, and sends unique commands to said slave card; and upon receipt of a master command, said second slave card acknowledges each unique command, performs the requested task, and reports back the results of that task.

57. A method for wrapping a substantially annular object with wrapping material dispensed as a sheet from a roll, using a rotating device and at least one adaptive robotic device having at least one tripper, under control of a processor, comprising:

wrapping said annular object with said wrapping material in the grasp of said gripper via said at least one robotic device, wherein said wrapping step comprises a plurality of wrapping tasks, including the task of wrapping at least one surface of said annular object;

sending signals to said processor via a remote control, including a plurality of buttons, wherein each of said plurality of wrapping tasks is initiated by pressing at least one of said buttons; and instructing said robotic device, via said processor, to perform each task of said plurality of wrapping tasks, in response to at least one of said signals from said remote control.

58. A method for wrapping an annular object as in claim 57, further comprising:

rotating said annular object about its rotational axis via said rotating device; and controlling rotation of said rotating device, via said processor, in response to at least one of said signals received from said remote control.

59. A method for wrapping an annular object as in claim 58, wherein:

controlling rotation of said rotating device via said processor in accordance with the wrapping tasks of said robotic device in response to signals received from said remote control.

60. A method for wrapping an annular object as in claim 57 using a pair of variable-tension handles for dispensing said wrapping material, wherein said at least one robotic device includes a first and second robotic arm, each arm including a pair of grippers, further comprising:

grasping said handles with a first pair of grippers mounted on said first arm; releasing the handles from a second pair of grippers mounted on said second arm; carrying said material around said object, via the first arm, to the second arm; grasping the handles with the second pair of grippers mounted on the second arm; releasing the handles from the first pair of grippers mounted on the first arm; and carrying said material around said object, via the second arm, back to the first arm;

such that said at least one surface of said annular object includes its outside surface and the inside surface of its cylindrical center hole.

61. A method for wrapping an annular object as in claim 60, further comprising:

repeating the cycle of grasping, releasing, and carrying steps as said object rotates, such that all inside and outside surfaces of said object are covered with wrapping material;

wherein the repetitive cycle of grasping, releasing, and carrying is initiated and/or terminated by pressing at least one of said remote control buttons.

62. A method for wrapping a plurality of substantially annular objects with wrapping material as in claim 57, at a plurality of wrapping stations, each station having its own rotating device to rotate one of said plurality of objects, further comprising:

rotating a first annular object at a first wrapping station via a first rotating device;

carrying said wrapping material around said first annular object via said robotic device, including a pair of robotic arms;

moving said pair of robotic arms between said first wrapping station and a second wrapping station via a pair of movable platforms, each supporting one of said pair of robotic arms;

rotating a second annular object at said second wrapping station via a second rotating device;

carrying said wrapping material around said second annular object via said pair of robotic arms;

moving said robotic arms to and from said first or said second annular object via a second pair of movable platforms, each also supporting one of said robotic arms; wherein said moving steps comprise a plurality of moving tasks, each task being initiated by at least one of said plurality of buttons on said remote control, such that said processor, coupled to said movable platforms, instructs said platforms to move in accordance with each of said plurality of moving tasks, in response to signals from said remote control.

63. An apparatus for wrapping a plurality of substantially annular objects with wrapping material on a plurality of rotating devices as in claim 62, further comprising:

moving said wrapping arms between said second station and a third station via said first pair of moving platforms;

rotating a third annular object at said third wrapping station via a third rotating device;

carrying said wrapping material around said third annular object via said pair of robotic arms; and moving said wrapping arms to and from said third annular object via said second pair of movable platforms;

wherein each of said moving tasks with respect to said third station and said third object are also initiated via said processor in response to a signal from said remote control.

64. A method for wrapping a plurality of substantially annular objects with wrapping material dispensed as a sheet from a roll at a plurality of wrapping stations, each station having its own rotating device to rotate one of said plurality of objects, comprising:

rotating a first annular object at a first wrapping station via a first rotating device;

carrying said wrapping material around said first annular object via said at least one robotic arm, including a pair of robotic arms, each having at least one gripper for grasping said roll of material as it carried;

moving said pair of robotic arms between said first wrapping station and a second wrapping station via a first pair of movable platforms, each supporting one of said pair of robotic arms;

rotating a second annular object at said second wrapping station via a second rotating device; and carrying said wrapping material around said second annular object via said pair of robotic arms in the grasp of said at least one gripper mounted on each arm;

such that said at least one surface of said annular object includes its outside surface and the inside surface of its cylindrical center hole.

65. A method for wrapping a plurality of substantially annular objects with wrapping material on a plurality of rotating devices as in claim 64, further comprising:

moving said robotic arms to and from said first or said second annular object via a second pair of movable platforms, each also supporting one of said robotic arms.

66. A method for wrapping a plurality of substantially annular objects with wrapping material on a plurality of rotating devices as in claim 65, said plurality of stations including a third wrapping station with its own rotating device, further comprising:

moving said robotic arms between said second and said third stations via said first moving platforms;

moving said robotic arms to and from a third annular object at said third station via said second movable platforms;

rotating said third annular object at said third wrapping station via a third rotating device; and carrying said wrapping material around said third annular object via said pair of robotic arms.

67. A method for wrapping a plurality of substantially annular objects with wrapping material on a plurality of rotating devices as in claim 66 under control of a processor, wherein said processor control further comprises:

initiating, monitoring and terminating, upon completion, each of said moving steps by said first platforms, each of said moving steps by said second platforms, each of said rotating steps by said rotating device, and each of said carrying steps by said robotic arms; such that each of said first, second, and third annular objects are completely wrapped after completing said carrying steps at said first, second, and third stations, respectively.

68. A method for wrapping a substantially annular object with wrapping material dispensed as a sheet from a roll, using a rotating device and at least one robotic arm under control of a processor, comprising:

grasping said roll of wrapping material with at least one gripper mounted on said at least one robotic arm;

carrying said wrapping material, via said robotic arm, around at least one surface of said annular object, including at least the inner surface of its cylindrical center hole; and dispensing said roll of wrapping material under tension as said material is carried around said annular object, via at least one variable-tensioning device inserted in said roll of material, such that the dispensed sheet of material is wrapped substantially taut across each said surface wrapped.

69. A method for wrapping an annular object as in claim 68, wherein said dispensing step further comprises:

maintaining the braking tension of the wrapping material as it is dispensed during said carrying task, via a non-rotating circular brake in said variable-tension device.

70. A method for wrapping an annular object as in claim 68, wherein said at least one robotic arm includes a pair of robotic arms, each arm further including at least one slide, said carrying step further comprising:

raising and lowering each of said robotic arms, via said at least one slide, from the cylindrical center hole to the outside surface of said annular object;

such that said at least one surface of said annular object includes its outer surface and the inner surface of its cylindrical center hole.

71. A method for wrapping an annular object as in claim 70, wherein said at least one robotic arm includes a first and second robotic arm, and said at least one gripper includes a first and second pair of grippers, further comprising:

grasping said material with said first pair of grippers mounted on said first arm; carrying said material around said object to said second arm; exchanging said material with said second pair of grippers mounted on said second arm; carrying material around said object back to said first arm; and dispensing said material under tension as it is carried around said object, such that it wraps tautly and smoothly against each exposed surface of said object it traverses.

72. A method for wrapping an annular object as in claim 70, wherein each of said pair of arms include a pair of grippers, and said at least one variable-tensioning device includes a pair of variable-tensioning handles for dispensing said wrapping material, further comprising:

grasping said material with a first pair of grippers mounted on said first arm;

releasing the handles from a second pair of grippers mounted on said second arm;

carrying said material around said object, via the first arm, to the second arm; grasping the handles with the second pair o grippers mounted on the second arm; releasing the handles from the first pair of grippers mounted on the first arm; carrying said material around said object, via the second arm, back to the first arm; and dispensing said material under tension as it is carried around said object, such that it wraps tautly and smoothly against each exposed surface of said object it traverses;

such that said at least one surface of said annular object includes its outside surface and the inside surface of its cylindrical center hole.

73. A method for wrapping an annular object as in claim 72, further comprising:

rotating said annular object about its rotational axis via said rotating device; and repeating the cycle of grasping, releasing, and carrying as said object rotates, such that all inside and outside surfaces of said object are covered tautly with wrapping material.

74. A method for wrapping an annular object as in claim 69, wherein said wrapping material is pre-loaded on a cylindrical cardboard roll with a hollow center, and said variable-tension devices are handles, wherein pre-setting said tension comprises:

selection the braking tension by varying the pressure against a non-rotating circular brake plate, via an adjusting knob on the inside end of each variable-tension handle;

generating said braking tension by pressing said brake plate against a matching circular brake, rigidly secured to the non-rotating outside end of said handle which fits smoothly into said at least one gripper during said wrapping task; and allowing the roll of wrapping material to rotate during said wrapping task via an internal needle bearing, pressed into a rotating hollow sleeve which fits snugly into the circular end of said roll;

wherein said adjusting knob presses the non-rotating circular brake against the rotating outer race of said internal bearing to increase or decrease braking, in response to said adjusting knob being turned clockwise or counter-clockwise, respectively.

75. A method for wrapping an annular object as in claim 74, wherein said variable-tension handles are drawn tightly together to immobilize said roll, comprising:

twisting said pair of pre-tensioned handles securely together via a threaded connecting rod, as they are inserted facing each other into both ends of the roll of wrapping material; and sinking concentric rings of locking spikes, facing inward from an outer flange on the rotating sleeve of each handle, into the circular ends of said roll of wrapping material as the handles are twisted together, such that the roll is prevented from slipping around the outside of said rotating sleeve.

76. A method for wrapping a plurality of substantially annular objects with wrapping material as in claim 68, at a plurality of wrapping stations, each station having its own rotating device to rotate one of said plurality of objects, further comprising:

rotating a first annular object at a first wrapping station via a first rotating device;

carrying said wrapping material around said first annular object via said at least one robotic arm, including a pair of robotic arms;

moving said pair of robotic arms between said first wrapping station and a second wrapping station via a pair of movable platforms, each supporting one of said pair of robotic arms;

rotating a second annular object at said second wrapping station via a second rotating device;

carrying said wrapping material around said second annular object via said pair of robotic arms; and dispensing said material under tension as it is carried around said object, such that it wraps tautly and smoothly against each exposed surface of said object it traverses;

such that said at least one surface of said annular object includes its outside surface and the inside surface of its cylindrical center hole.

77. A method for wrapping a plurality of substantially annular objects with wrapping material on a plurality of rotating devices as in claim 76, further comprising:

moving said robotic arms to and from said first or said second annular object via a second pair of movable platforms, each also supporting one of said robotic arms.

78. A method for wrapping a plurality of substantially annular objects with wrapping material on a plurality of rotating devices as in claim 77, said plurality of stations including a third wrapping station with its own rotating device, further comprising:

moving said robotic arms between said second and said third stations via said first moving platforms; and moving said robotic arms to and from said third annular object at said third station via said second movable platforms.

79. An apparatus for wrapping a substantially annular object with wrapping material dispensed as a sheet from a roll, comprising:

at least one sensing device for generating signals indicative of the size of said annular object;

an adaptive rotating device for rotating said annular object about its rotational axis;

at least one adaptive robotic arm for carrying said wrapping material around at least one surface of said annular object as it rotates, said at least one surface including the inside surface of the object's cylindrical hole;

at least one gripper, mounted on said robotic arm, for grasping the roll of wrapping material as it is carried;

at least one variable-tensioning device, inserted in said roll of wrapping material, for dispensing the material under tension as said material is carried around said annular object, such that the dispensed sheet of material is wrapped substantially taut across each said surface wrapped;

a processor, coupled to said sensing device and said adaptive robotic arm, for adapting said robotic arm in response to signals received from said sensing device;

said processor, also coupled to said adaptive rotating device, for adapting said rotating device in response to signals received from said sensing device; and a remote control, including a plurality of buttons, for sending command signals to said processor, wherein each of said generating, adapting, rotating, and carrying tasks is initiated by pressing at least one of said buttons.

80. An apparatus for wrapping a plurality of substantially annular objects with wrapping material on first and second said adaptive rotating devices as in claim 79, further comprising:

a first wrapping station having a first adaptive rotating device for rotating a first annular object;

a second wrapping station having a second adaptive rotating device for rotating a second annular object;

said at least one adaptive robotic arm including two adaptive robotic arms for carrying said wrapping material around said first or said second annular object; and a pair of movable platforms, each supporting one of said robotic arms, for moving said robotic arms between said first wrapping station and said second wrapping station.

81. An apparatus for wrapping a substantially annular object with wrapping material dispensed as a sheet from a roll, comprising:

a rotating device for rotating said annular object about its rotational axis;

at least one adaptive robotic arm for carrying said roll of wrapping material around at least one surface of said annular object as it rotates, said at least one surface including the inside surface of the object's cylindrical hole; and at least one gripper having two opposing surfaces, mounted on said robotic arm for grasping the roll of wrapping material between said opposing surfaces such that the material is securely held for enabling said at least one robotic arm to carry the material around said at least one surface of said annular object.

82. An apparatus for wrapping an annular object as in claim 81, wherein:

said at least one robotic arm includes a pair of robotic arms; and said at least one gripper includes a pair of grippers, at least one of said pair of grippers mounted on each robotic arm.

83. An apparatus for wrapping an annular object as in claims 82, wherein:

said at least one gripper includes two pair of grippers, at least one pair of said grippers mounted on each robotic arm.

84. An apparatus for wrapping an annular object as in claim 81, wherein:

said rotating device includes a pair of coil rollers for supporting said annular object and rotating it about its rotational axis.

85. An apparatus for wrapping an annular object as in claim 81, further comprising:

at least one pair of slides for raising and lowering said at least one robotic arm from the center hole to the outside surface of said annular object;

wherein said at least one surface of said annular object includes its outer surface and the inner surface of its cylindrical center hole.

86. The apparatus for wrapping an annular object as in claim 85 wherein:

said at least one pair of slides includes two pairs of slides; and said at least one robotic arm includes a pair of robotic arms, each robotic arm mounted upon one of said two pairs of slides.

87. The apparatus for wrapping an annular object as in claim 86 further comprising:

a pair of chasses, each supporting a pair of said vertical slides as an integral unit, for keeping said vertical slides rigid while the robotic arms are wrapping the object.

88. An apparatus for wrapping an annular object as in claim 81, further comprising:

at least one sensing device for generating signals indicative of the size of said annular object; and a processor, coupled to said sensing device and said at least one robotic arm, for adapting said robotic arm in response to signals received from said sensing device.

89. An apparatus for wrapping an annular object as in claim 88, further wherein:

said at least one sensing device senses the height of said object and its cylindrical rotational axis, and the distance between said object and said robotic arm; and said processor adapts said at least one robotic arm to wrap said object in accordance sensed height and rotational axis of said object, and the sensed distance to said object.

90. An apparatus for wrapping an annular object as in claim 81, wherein:

said processor is also coupled to said rotating device, and adapts said rotating device in response to signals received from said at least one sensing device.

91. An apparatus for wrapping an annular object as in claim 90, wherein:

said at least one sensing device senses the height of said object and its cylindrical rotational axis, and the distance between said object and said robotic device;

said processor adapts said robotic device to wrap said object in accordance with the sensed height and rotational axis of said object, and the sensed distance to said object; and said processor adapts said rotating device to wrap said object in accordance with the sensed height and rotational axis of said object, and the width of said object based upon the sensed distance of said robotic device to said object.

92. An apparatus for wrapping a substantially annular object with wrapping material as in claim 81, wherein said carrying step comprises a plurality of tasks, further comprising:

a processor, coupled to said robotic arm, for instructing said robotic arm to perform each task of said plurality of carrying tasks; and a remote control, including a plurality of buttons, for sending signals to said processor, wherein each of said plurality of carrying tasks is initiated by pressing one said buttons.

93. An apparatus for wrapping an annular object as in claim 92, wherein:

said processor, also coupled to said rotating device, controls rotation of said rotating device in accordance with the carrying tasks of said robotic arm, in response to at least one of said signals received from said remote control.

94. An apparatus for wrapping a substantially annular object with wrapping material in claim 81, further comprising:

at least one variable-tensioning device, inserted in said roll of wrapping material, for dispensing the material under tension as said material is carried around said annular object.

95. An apparatus for wrapping an annular object as in claim 94, wherein:

said at least one robotic arm includes a pair of robotic arms; and said at least one gripper includes a pair of grippers, at least one of said pair of grippers mounted on each robotic arm.

96. An apparatus for wrapping an annular object as in claim 95, wherein:

said at least one gripper includes two pair of grippers, at least one pair of said grippers mounted on each robotic arm; and said at least one variable-tension device includes a pair of variable-tension handles, inserted in each end of said roll of wrapping material.

97. An apparatus for wrapping an annular object as in claim 96, wherein said pair of variable-tension handles further comprise:

a non-rotating circular brake in each variable-tension handle for maintaining the braking tension on the wrapping material as it is dispensed during said carrying task.

98. An apparatus for wrapping a plurality of substantially annular objects with wrapping material on a plurality of rotating devices as in claim 81, further comprising:

a first wrapping station, having a first rotating device for rotating a first annular object;

a second wrapping station, having a second rotating device for rotating a second annular object;

said at least one robotic arm including a pair of robotic arms for carrying said wrapping material around said first or said second annular object; and a pair of movable platforms, each supporting one of said robotic arms, for moving said robotic arms between said first wrapping station and said second wrapping station.

99. An apparatus for wrapping a plurality of substantially annular objects with wrapping material on a plurality of rotating devices as in claim 98, further comprising:

a second pair of movable platforms, each also supporting one of said robotic arms, for moving said robotic arms to and from said first or said second annular object.

100. An apparatus for wrapping a plurality of substantially annular objects with wrapping material on a plurality of rotating devices as in claim 99, further comprising:

a third wrapping station, having a third rotating device for rotating a third annular object; wherein said movable platforms also move said robotic arms between said second and said third stations, and to and from said third annular object.

101. An apparatus for wrapping a substantially annular object having a center hole including an inner surface with wrapping material dispensed as a sheet from a roll, comprising:

at least one sensing device for generating signals indicative of the size of said annular object;

an adaptive robotic device for wrapping said annular object including the inner surface of said center hole, such that it adapts its path of travel to the size of said object;

at least one gripper having two opposing surfaces, mounted on said robotic device, for grasping the roll of wrapping material between said opposing surfaces such that the material is securely held while being wrapped; and a processor, coupled to said sensing device and said adaptive robotic device, for adapting said robotic device in response to signals received from said sensing device.

102. An apparatus for wrapping an annular object as in claim 101, wherein:

said at least one sensing device senses the height of said object and its cylindrical rotational axis, and the distance between said object and said robotic device; and said processor adapts said robotic device to wrap said object in accordance with the sensed height and rotational axis of said object, and the sensed distance to said object.

103. An apparatus for wrapping an annular object as in claim 101, wherein:

said at least one sensing device includes a first sensing device for sensing the height of said object and its cylindrical rotational axis;

said at least one sensing device also includes a second sensing device for sensing the distance between said object and said adaptive robotic device; and said processor adapts said robotic device to wrap said object in accordance with the sensed height and rotational axis of said object, and the sensed distance to said object.

104. An apparatus for wrapping an annular object as in claim 101, further comprising:

an adaptive rotating device for rotating said annular object about its rotational axis;

said processor, also coupled to said adaptive rotating device, for adapting said rotating device in response to signals received from said at least one sensing device.

105. An apparatus for wrapping an annular object as in claim 104, wherein:

said at least one sensing device senses the height of said object and its cylindrical rotational axis, and the distance between said object and said robotic device;

said processor adapts said robotic device to wrap said object in accordance with the sensed height and rotational axis of said object, and the sensed distance to said object;

said processor adapts said rotating device to wrap said object in accordance with the sensed height and rotational axis of said object, and the width of said object based upon the sensed distance of said robotic device to said object.

106. An apparatus for wrapping an annular object as in claim 105, wherein:

said processor adapts said rotating device by adjusting its speed such that a portion of said wrapping material is overlapped on the outer surface of said object as it is wrapped.

107. An apparatus for wrapping an annular object as in claim 104, wherein:

said at least one sensing device includes a first sensing device for sensing the height of said object and its cylindrical rotational axis;

said at least one sensing device also includes a second sensing device for sensing the distance between said object and said adaptive robotic device; and said processor adapts said robotic device to wrap said object in accordance with the sensed height and rotational axis of said object, and the sensed distance to said object.

108. An apparatus for wrapping a substantially annular object with wrapping material in claim 101, wherein said wrapping function comprises a plurality of tasks, further comprising:

said processor, coupled to said robotic device, instructing said robotic device to perform each task of said plurality of wrapping tasks; and a remote control, including a plurality of buttons, for sending signals to said processor, wherein each of said plurality of wrapping tasks is initiated by pressing one said buttons.

109. An apparatus for wrapping an annular object as in claim 108, further comprising:

A rotating device for rotating said annular object about its rotational axis;

wherein said processor, also coupled to said rotating device, controls rotation of said rotating device in accordance with the wrapping tasks of said robotic arm, in response to at least one of said signals received from said remote control.

110. An apparatus for wrapping a substantially annular object with wrapping material as in claim 101, further comprising:

said adaptive robotic device includes a pair of wrapping arms;

at least one pair of grippers, one of said grippers mounted on each wrapping arm; and at least one variable-tensioning device, inserted in said roll of wrapping material, for dispensing the material under tension as said material is wrapped around said annular object.

111. An apparatus for wrapping an annular object as in claim 110, wherein:

said at least one pair of gripper includes two pair of grippers, at least one pair of said grippers mounted on each wrapping arm; and said at least one variable-tension device includes a pair of variable-tension devices, inserted in each end of said roll of wrapping material.

112. An apparatus for wrapping an annular object as in claim 111, wherein said pair of variable-tension devices are handles which further comprise:

a non-rotating circular brake in each variable-tension handle for maintaining the braking tension on the wrapping material as it is dispensed during said wrapping task.

113. An apparatus for wrapping a plurality of substantially annular objects with wrapping material on a plurality of rotating devices as in claim 101, further comprising:

a first wrapping station, having a first rotating device for rotating a first annular object;

a second wrapping station, having a second rotating device for rotating a second annular object;

said adaptive robotic device including a pair of robotic arms for carrying said wrapping material around said first or said second annular object; and a pair of movable platforms, each supporting one of said robotic arms, for moving said robotic arms between said first wrapping station and said second wrapping station.

114. An apparatus for wrapping a plurality of substantially annular objects with wrapping material on a plurality of rotating devices as in claim 113, further comprising:

a second pair of movable platforms, each also supporting one of said robotic arms, for moving said robotic arms to and from said first or said second annular object.

115. An apparatus for wrapping a plurality of substantially annular objects with wrapping material on a plurality of rotating devices as in claim 114, further comprising:

a third wrapping station, having a third rotating device for rotating a third annular object; wherein said movable platforms also move said robotic arms between said second and said third stations, and to and from said third annular object.

116. The apparatus for wrapping an annular object as in claim 101, wherein said processor further comprises:

a first card and a second card, each with its own digital and analog inputs/outputs, for controlling the motion of, and receiving feedback from, all electronic system components including said rotating device, said at least one robotic device, and said sensing devices.

117. The apparatus for wrapping an annular object as in claim 116, further comprising:

computer programs running continuously within said first and second cards, for analyzing the feedback from said digital and analog inputs, and for issuing said digital and analog outputs to control the sequence of steps required for each major task, including moving to calculated positions, sensing dimensions of the object, rotating the rotating device, and wrapping the object.

118. The apparatus for wrapping an annular object as in claim 117 wherein said computer programs control execution of said major tasks, further comprising:

two pairs of asynchronous communication lines for transferring control signals between said first and second cards so as to effect a master/slave relationship between them, respectively, one pair of said lines dedicated to each signal direction; and asynchronous protocol within the computer programs, responsive to said asynchronous control signals, permitting the cards to synchronize events via said communication lines, wherein:

said first master card, upon operator request, decides which major tasks will be performed at what time, and sends unique commands to said slave card; and said second slave card, upon receipt of a master command, acknowledges the command, performs the requested task, and reports back the results of that task.

119. An apparatus for wrapping a substantially annular object with wrapping material dispensed as a sheet from a roll, comprising:

at least one sensing device for generating signals indicative of the size of said annular object;

an adaptive rotating device for rotating said annular object about its rotational axis;

at least one adaptive robotic device for carrying said wrapping material around at least one surface of said annular object as it rotates, such that it adapts its path of travel to the size of said object;

at least one gripper having two opposing surfaces, mounted on said robotic device, for grasping the roll of wrapping material between said opposing surfaces such that the material is securely held as it is carried by said robotic device; and a processor, coupled to said sensing device, said adaptive robotic device and said adaptive rotating device, for adapting said rotating device and said robotic device in response to signals received from said sensing device.

120. An apparatus for wrapping an annular object as in claim 119, wherein:

said at least one sensing device senses the height of said object and its cylindrical rotational axis, and the distance between said object and said robotic device; and said processor adapts said rotating device to rotate said object in accordance with the sensed height and rotational axis of said object, and the sensed width of said object based upon the distance of said at least one robotic device to said object.

121. An apparatus for wrapping an annular object as in claim 120, wherein:

said processor adapts said rotating device by adjusting its speed such that a portion of said wrapping material is overlapped on the outer surface of said object as it is wrapped.

122. An apparatus for wrapping an annular object as in claim 119, wherein:

said at least one sensing device includes a first sensing device for sensing the height of said object and its cylindrical rotational axis;

said at least one sensing device also includes a second sensing device for sensing the distance between said object and said at least one robotic device; and said processor adapts said rotating device to rotate said object in accordance with the sensed height and rotational axis of said object, and the width of said object based upon the sensed distance of said at least one robotic device to said object.

123. An apparatus for wrapping a substantially annular object with wrapping material in claim 119, wherein said carrying function comprises a plurality of tasks, further comprising:

said processor, coupled to said robotic device, instructing said robotic device to perform each task of said plurality of carrying tasks; and a remote control, including a plurality of buttons, for sending signals to said processor, wherein each of said plurality of carrying tasks is initiated by pressing one said buttons.

124. An apparatus for wrapping an annular object as in claim 123, wherein:

said processor controls rotation of said rotating device in accordance with the carrying tasks of said robotic arm, in response to at least one of said signals received from said remote control.

125. An apparatus for wrapping a substantially annular object with wrapping material in claim 119, further comprising:

said robotic device includes a pair of robotic arms;

at least one pair of grippers, one of said grippers mounted on each robotic arm; and at least one variable-tensioning device, inserted in said roll of wrapping material, for dispensing the material under tension as said material is carried around said annular object.

126. An apparatus for wrapping an annular object as in claim 125, wherein:

said at least one pair of gripper includes two pair of grippers, at least one pair of said grippers mounted on each robotic arm; and said at least one variable-tension device includes a pair of variable-tension devices, inserted in each end of said roll of wrapping material.

127. An apparatus for wrapping an annular object as in claim 126, wherein said pair of variable-tension devices are handles which further comprise:

a non-rotating circular brake in each variable-tension handle for maintaining the braking tension on the wrapping material as it is dispensed during said carrying task.

128. An apparatus for wrapping a plurality of substantially annular objects with wrapping material on a plurality of rotating devices as in claim 119, further comprising:

a first wrapping station, having a first rotating device for rotating a first annular object;

a second wrapping station, having a second rotating device for rotating a second annular object;

said at least one robotic device including a pair of robotic arms for carrying said wrapping material around said first or said second annular object; and a pair of movable platforms, each supporting one of said robotic arms, for moving said robotic arms between said first wrapping station and said second wrapping station.

129. An apparatus for wrapping a plurality of substantially annular objects with wrapping material on a plurality of rotating devices as in claim 128, further comprising:

a second pair of movable platforms, each also supporting one of said robotic arms, for moving said robotic arms to and from said first or said second annular object.

130. An apparatus for wrapping a plurality of substantially annular objects with wrapping material on a plurality of rotating devices as in claim 129, further comprising:

a third wrapping station, having a third rotating device for rotating a third annular object;

wherein said movable platforms also move said robotic arms between said second and said third stations, and to and from said third annular object.

131. The apparatus for wrapping an annular object as in claim 119, wherein said processor further comprises:

a first card and a second card, each with its own digital and analog inputs/outputs, for controlling the motion of, and receiving feedback from, all electronic system components including said arms, grippers, slides, and said rotating device, and all position sensors attached thereto.

132. The apparatus for wrapping an annular object as in claim 131, further comprising:

computer programs comprising operating modules running continuously within said first and second cards, respectively, for analyzing the feedback from said digital and analog inputs, and for issuing said digital and analog outputs to control the sequence of steps required for each major task, including moving to calculated positions, sensing dimensions of the object, rotating the rotating device, and wrapping the object.

133. The apparatus for wrapping an annular object as in claim 132 wherein, to execute any of said major tasks controlled by said computer programs, said apparatus further comprises:

two pairs of asynchronous communication lines for transferring control signals between said first and second cards so as to effect a master/slave relationship, respectively, between them; and asynchronous protocol within the computer programs, responsive to said asynchronous control signals, permitting the cards to synchronize events via said communication lines, one pair dedicated to each signal direction, wherein:

said first master card, upon operator request, decides which major tasks will be performed at what time, and sends unique commands to said slave card;

said second slave card, upon receipt of a master command, acknowledges the command, performs the requested task, and reports back the results of that task.

134. An apparatus for wrapping a substantially annular object with wrapping material dispensed as a sheet from a roll, comprising:

an adaptive a robotic device for wrapping said annular object, wherein said wrapping function comprises a plurality of tasks, including the task of wrapping said object by carrying said material across at least one surface of said annular object;

at least one gripper having two opposing surfaces, mounted on said robotic device, for gasp the roll of wrapping material between said opposing surfaces such that the material is securely held as it is carried by said robotic device;

a processor, coupled to said robotic device, for instructing said robotic device to perform each task of said plurality of tasks; and a remote control, including a plurality of buttons, for sending signals to said processor, wherein each of said plurality of wrapping tasks is initiated by pressing one said buttons.

135. An apparatus for wrapping an annular object as in claim 134, further comprising:

A rotating device for rotating said annular object about its rotational axis; and said processor, also coupled to said rotating device, controlling rotation of said rotating device in response to at least one of said signals received from said remote control.

136. An apparatus for wrapping an annular object as in claim 135, wherein:

said processor controls rotation of said rotating device in accordance with the wrapping tasks of said robotic device, in response to at least one of said signals received from said remote control.

137. An apparatus for wrapping a substantially annular object with wrapping material in claim 134, further comprising:

said robotic device includes a pair of robotic arms;

at least one pair of grippers, one of said grippers mounted on each robotic arm; and at least one variable-tensioning device, inserted in said roll of wrapping material, for dispensing the material under tension as said material is wrapped around said annular object.

138. An apparatus for wrapping an annular object as in claim 137, wherein:

said at least one pair of gripper includes two pair of grippers, at least one pair of said grippers mounted on each robotic arm; and said at least one variable-tension device includes a pair of variable-tension devices, inserted in each end of said roll of wrapping material.

139. An apparatus for wrapping an annular object as in claim 138, wherein said pair of variable-tension devices are handles which further comprise:

a non-rotating circular brake in each variable-tension handle for maintaining the braking tension on the wrapping material as it is dispensed during said wrapping task.

140. An apparatus for wrapping a plurality of substantially annular objects with wrapping material on a plurality of rotating devices as in claim 135, further comprising:

a first wrapping station, having a first rotating device for rotating a first annular object;

a second wrapping station, having a second rotating device for rotating a second annular object;

said robotic device including a pair of wrapping arms for carrying said wrapping material around said first or said second annular object;

a pair of movable platforms, each supporting one of said wrapping arms, for moving said wrapping arms between said first wrapping station and said second wrapping station; and a second pair of movable platforms, each also supporting one of said wrapping arms, for moving said wrapping arms to and from said first or said second annular object; wherein said moving functions comprise a plurality of moving tasks, each task being initiated by at least one of said plurality of buttons on said remote control, such that said processor, coupled to said movable platforms, instructs said platforms to move in accordance with each of said plurality of moving tasks, in response to signals from said remote control.

141. An apparatus for wrapping a plurality of substantially annular objects with wrapping material on a plurality of rotating devices as in claim 140, further comprising:

a third wrapping station, having a third rotating device for rotating a third annular object;

wherein said movable platforms also move said wrapping arms between said second and said third stations, and to and from said third annular object; and wherein said moving tasks with respect to said third station and said third object are also initiated by said remote control via said processor.

142. An apparatus for wrapping a substantially annular object with wrapping material dispensed as a sheet from a roll, comprising:

at least one wrapping arm for carrying said wrapping material around at least one surface of said annular object;

at least one gripper, mounted on said wrapping arm, for grasping the roll of wrapping material; and at least one variable-tensioning device, inserted in said roll of wrapping material, for dispensing the material under tension as said material is carried around said annular object, such that the dispensed sheet of material is wrapped substantially taut across each said surface wrapped.

143. An apparatus for wrapping an annular object as in claim 142, wherein:

said at least one wrapping arm includes a pair of wrapping arms; and said at least one gripper includes a pair of grippers, at least one of said pair of grippers mounted on each wrapping arm.

144. An apparatus for wrapping an annular object as in claim 143, wherein:

said at least one gripper includes two pair of grippers, at least one pair of said grippers mounted on each wrapping arm; and said at least one variable-tension device includes a pair of variable-tension devices, inserted in each end of said roll of wrapping material.

145. An apparatus for wrapping an annular object as in claim 143, wherein said wrapping material is pre-loaded on a cylindrical cardboard roll with a hollow center, and said variable-tension devices are handles, each of which further comprises:

an adjusting knob, on the inside end of each variable-tension handle, for pre-setting the braking tension by varying the pressure against a non-rotating circular brake plate;

a matching circular brake for generating said tension, rigidly secured to the non-rotating outside end of the handle which fits smoothly into the grippers during the wrapping task;

an internal needle bearing pressed into a rotating hollow sleeve that fits snugly into the circular end of the roll of wrapping material, allowing it to rotate during the wrapping task;

wherein said adjusting knob presses the non-rotating circular brake against the rotating outer race of said internal bearing to increase or decrease braking, in response to said adjusting knob being turned clockwise or counter-clockwise, respectively.

146. The apparatus for wrapping an annular object as in claim 145 wherein said variable-tension handles further comprise:

a threaded connecting rod for twisting the pair of pre-tensioned handles securely together as they are inserted facing each other into both ends of the roll of wrapping material; and an outer flange on the rotating sleeve of each handle, containing a concentric ring of inward-facing locking spikes which sink into the circular ends of said roll of wrapping material as the handles are twisted together, such that the roll is prevented from slipping around the outside of said rotating sleeve.

147. An apparatus for wrapping a plurality of substantially annular objects with wrapping material on a plurality of rotating devices as in claim 143, further comprising:

a first wrapping station, having a first rotating device for rotating a first annular object;

a second wrapping station, having a second rotating device for rotating a second annular object;

said at least one wrapping arm including a pair of wrapping arms for carrying said wrapping material around said first or said second annular object; and a pair of movable platforms, each supporting one of said wrapping arms, for moving said wrapping arms between said first wrapping station and said second wrapping station.

148. An apparatus for wrapping a plurality of substantially annular objects with wrapping material on a plurality of rotating devices as in claim 147, further comprising:

a second pair of movable platforms, each also supporting one of said wrapping arms, for moving said wrapping arms to and from said first or said second annular object.

149. An apparatus for wrapping a plurality of substantially annular objects with wrapping material on a plurality of rotating devices as in claim 148, further comprising:

a third wrapping station, having a third rotating device for rotating a third annular object;

wherein said movable platforms also move said wrapping arms between said second and said third stations, and to and from said third annular object.

150. An apparatus for wrapping a plurality of substantially annular objects with wrapping material dispensed as a sheet from a roll on a plurality of rotating devices, comprising:

a first wrapping station, having a first rotating device for rotating a first annular object;

a second wrapping station, having a second rotating device for rotating a second annular object;

a pair of robotic devices for carrying said wrapping material around said first or said second annular object;

at least one gripper having two opposing surfaces, mounted on each robotic device, for grasping the roll of wrapping material between said opposing surfaces such that the material is securely held as it is carried by said robotic devices; and a pair of movable platforms, each supporting one of said robotic devices, for moving said robotic devices between said first wrapping station and said second wrapping station;

such that at least one surface of said first or said second annular object is wrapped, including its outside surface and the inside surface of its cylindrical center hole.

151. An apparatus for wrapping a plurality of substantially annular objects with wrapping material on a plurality of rotating devices as in claim 150, further comprising:

a second pair of movable platforms, each also supporting one of said robotic devices, for moving said robotic devices to and from said first or said second annular object.

152. An apparatus for wrapping a plurality of substantially annular objects with wrapping material on a plurality of rotating devices as in claim 151, further comprising:

a third wrapping station, having a third rotating device for rotating a third annular object;

said pair of robotic devices also for carrying said wrapping material around said third annular object;

a wherein said movable platforms also move said robotic devices between said second and said third stations, and to and from said third annular object.

153. An apparatus for wrapping a plurality of substantially annular objects with wrapping material on a plurality of rotating devices as in claim 152, under control of a processor, further comprising:

said processor for initiating, monitoring and terminating, upon completion, each of said moving functions by said first platforms, each of said moving functions by said second platforms, each of said rotating functions by said rotating device, and each of said carrying functions by said robotic arms; such that each of said first, second, and third annular objects are completely wrapped after completing said carrying functions at said first, second, and third stations, respectively.

* * * * *